US010215479B2

(12) United States Patent
Rindlisbach et al.

(10) Patent No.: US 10,215,479 B2
(45) Date of Patent: Feb. 26, 2019

(54) APPARATUS AND METHOD FOR ACCESSING REFRIGERATED ITEMS

(71) Applicants: Phillip J Rindlisbach, Riverton, UT (US); Nicholas James Gregory, Bountiful, UT (US)

(72) Inventors: Phillip J Rindlisbach, Riverton, UT (US); Nicholas James Gregory, Bountiful, UT (US)

( * ) Notice: Subject to any disclaimer, the term of this patent is extended or adjusted under 35 U.S.C. 154(b) by 0 days.

(21) Appl. No.: 15/018,837

(22) Filed: Feb. 8, 2016

(65) Prior Publication Data

US 2018/0120022 A1 May 3, 2018

Related U.S. Application Data

(63) Continuation-in-part of application No. 14/215,593, filed on Mar. 14, 2014, now Pat. No. 9,255,729.

(60) Provisional application No. 61/800,840, filed on Mar. 15, 2013.

(51) Int. Cl.

| | |
|---|---|
| ***F25D 25/00*** | (2006.01) |
| ***F25D 25/02*** | (2006.01) |
| ***F25D 11/02*** | (2006.01) |
| ***F25D 23/02*** | (2006.01) |
| ***F25D 23/06*** | (2006.01) |
| ***F25D 29/00*** | (2006.01) |
| ***F25D 23/00*** | (2006.01) |

(52) U.S. Cl.

CPC ..... *F25D 25/027* (2013.01); *F25D 11/02* (2013.01); *F25D 23/006* (2013.01); *F25D 23/028* (2013.01); *F25D 23/061* (2013.01); *F25D 23/062* (2013.01); *F25D 23/067* (2013.01); *F25D 23/069* (2013.01); *F25D 25/025* (2013.01); *F25D 29/003* (2013.01); *F25D 29/005* (2013.01); *F25D 2323/021* (2013.01); *F25D 2600/02* (2013.01); *F25D 2700/04* (2013.01)

(58) Field of Classification Search

CPC .... F25D 25/02; F25D 25/027; F25D 2500/02; F25D 23/028; F25D 2323/021

See application file for complete search history.

(56) References Cited

U.S. PATENT DOCUMENTS 4,123,130 A * 10/1978 Locke ..... A47B 49/004 312/236
4,191,437 A * 3/1980 Funke ..... A47B 49/00 108/94
5,056,332 A * 10/1991 Tajima ..... F25D 17/065 312/116
5,549,373 A * 8/1996 Bustos ..... A47F 3/0408 312/125

(Continued)

*Primary Examiner* — Daniel J Rohrhoff

(74) *Attorney, Agent, or Firm* — Jacob Ong; Ongs Law Firm PLLC

(57) ABSTRACT

A rotatable shelf for use in a refrigerator that may include a support bracket configured to support a turntable but is not required. A bearing assembly may be disposed between the support bracket and the turntable, wherein the bearing assembly is configured to facilitate the rotation of the turntable relative to the support bracket. Users may also rotate a rotatable drawer assembly to access items. A support bracket may be configured with notches or retaining members to maintain concentricity of the bearing assembly with the support bracket.

27 Claims, 70 Drawing Sheets

(56) References Cited

U.S. PATENT DOCUMENTS

| | | | | |
|---|---|---|---|---|
| 6,854,608 | B2 * | 2/2005 | McNeeley | A47B 49/00 211/78 |
| 6,883,887 | B1 * | 4/2005 | Mogensen | A47B 49/004 312/305 |
| 7,334,425 | B1 * | 2/2008 | Johnson | F25D 11/02 62/440 |
| 8,641,158 | B1 * | 2/2014 | Conner, Sr. | A47F 3/08 312/408 |
| 9,022,495 | B1 * | 5/2015 | Conner, Sr. | F25D 25/027 312/238 |
| 9,052,134 | B1 * | 6/2015 | Batchler | F25D 25/027 |
| 9,528,753 | B1 * | 12/2016 | Conner, Sr. | F25D 25/027 |
| 2004/0177641 | A1 * | 9/2004 | Kim | A47B 49/004 62/441 |
| 2008/0217266 | A1 * | 9/2008 | Doyal | F24C 15/16 211/1.52 |
| 2010/0231105 | A1 * | 9/2010 | Latif | A47B 46/005 312/293.1 |
| 2014/0132128 | A1 * | 5/2014 | Simon | A47F 3/0478 312/116 |
| 2014/0250943 | A1 * | 9/2014 | Pericolini | F25D 25/027 62/441 |
| 2015/0233629 | A1 * | 8/2015 | Choi | F25D 23/04 312/404 |

* cited by examiner

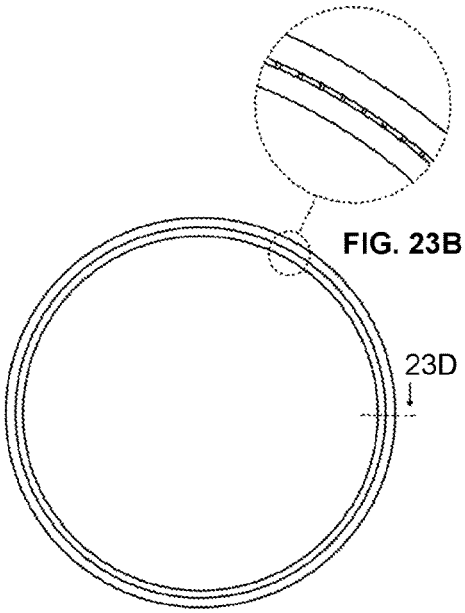
FIG. 23B
FIG. 23A
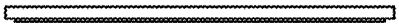
FIG. 23C
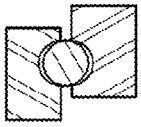
FIG. 23D
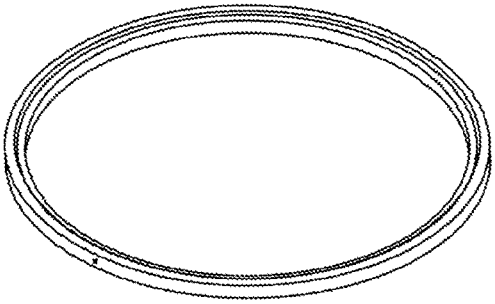
FIG. 23E

42

42

37F
42
1085

42
1085

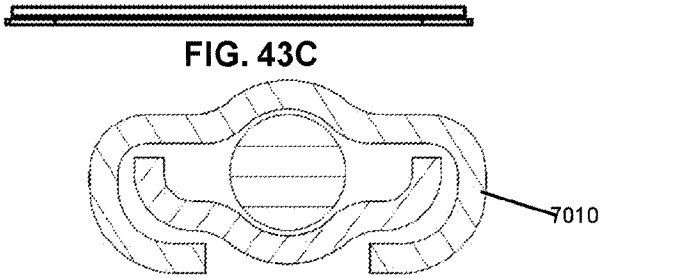
FIG. 43C
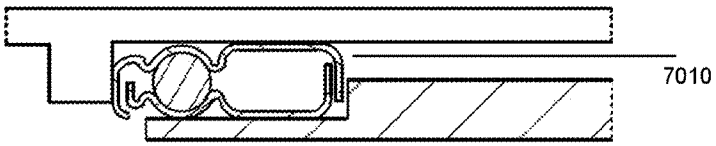
FIG. 43D
FIG. 43E
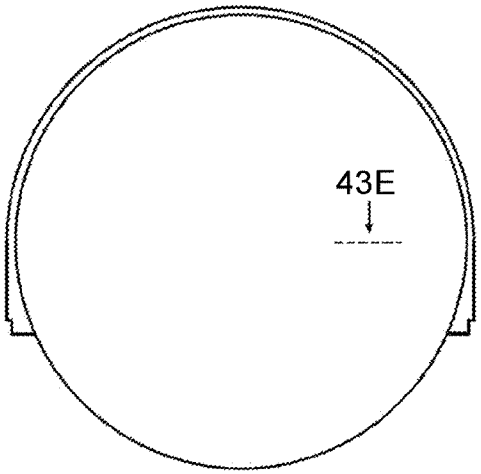
FIG. 43B

APPARATUS AND METHOD FOR ACCESSING REFRIGERATED ITEMS

CROSS-REFERENCE TO RELATED APPLICATIONS

The present non-provisional patent application claims the benefit of Non-Provisional U.S. patent application Ser. No. 14/215,593, filed on Mar. 17, 2014. Non-Provisional U.S. patent application Ser. No. 14/215,593 claims the benefit of Provisional U.S. Patent Application Ser. No. 61/800,840 filed on Mar. 15, 2013; Application Ser. No. 61/800,840 and application Ser. No. 14/215,593 are hereby incorporated by reference.

BACKGROUND OF THE INVENTION

1. The Field of the Invention

The present invention relates generally to shelving and storage space suitable for use in refrigerators. More specifically, some embodiments of the invention relate to refrigeration shelving and storage space that may be rotatable, removable, easily installable, or cleanable. Some embodiments may also include structures for supporting such shelving and storage space and may provide more convenient access to items stored thereon or improved temperature distribution.

2. Background

Traditional shelving used in conventional refrigerators is static, with such shelving and storage space generally shaped into squares or rectangles designed to follow the outer dimensions of the refrigerator. This configuration of square or rectangular fixed shelving may appear to maximize storage space within the refrigerator.

Traditional refrigerators include a refrigeration compartment located at the front of the refrigerator and accessible through a door. They also include another space, separate from the refrigeration space, which contains the mechanical components necessary to generate the refrigerated air that maintains the required cool temperature in the refrigeration compartment. This space for the mechanical components is typically rectangular and occupies most of the rear portion of the refrigerator. In some refrigerators, this space may occupy the entire rear three to four inches of the refrigerator. The refrigeration space is also typically rectangular or square, and generally contains rectangular or square shelving and/or drawers dispersed throughout. This arrangement has typically been viewed as maximizing the internal storage space of the refrigerator.

This fixed storage arrangement may, however, lead to several undesirable effects. Items stored on fixed shelving are continuously pushed towards the rear of the refrigerator as additional items are added to the shelf before the original items are removed or used. Thus, over time, the items first placed onto the shelf become inaccessible because the items placed in front of them block access. Further, not only may it be difficult to access the items that have been pushed towards the rear of the shelf, it may also be difficult to even visually see those items. The items pushed towards the rear of the shelf may become visually blocked by both the items placed in front of them and by the other shelves or structures of the refrigerator itself, especially when viewed from an angle above the shelf, as may be typical of a user standing in front of a refrigerator.

Often, this lack of visibility and/or accessibility leads to such items being forgotten about by the user. Because many items stored in a refrigerator are food items with limited shelf life, forgotten items have a greatly increased risk of expiring before being used.

Additionally, food items that have been pushed to the rear of a static shelf, and that have consequently become hard to see and access, and that have expired, may create undesirable odors within the refrigerator. The expired food items may also create increased health risks associated with bacterial growth.

Another disadvantage to the conventional static shelving used in traditional refrigerators results from the imperfect temperature distribution within refrigerators. Traditional refrigerators likely include fixed cooling vents located at the rear of the refrigerator. The fixed nature of these vents causes an unequal temperature distribution within the refrigerator, where temperatures are likely colder closer to the vents and warmer farther from the vents.

Thus, in a traditional refrigerator containing static shelving, items placed closer to the vents are stored at a colder temperature than items stored farther from the vents. The foods stored at the colder temperatures are more likely to freeze, which may be undesirable, while the foods stored at the warmer temperatures may be more likely to spoil, which also may be undesirable.

The static nature of traditional refrigerator shelving exacerbates this problem because the stored items, once placed on the shelf are subject to whichever temperature zone they happen to occupy, either warmer or colder. Further, the shelving itself creates a static obstacle that obstructs the cold air coming into the refrigeration compartments from the vents from easily mixing with the air already inside the refrigeration space, leading to increased variance in temperature throughout the refrigerator.

SUMMARY

The various implementations of the present invention are provided as a device for storing food in a refrigerator on a rotatable shelf, for increasing access to items stored on the rotatable shelf, increasing the sturdiness of rotatable shelves and associated parts, for mitigating the negative effects of the unequal temperature distribution that exists within refrigerators, or for increasing access and visibility of items stored on refrigerator shelves. In one embodiment, this invention may comprise a rotatable shelf assembly for a refrigerator. The rotatable shelf assembly may include a support bracket having a flat upper surface and an outer edge portion configured to physically engage an inner wall of a refrigerator and orient the support bracket in a substantially horizontally within the refrigerator. A bearing assembly having an upper and lower surface and at least three bearings disposed therein, wherein the bearings are configured to extend beyond the upper and lower surface, and wherein the bearings are configured to roll on the flat upper surface of the support bracket or on an inner upper surface of the support bracket may also be included. The rotatable shelf assembly may further comprise a turntable in the shape of a flat disk with an upper and lower surface, configured in size and shape such that the at least three bearings of the bearing assembly roll on the lower surface of the turntable, thus supporting the turntable. In another embodiment the refrigerator may further comprise vertically-aligned pilasters with relatively small brackets which supports the weight of the support bracket at the front of the support bracket, and the support bracket may be further configured with two notches located at the front of the support bracket so that the notches of the support bracket of the rotatable shelf assembly catch on the vertically-aligned pilasters when the support bracket is moved forward such that a flange located in the rear portion of the support bracket remains coupled with the rear interior wall of the refrigerator and the support bracket and its associated rotatable shelf assembly are prevented from tilting downward and away from a relatively horizontal alignment. In another embodiment the rotatable shelf assembly may comprise a rotatable shelf with a gradually tapering lip or chamfered lip which provides a convenient grip for a user who desires to rotate the rotatable shelf assembly by rotating the lip and also acts to retain objects placed on the rotatable shelf assembly from being flung from the rotatable shelf assembly by centrifugal forces as the rotatable shelf assembly is being rotated. In another embodiment, a two part casing surrounds a plurality of bearings and also prevents the bearings from contacting with foods and liquids which may have fallen from the rotatable shelf assembly onto the bearing assembly. In some embodiments, the invention may comprise a retaining member that is located on the underside of the rotatable shelf assembly and acts to retain the rotatable shelf assembly from being decoupled from the support bracket while the turntable is being rotated. In another embodiment a bearing assembly consists of two annular-shaped structure, wherein the two annular-shaped structure form a groove for bearings at the location of where the two annular-shaped structures meet, wherein in at least one of the rings is elevated above the other ring. In another embodiment, the refrigerator may further comprise a crisper drawer comprising a cylindrical wall coupled to a rotatable shelf assembly and configured such that a user can grasp a lip which circumscribes the crisper drawer and move the crisper drawer in a lateral direction on a plate that rests on a track, such that the crisper drawer is moved towards the user while at the same time the rotatable shelf assembly of the crisper drawer is also rotated in a clockwise or counterclockwise direction. In another embodiment, the invention may comprise a refrigerator with at least one rotatable shelf disposed within an interior space of the refrigerator, and at least one electric motor mechanically coupled to the at least one rotatable shelf and configured to cause the rotation of the at least one rotatable shelf in either a clockwise or counterclockwise direction.

In other embodiments, the invention may include shelving attached to the inner surfaces of a French-style refrigerator door and configured for use in a refrigerator that further comprises substantially circular shelving. The door shelving may extend from the inner surface of a door, wherein the distal edge portion of the door shelving may be configured to extend into an interior space of a refrigeration unit and substantially follow a radius of a substantially circular shelf disposed within the interior of the refrigerator.

In another embodiment, the invention may comprise a method for controlling rotation of a rotatable shelf for a refrigerator. The method may include providing a first switch, providing a control module connected to an input of the switch and further connected to an electric motor that is mechanically coupled to a rotatable shelf, configuring the control module to cause the electric motor to rotate the rotatable shelf a) in a clockwise direction when the switch is in a certain position, b) in counterclockwise direction when the switch is in a certain position, or c) the control module may be configured to cause the electric motor to stop rotating the rotatable shelf when the switch is in an "off" position.

These and other objects and features of the present invention will become more fully apparent from the following description and appended claims, or may be learned by the practice of the invention as set forth hereinafter.

For purposes of this application: a first compartment is also known as a refrigeration compartment; a second compartment is also known as a freezer; a turntable is also known as a rotatable disc-shaped shelf; a rotatable drawer assembly is also known as a rotatable crisper drawer; a bearing assembly is an assembly that comprises bearings and bearing holders (which are parts that are directly adjacent and in contact with at least one bearing); a bearing assembly is a bearing assembly with an annular-shape;

Proximal arc is equivalent to proximal portion; distal arc is equivalent to distal portion.

Coupled means to be in direct or indirect contact with another object; in preferred embodiments two or more objects that are coupled may be affixed by some type of physical or nonphysical means such as glue, screw, nail, mating connections, soldering, which also includes being detachably affixed which means that a relatively temporary means has been used to affix the two or more objects. Nonphysical means include magnetic forces. Detachably coupled refers to temporary coupling such as a ball bearing to a surface where the physical contact between the two objects can be easily removed by gravity or other weak force. As mentioned above, indirect coupling includes Object A being coupled to Object B and Object C being coupled to Object B would mean that Object A is coupled to Object C even if Object A is not physically contacting Object C. Additional elements may be coupled to each other in this manner.

BRIEF DESCRIPTION OF THE DRAWINGS

The preferred embodiments of the present invention will be described in conjunction with the appended drawings. Like designations denote like elements, and:

FIG. 22F shows an exploded view of the embodiment shown in FIG. 22B; in FIG. 22F, a turn table is shown at the top part of FIG. 22F, the bearing assembly of FIG. 23E is shown in the middle part of FIG. 22F, and a support bracket is shown in bottom part of the figure.

FIG. 23A is a top perspective view of an embodiment of a bearing assembly;

FIG. 23B is a an enlarged top perspective view of a portion of the embodiment of the bearing assembly depicted in FIG. 23A;

FIG. 23C is a side view of an embodiment of the bearing assembly depicted in FIG. 23A;

FIG. 23D is a cross-sectional view of an embodiment of the bearing assembly depicted in FIG. 23A;

FIG. 23E is an isometric view of an embodiment of the bearing assembly depicted in FIG. 23A.

FIG. 23F is an exploded view of a diagram of an embodiment of a support bracket, a plurality of bearings, and a bearing assembly that is ring-shaped as depicted in FIG. 23E.

FIG. 36B is an enlarged view of the top portion of the crisper drawer partition holder shown in FIG. 36A;

FIG. 36C is an enlarged view of the bottom portion of the crisper drawer partition holder shown in FIG. 36A;

FIG. 36D is an enlarged, exploded view of the partition holder shown in FIG. 36A;

FIG. 37A is a perspective view of a diagram of an embodiment of a crisper drawer and an embodiment of a partition holder;

FIG. 37B is an enlarged view of a diagram of the partition holder shown in FIG. 37A;

FIG. 37C is a perspective view of a diagram of an embodiment of a crisper drawer, a partition, and an embodiment of a partition holder;

FIG. 37D is an enlarged view of a diagram of the partition holder shown in FIG. 37C;

FIG. 37E is perspective view from the side of a diagram of an embodiment of a crisper drawer, a bottom plate, and two rails;

FIG. 37F is a cross-sectional view of the crisper drawer and the bottom plate depicted in FIG. 37E;

FIG. 38A is a perspective view of a diagram of an embodiment of a crisper drawer and an embodiment of a partition;

FIG. 39A is a side perspective view of a diagram of a rail;

FIG. 39B is an isometric view of a diagram of a rail;

Figure 40A:
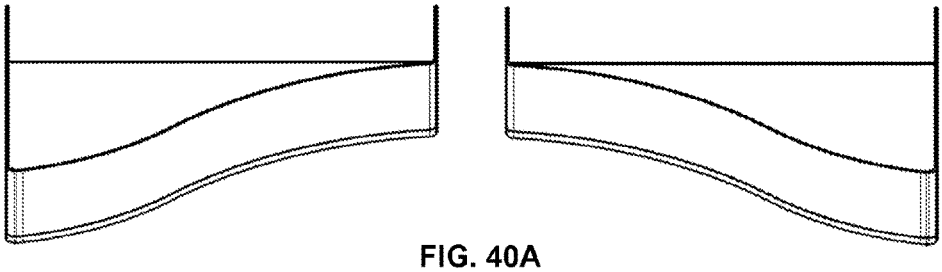
Figure 40B:
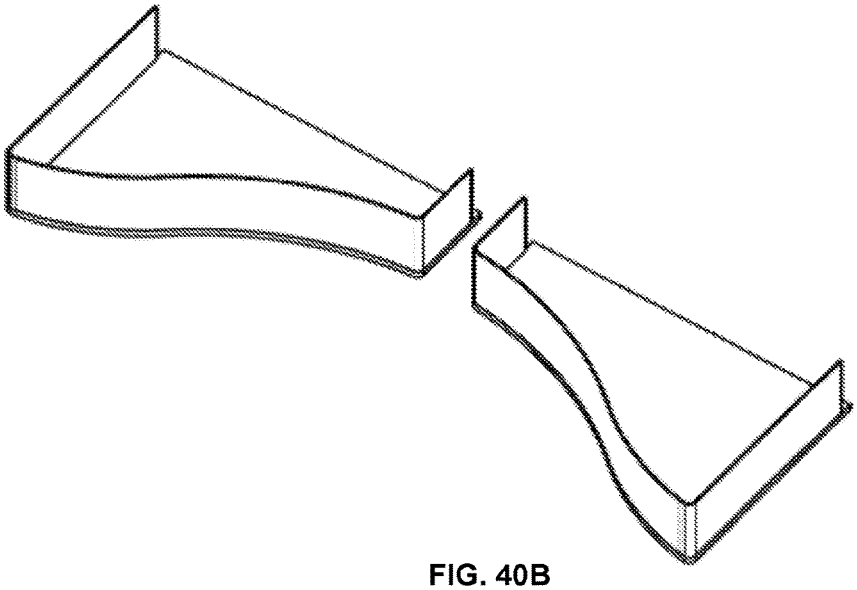
Figure 41A:
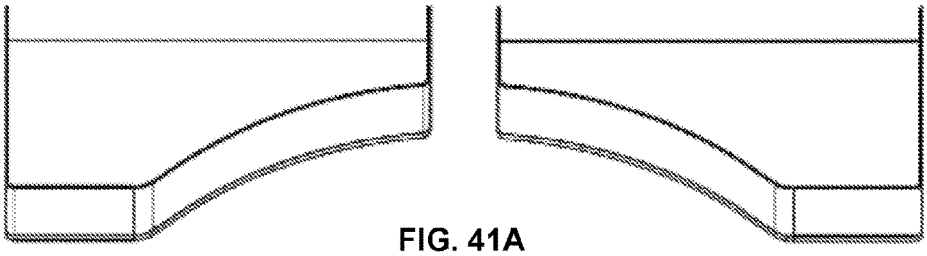
Figure 41B:
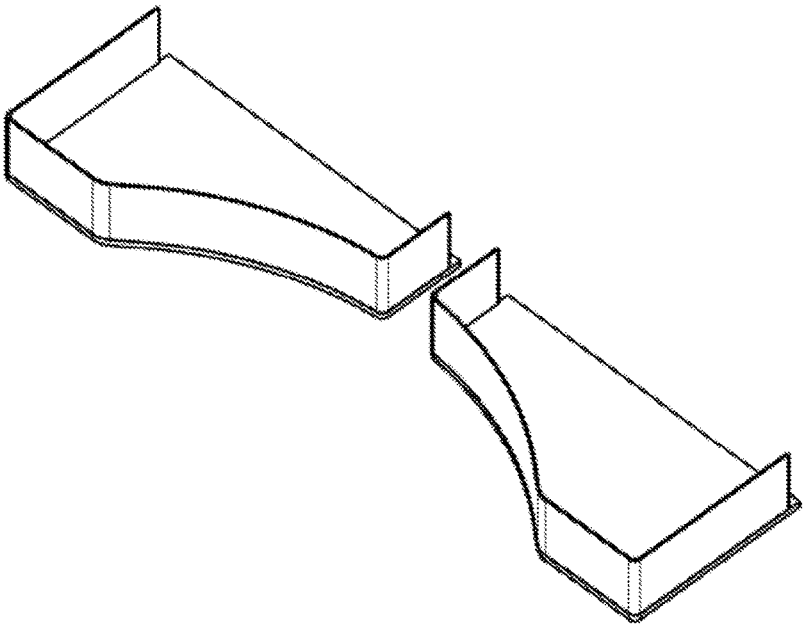
Figure 42A:
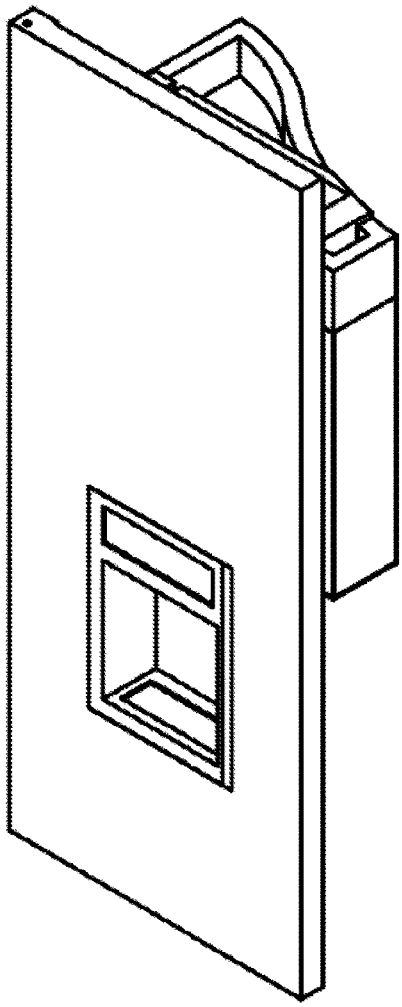
Figure 42B:
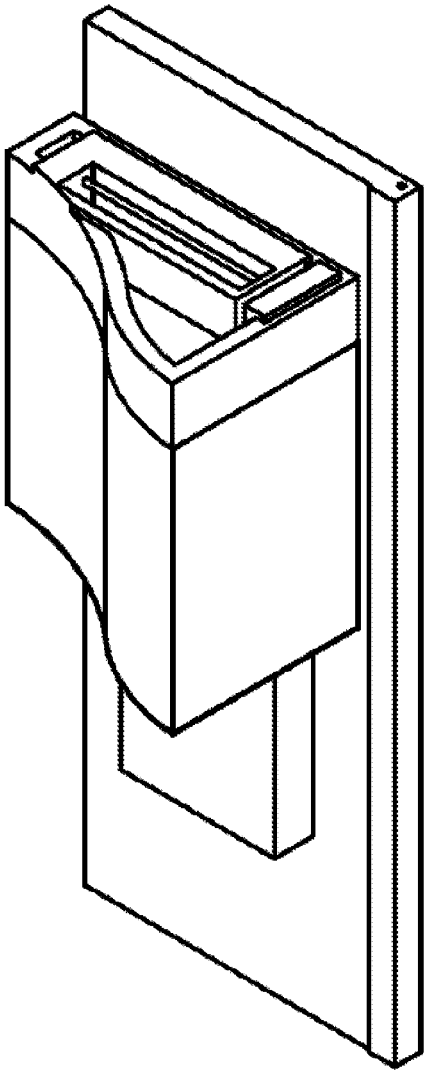
Figure 42C:
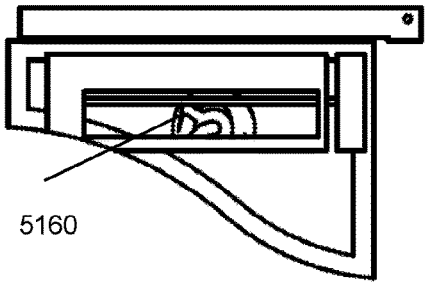
Figure 42D:
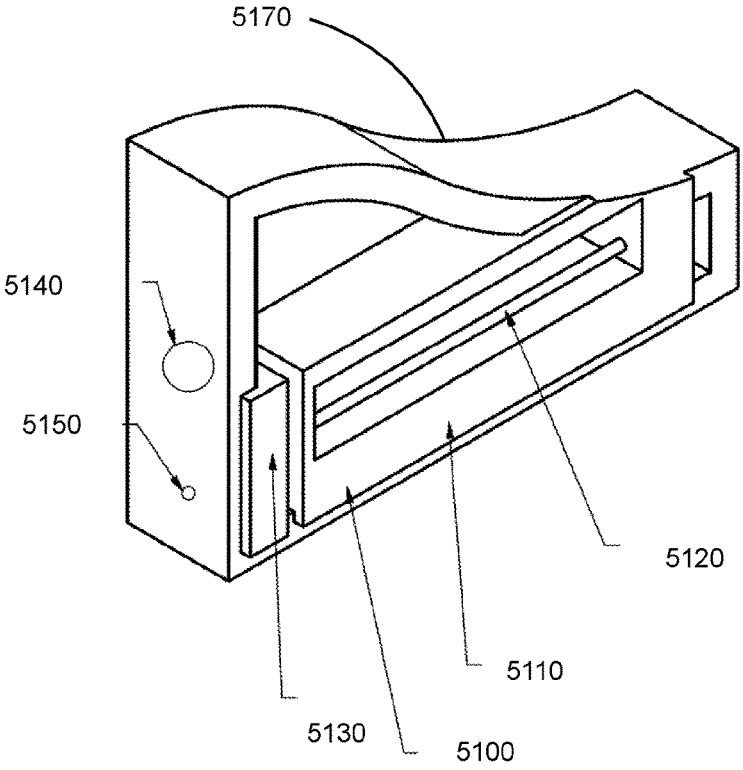
Figure 43A:
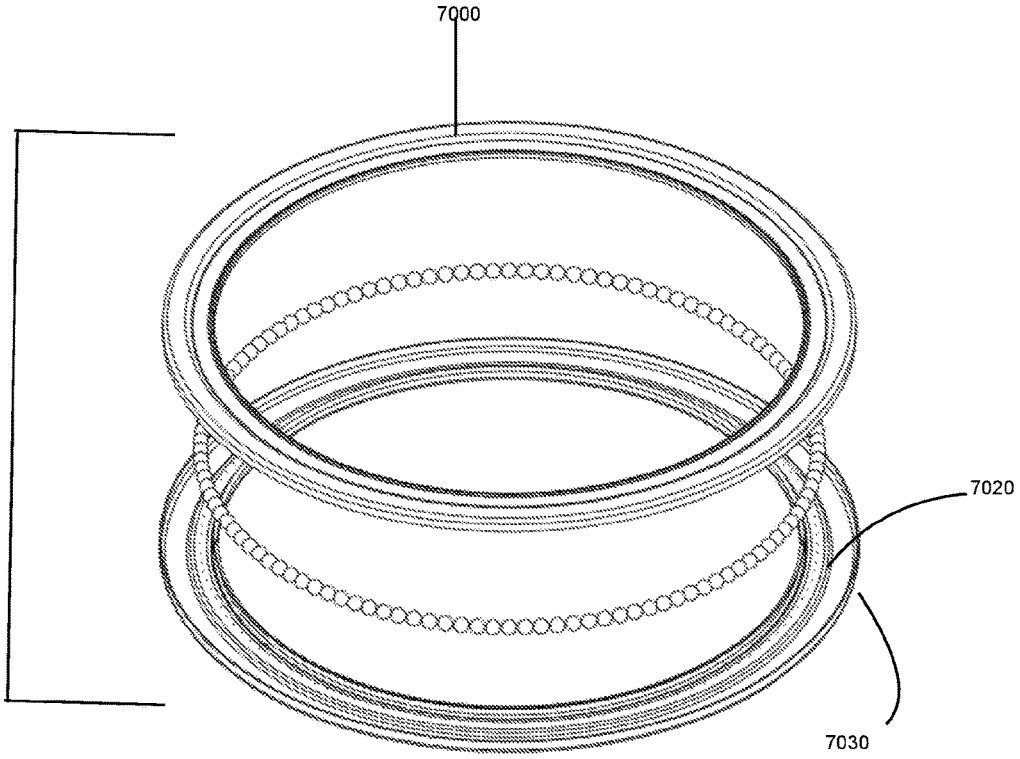

FIG. 40A is an isometric view from the top, front perspective of an embodiment of a pair of door shelves;

FIG. 40B is an isometric view of an embodiment of a pair of door shelves shown in FIG. 40A;

FIG. 41A is an isometric view from the top, front perspective of an embodiment of a pair of door shelves;

FIG. 41B is an isometric view of an embodiment of a pair of door shelves shown in FIG. 41A;

FIG. 42A is an isometric view of diagram of an embodiment of an ice maker, a door panel, and a water dispenser;

FIG. 42B is an isometric view from the back view of a diagram of an embodiment of the ice maker, the door panel and the water dispenser depicted in FIG. 42A;

FIG. 42C is a top view of a diagram of the icemaker depicted in FIGS. 42A and 42B;

FIG. 42D is an isometric view from the side view of a diagram of the ice machine depicted in FIGS. 42A, 42B, and 42C;

FIGS. 43A through 43E will be described in the following description;

FIG. 43A is an exploded view of the bearing assembly depicted in FIG. 43E;

FIG. 43B is a top perspective view of the support bracket, shelf, and bearing assembly (not visible) shown in FIG. 43E;

FIG. 43C is a side perspective view of the embodiment shown in FIG. 43B;

FIG. 43D is a cross sectional view of the alternative embodiment of the bearing assembly that is not visible in FIG. 43B but is visible in FIG. 43E;

FIG. 43E is a cross-sectional view diagram that is viewed from the side of a cross section taken from FIG. 43B and that shows an embodiment of a rotatable shelf assembly that comprises a shelf, a bearing assembly, and a support bracket;

DETAILED DESCRIPTION

It will be readily understood that the components of the present invention, as generally described with reference to the drawings herein, could be implemented in a wide variety of different configurations. Thus, the following more detailed description of the embodiments of the system and method of the present invention, is not intended to limit the scope of the invention, but is merely representative of various embodiments of the invention. Unless explicitly stated, the use of "or" means and/or, that is, this the non-exclusive meaning of or.

Embodiments of the present invention may also be applicable to the medical field wherein vaccinations and other biological medications or chemicals need constant cold temperatures to have a longer life. Warm and very cold areas are undesired for chemicals that need constant temperatures.

Figure 1A:
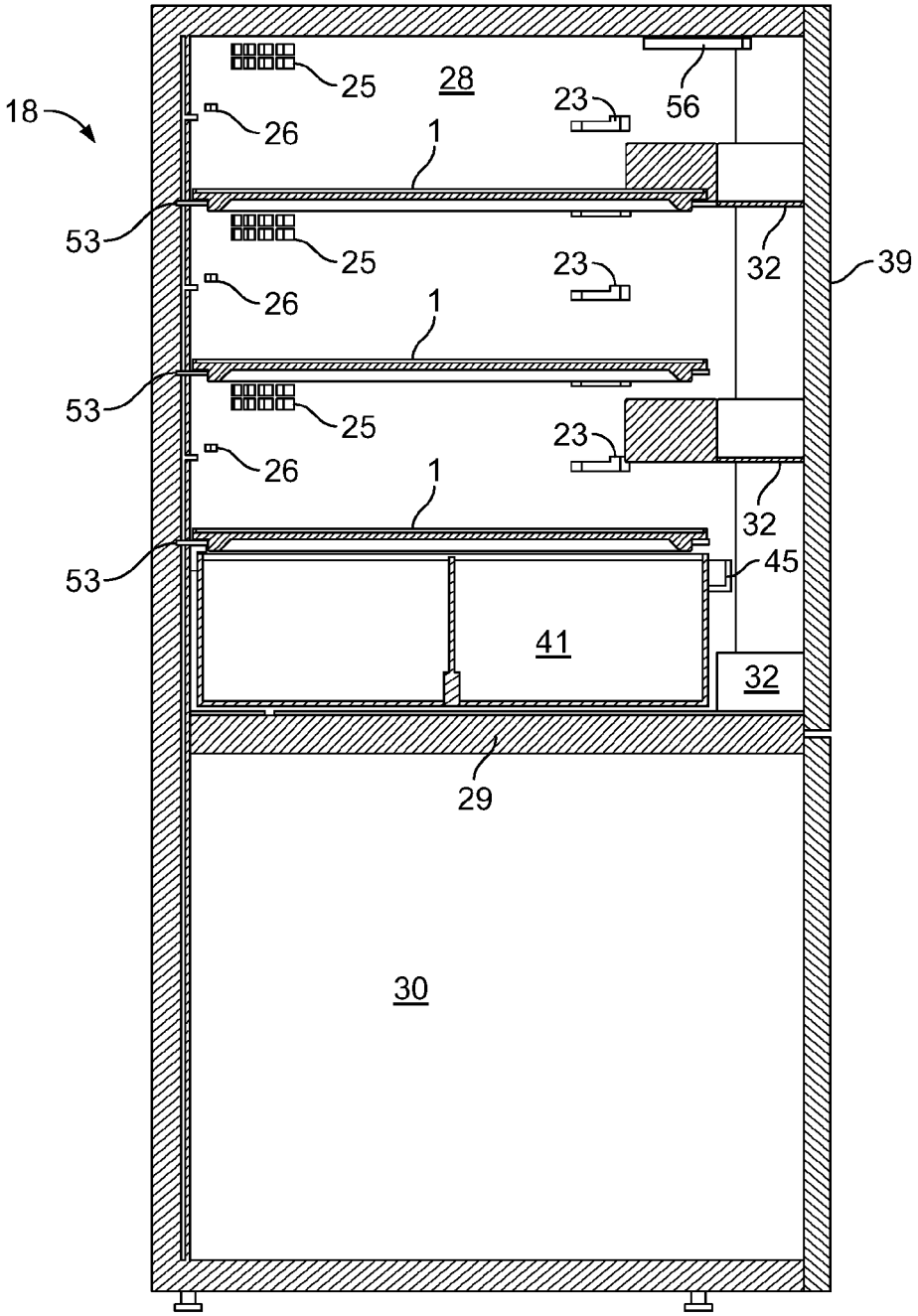
FIG. 1A is a cross-sectional view, from a side perspective, of a refrigerator such as the one shown in FIG. 10B, with more than one rotatable shelf assembly installed therein.

Referring now to FIG. 1A, a cross-sectional view, from a side perspective, of a refrigerator 18 configured for use with some embodiments of the invention is shown. Refrigerator 18 may comprise a refrigeration compartment 28 and a freezer compartment 30 separated by divider 29. Refrigeration compartment 28 or freezer compartment 30 may be of various sizes and locations; in some embodiments freezer compartment 30 is located above, to the side of, or below refrigeration compartment 28. As used herein, "refrigerator" includes a refrigerator without a freezer, a freezer without a refrigeration compartment, or refrigerator compartment. Refrigeration compartment 28 or freezer compartment 30 may include one or more rotatable shelf assembly 1. In some embodiments, refrigeration compartment 28 or freezer compartment 30 may also include one or more rotating drawer assembly 41. Rotatable shelf assembly 1 and rotating drawer assembly 41 will be discussed in greater detail below.

Refrigerator 18 may also include a refrigerator door 39, which may be configured to provide access to refrigeration compartment 28, freezer compartment 30, or both when door 39 is in an open position. When door 39 is in a closed position, as seen in FIGS. 1A and 10B it may be configured to seal at least one of the following selected from the group consisting of refrigeration compartment 28 and freezer compartment 30. Door 39 may also include at least one door shelf 32. In some embodiments, door shelf 32 is configured to extend within refrigeration compartment 28 and substantially fill the space between a substantially circular shelf, like a rotatable shelf assembly 1, and refrigerator door 39. Refrigerator 18 may also include, within refrigeration compartment 28 or freezer compartment 30, at least one vent 25, at least one bracket support 23, and at least one slit 26. The utility of these features, present in some embodiments of the invention, will be fully explained in greater detail below.

Figure 1B:
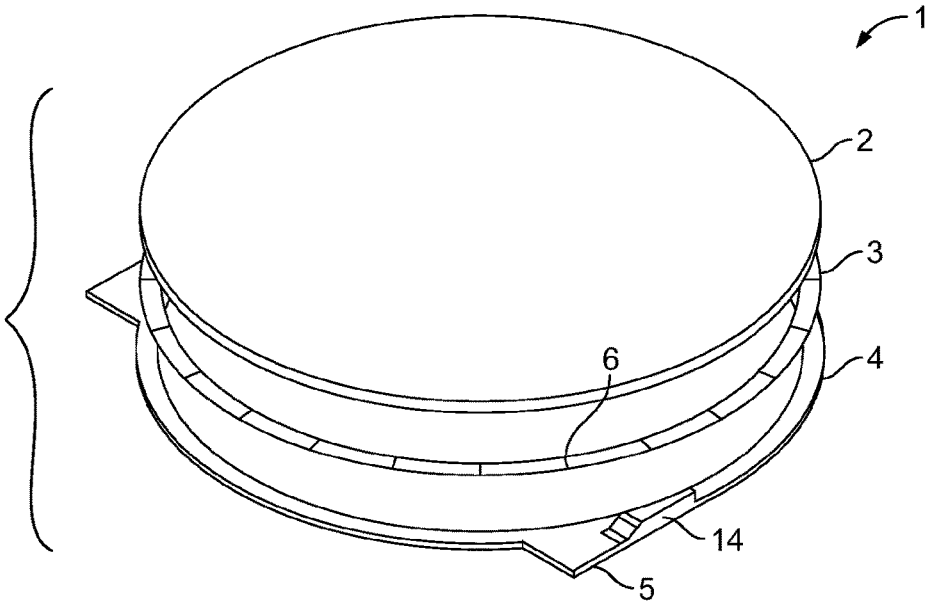
FIG. 1B is a diagram of an exploded view of an embodiment of a rotatable shelf assembly.

FIG. 1B presents an exploded view of an embodiment of rotatable shelf assembly 1. Some embodiments of rotatable shelf assembly 1 may comprise at least one turntable 2 and at least one support bracket 4. A bearing assembly 3 may also be positioned between turntable 2 and support bracket 4. Bearing assembly 3 may be configured to facilitate the rotation of turntable 2 relative to support bracket 4. In some embodiments, this rotation may be accomplished by the use of bearings 6 that are spaced along bearing assembly 3. Bearings 6 may comprise substantially cylindrical roller pins, substantially spherical ball bearings, or external wheels in various embodiments of the invention. Bearing assembly 3 with at least one bearing 6 may be configured such that the at least one bearing 6 rolls along a top surface of the support bracket 4 and/or along a bottom surface of a turntable 2, thus facilitating the rotation of turntable 2.

In other embodiments, rotatable shelf assembly 1 may comprise only turntable 2 and bearing assembly 3. In this embodiment, bearing assembly 3 is configured to support turntable 2 and to facilitate rotation of turntable 2 relative to an object upon which bearing assembly 3 rests.

In some embodiments, support bracket 4 may be configured to support bearing assembly 3 and turntable 2. This may accomplished by the use of one or more flanges 5 disposed on outer edge portions of support bracket 4, as seen in FIGS. 1B, 4A, 4C, and 4D. One or more flanges 5 may be configured to rest in slotted or recessed bracket supports 230 disposed in an interior wall 16, 161 of refrigerator 18. When one or more flanges 5 are inserted into or rested upon bracket supports 23, 230, the interior walls of refrigerator 18 may provide support for support bracket 4. Support bracket 4 may then provide support for bearing assembly 3, which, in turn, may provide support for turntable 2. Turntable 2 may then provide support for any items that are to be stored within refrigerator 18.

Figure 1C:
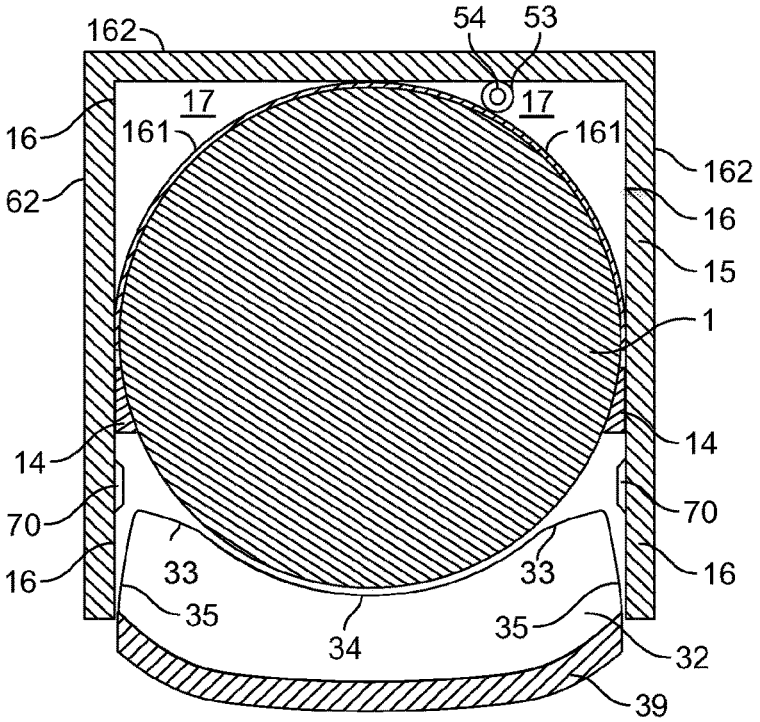
FIG. 1C is a diagram of a cross-sectional view with a cross section taken from a refrigerator such as the one shown in FIG. 10B, from a top perspective, of an embodiment of a refrigerator with a rotatable shelf assembly installed therein.

As shown in FIG. 1C, some embodiments of the invention may be configured to efficiently utilize the interior space of a refrigerator 18. An interior wall 16 of refrigerator 18 may be shaped so that the rear portion of interior wall 161 follows a substantially constant radius that is configured to touch an outer surface of support bracket 4. Side portions of interior wall 16 may be substantially straight. The space between the interior walls 16, 161 of refrigerator 18 and outer walls 162 may be filled with insulation 15 to insulate the temperature of air within the refrigerator from the temperature of air outside of the refrigerator. The rear portion of interior wall 161 may curve at a radius to create at least one cavity 17 in the rear corners of refrigerator 18 between the rear portion of interior wall 161 and outer walls 162. Mechanical components and/or ductwork may be configured within the at least one cavity 17 to provide refrigerated air to refrigeration compartment 29.

In some embodiments, the size of rotatable shelf assembly 1 may be substantially increased by configuring the outer diameter of rotatable shelf assembly 1 to be approximately equal to the distance between side portions of interior walls 16. The radius of rear portion of interior wall 161 may further be configured to approximately equal one-half the distance between side portions of interior walls 16.

Figure 2A:
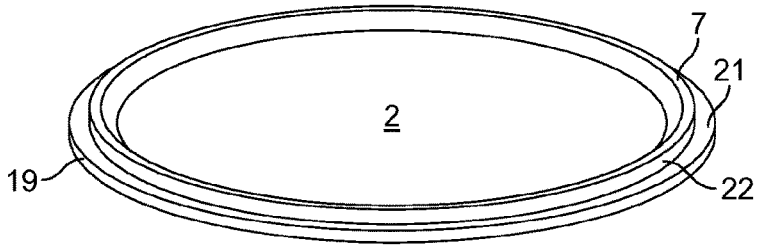
FIG. 2A is a bottom perspective view of an embodiment of a turntable configured for use with some embodiments of a rotatable shelf assembly.
Figure 2B:
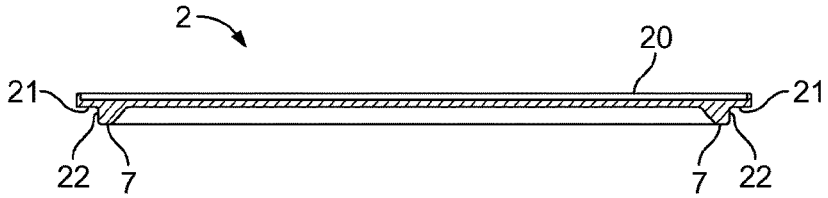
FIG. 2B is a cross-sectional view of an embodiment of a turntable, the cross-section being created by a vertical plane as seen in FIG. 2C and viewed from a side view.
Figure 2C:
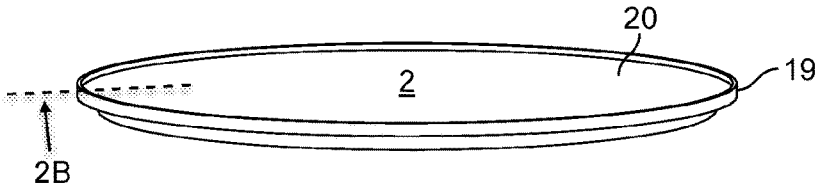
FIG. 2C is a top perspective view of an embodiment of a turntable configured for use with some embodiments of a rotatable shelf assembly.

Referring now to FIG. 2A-2C, an embodiment of turntable 2 is shown. In some embodiments turntable 2 may be a flat disk comprising an outer radius 19 and a flat surface 20. In other embodiments, flat surface 20 may be slightly concave. Items to be stored on rotatable shelf assembly 1 may be placed on flat surface 20. In other embodiments, turntable 2 may be formed as a hexagonal, octagonal, or any polygonal shape.

In some embodiments, turntable 2 is made from tempered glass, plastic, or any other material suitable for use inside refrigerator 18 and capable of supporting the weight of items stored on turntable 2. In some embodiments, the thickness of turntable 2 may be less than one inch; however, other thicknesses may be utilized in certain other embodiments. Turntable 2 may be manufactured from materials and with a particular thickness such that the turntable can support the weight of the items placed thereon. Turntable 2 may be manufactured through tempered glass casting, plastic injection molding, laser sintering, casting, sheet metal punching, milling, or other appropriate processes. Turntable 2 may also be coated with an anti-corrosive finish. In some embodiments turntable is formed with a hole on its lower surface and a pin or some other object which may be used as a center pivot may be inserted into the hole.

In some embodiments, outer radius 19 of turntable 2 may be configured to be slightly less than the radius of the rear portion of interior wall 161 of refrigerator 18. Such an outer radius 19 may increase the surface area of flat surface 20, increasing the available storage space, while still allowing turntable 2 to rotate freely and with a clearance with respect to interior walls 16, 161 of refrigerator 18. For purposes of this disclosure, clearance is defined as a relative positioning of two objects such that a first object can move relative to a second object without touching the second object.

FIG. 2B shows a cross-sectional view of an embodiment of turntable 2 that is shown in FIGS. 2A and 2B. In some embodiments, turntable 2 includes a substantially circular lower support flange 7 that extends from the bottom of turntable 2. Turntable 2 thus may include a lower horizontal support surface 21 and a lower vertical support surface 22. In some embodiments, lower support flange 7, lower horizontal support surface 21, and lower vertical surface 22 are configured to ensure that turntable 2 remains substantially centered relative to bearing assembly 3 and support bracket 4 when assembled. In some embodiments lower support flange 7 may be manufactured separately and then attached, either mechanically or chemically, to the bottom of turntable 2. In other embodiments, the lower support flange is manufactured as an integral, continuous part of the turntable 2.

Turntable 2 may also include, in some embodiments, a lip 19 that extends upward from the outer edge portion of flat surface 20. Lip 19 may be configured to help contain any spills that occur on flat surface 20. Lips 19 may also be configured to prevent items from falling off by centrifugal or centripetal forces acting on the items during turntable rotation. In some embodiments, lip 19 may also be comprise a high friction, grip-inducing material, or may be formed from small bumps or ridges.

In some embodiments of the invention, turntable 2 may be configured to be easily cleanable. Further, turntable 2 may be manufactured from a material that is resistant to stains and/or may be manufactured by filleting all sharp corners of turntable 2 to help prevent food or other items from becoming wedged therein.

Referring now to FIGS. 3A-3G, 12A-12C, and 14A-14C, various embodiments of bearing assembly 3 are shown. As noted above, bearing assembly 3 may be configured to facilitate the rotation of turntable 2 relative to support bracket 4 or relative to any object upon which turntable 2 and bearing assembly 3 are placed. In some embodiments, bearing assembly 3 may be configured to be insertable between turntable 2 and support bracket 4 and may further comprise bearings 6 to facilitate the rotation of turntable 2. The shape of bearings 6, 8 may vary in different embodiments of the invention and it should be understood that any suitable shape may be used, including, but not limited to, substantially cylindrical roller pins, substantially spherical ball bearings, or external wheels.

In some embodiments of the invention, the outermost radius of bearing assembly 3 is slightly less than the radius of rear portion of interior wall 161 of refrigerator 18, allowing for clearance between interior walls 16, 161 and bearing assembly 3. This configuration may allow bearing assembly 3 to rotate freely without binding or bumping against interior walls 16, 161 of refrigerator 18.

Figure 3A:
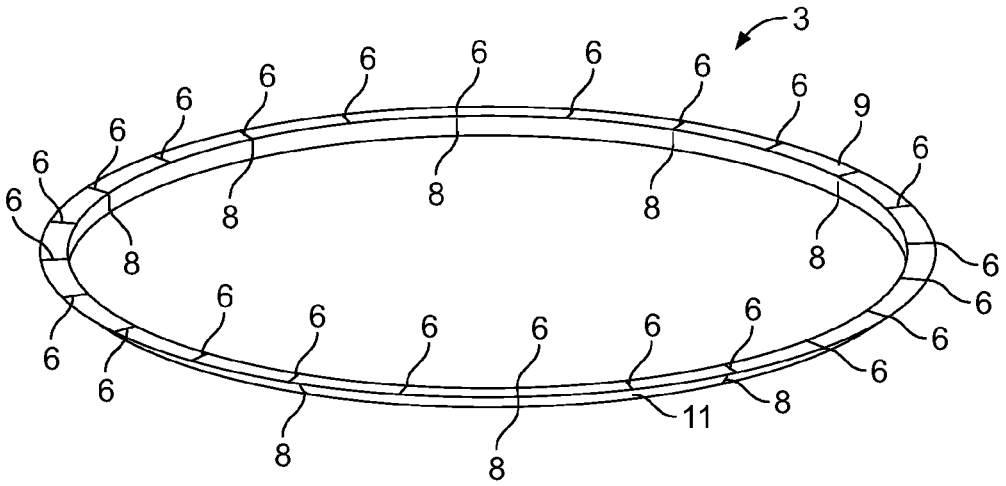
FIG. 3A is an embodiment of a bearing assembly for use in some embodiments of a rotatable shelf assembly, wherein the bearing assembly comprises a horizontal flange and a vertical flange.
Figure 3B:
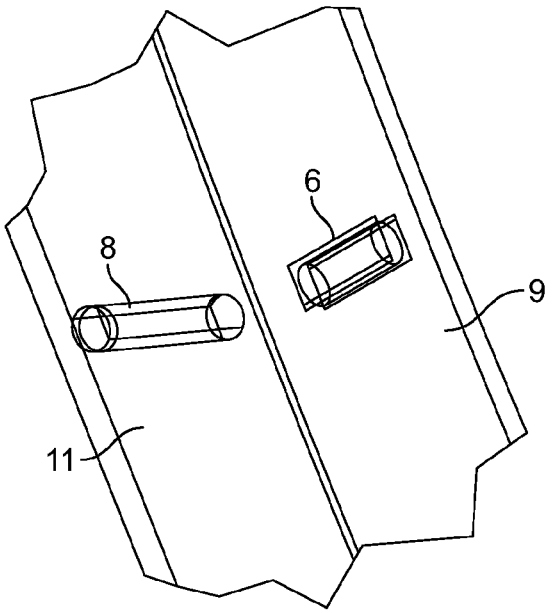
FIG. 3B is a diagram of a detailed view of the placement and configuration of bearings in the embodiment of the bearing assembly shown in FIG. 3A.
Figure 3C:
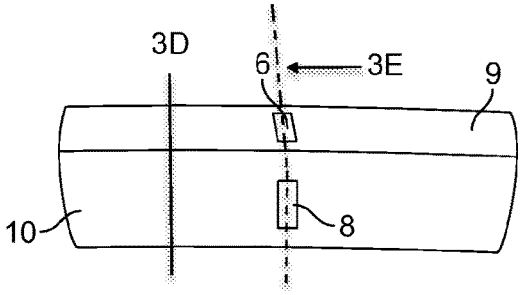
FIG. 3C is a diagram of a detailed view of two bearings shown in the top center portion of the bearing assembly shown in FIG. 3A.
Figure 3D:
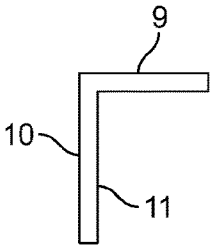
FIG. 3D is a cross-sectional view of an embodiment of a bearing assembly taken at a location that does not include bearings, the plane on which the cross-section is taken can be seen in FIG. 3C.

One embodiment of bearing assembly 3 is depicted in FIGS. 3A-3G. In this embodiment bearing assembly 3 comprises an annular ring with a generally L-shaped cross-section, as seen in FIG. 3D. The L-shaped cross-section may be formed from a horizontal flange 9 and a vertical flange 10. Horizontal flange 9 and vertical flange 10 may be manufactured separately and then attached to each other, such as by a mechanical process or chemical process, or they may be manufactured as one integral part. In some embodiments bearings may be disposed in both horizontal flange 9 and vertical flange 10; thus, there may be both horizontal bearings 6 and vertical bearings 9. Horizontal bearings 6 may be configured to roll along a lower horizontal support surface 21 of turntable 2, and thus may support turntable 2 and may allow it to rotate freely. Horizontal bearings 6 may also be configured to roll along a top surface 12 of support bracket 4. In some embodiments, bearing assembly 3 comprises at least three equally spaced horizontal bearings 6. In some embodiments, bearing assembly 3 may also comprise at least three vertical bearings 8. Vertical bearings 8 may be configured to roll along a lower vertical support surface 22 of turntable 2, which may thus facilitate that turntable 2 remain substantially centered relative to bearing assembly 3 and support bracket 4. Vertical bearings 8 may be further configured to roll along inner surface 13 of support bracket 4, which may thus facilitate that bearing assembly 3 remains substantially centered relative to support bracket 4. In some embodiments, turntable 2, bearing assembly 3, and support bracket 4 may be configured to remain substantially concentric with each other.

FIG. 3B provides a detailed view of the placement of horizontal bearing 6 and vertical bearing 8 in a portion of the embodiment of bearing assembly 3 depicted in FIG. 3A. In this embodiment, substantially cylindrical bearings 6, 8 are placed into substantially cylindrical recesses formed in horizontal flange 9 and vertical flange 10. The substantially cylindrical recesses may be sized to provide clearance between the body of bearing assembly 3 and bearings 6, 8. In another embodiment, bearings 6, 8 may be substantially spherical, and slightly larger recesses may also be substantially spherically shaped so as to accommodate substantially spherical bearings 6, 8, while still allowing them to rotate substantially freely. Bearings 6, 8 may be inserted into bearing assembly 3 by pressure. Bearings 6, 8 may also be inserted by bending bearing assembly 3, thus further opening the recesses and allowing bearings 6, 8 to be inserted.

FIG. 3C illustrates a detailed top perspective view of bearings 6, 8 at the "11:00 position" relative to a clock located in a section of an embodiment of bearing assembly 3 and depicted by FIG. 3A. Vertical bearing 8 is located in vertical flange 10, and horizontal bearing 6 is located in horizontal flange 9 of bearing assembly 3. FIGS. 3F and 3G provide additional views of the portion of the embodiment of the bearing assembly shown in FIG. 3C.

Figure 3E:
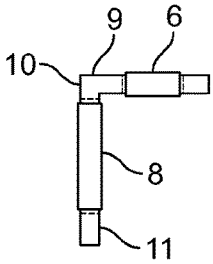
FIG. 3E is a cross-sectional view of an embodiment of a bearing assembly taken at a location that includes the bearings, the plane on which the cross-section is taken can be seen in FIG. 3C.
Figure 3F:
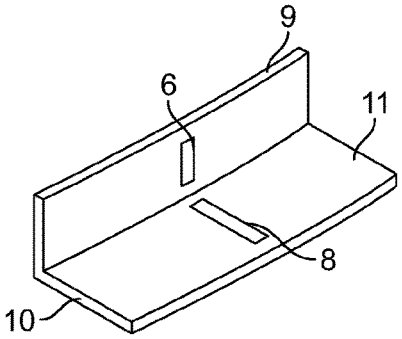
FIG. 3F depicts the detail view of FIG. 3C as seen from a bottom perspective view.
Figure 3G:
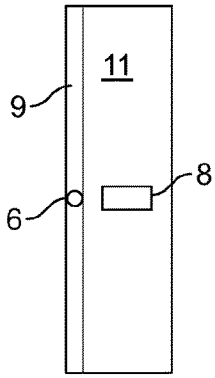
FIG. 3G depicts the detail view of FIG. 3C as seen from a bottom view.

FIGS. 3D and 3E illustrate cross-sectional views of one embodiment of a bearing assembly 3 with horizontal flange 9, horizontal bearing 6, vertical flange 10, and vertical bearing 8. In some embodiments the outer diameter of horizontal bearing 6 and vertical bearing 8 is greater than the thickness of horizontal flange 9 and vertical flange 10. This arrangement may allow horizontal bearings 6 vertical and vertical bearings 8 to make contact with support surfaces on either side of the flanges 9, 10. Further, in some embodiments, the recesses that house bearings 6, 8 may be open from each side of flanges 9, 10.

The main body of bearing assembly 3 may be made from polymer plastic, metal, vinyl, or any other appropriately material, such as a material that is strong and/or easily cleanable. In some embodiments the main body of bearing assembly 3 may be manufactured through injection molding, laser sintering, or any other appropriate manufacturing process. Bearing assembly 3 or bearings 6, 8 may also be coated with an anti-corrosive substance.

Bearings 6, 8 may be made from any material sufficient to support the weight of turntable 2 and items stored thereon; this may include metal, ceramic, or a hard plastic. Bearings 6, 8 may also be formed as either rollers, having a substantially cylindrical shape, balls, having a substantially spherical shape, or any other suitable shape. In some embodiments, bearings 6, 8 are inserted into the main body of bearing assembly 3 though the application of pressure. The main body of bearing assembly 3 may include cavities formed therein to receive bearings 6, 8. The cavities should be appropriately sized to contain bearings 6, 8, while still allowing them to rotate relatively freely.

In some embodiments, bearing assembly 3 may include at least three horizontal bearings 6 spaced evenly around the horizontal flange 9 of bearing assembly 3, and also may include at least three vertical bearings 8 spaced evenly around vertical flange 10 of bearing assembly 3. However, it will be appreciated that more than three horizontal bearings 6 and more than three vertical bearings 8 may be utilized. In some embodiments, bearing assembly 3 may include three, four, five, six, seven, eight, nine, ten, or more horizontal bearings 6 and three, four, five, six, seven, eight, nine, ten, or more vertical bearings 8. It is also contemplated the spacing of bearings 6, 8 need not be even in all embodiments.

Figure 14A:
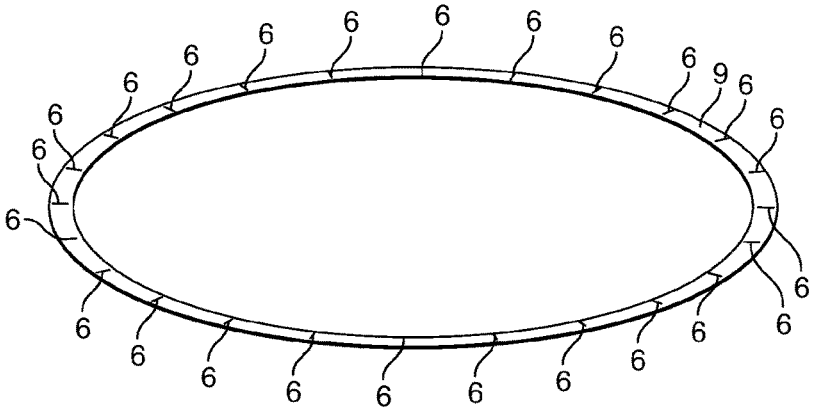
FIG. 14A is a top perspective view of an alternative embodiment of a bearing assembly, wherein the bearing assembly comprises a horizontal flange.
Figure 14B:
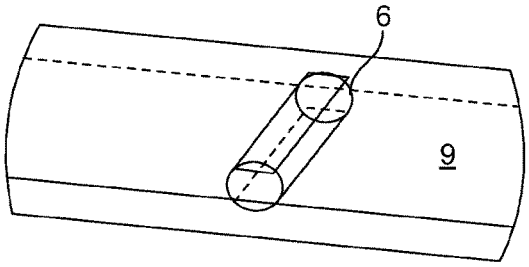
FIG. 14B is a top perspective view of a portion of the alternative embodiment of a bearing assembly of FIG. 14A.
Figure 14C:
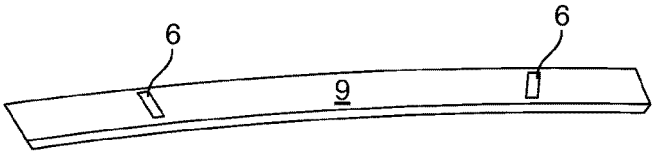
FIG. 14C is a top perspective view of a portion of an embodiment of the bearing assembly depicted in FIG. 14A.

Another embodiment of a bearing assembly 3 is depicted in FIGS. 14A-14C. In this embodiment bearing assembly 3 comprises only a horizontal flange 9 and horizontal bearings 6. In some variation of this embodiment, bearing assembly 3 may include at least three horizontal bearings 6 evenly spaced around the bearing assembly 3. However, it is contemplated that bearing assembly 3 may include more than three horizontal bearings 6 in some embodiments and that the spacing of horizontal bearings 6 need not be uniform in all cases. FIGS. 14B and 14C provide detailed views of a possible configurations of horizontal bearings 6 in some embodiments of bearing assembly 3 that comprise only a horizontal support flange 9. As pictured in FIG. 14B, substantially cylindrical bearings 6 are placed into substantially cylindrical recesses formed in horizontal flange 9. The substantially cylindrical recesses may be sized to provide clearance between the body of bearing assembly 3 and bearings 6. In another embodiment, bearings 6 may be substantially spherical, and slightly larger recesses may also be substantially spherically shaped so as to accommodate substantially spherical bearings 6, while still allowing them to rotate substantially freely. Bearings 6 may be inserted into bearing assembly 3 by pressure. Bearings 6 may also be inserted by bending bearing assembly 3, thus further opening the recesses and allowing bearings 6 to be inserted.

Figure 12A:
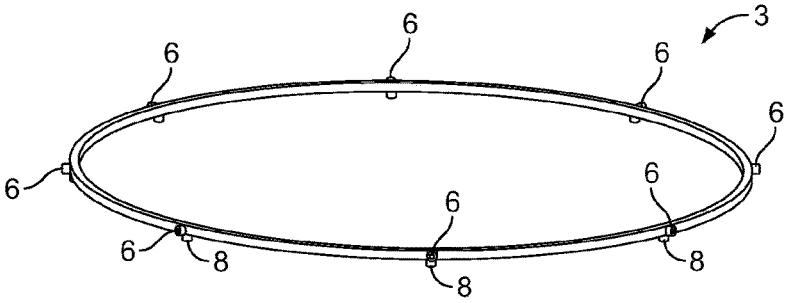
FIG. 12A is a diagram of an alternative embodiment of a bearing assembly comprising external wheels.
Figure 12B:
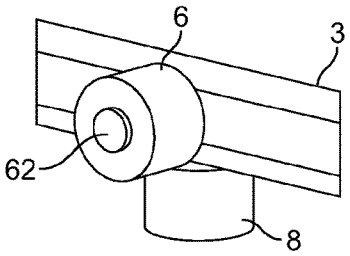
FIG. 12B is a detailed perspective view of an embodiment of a section of a bearing assembly comprising external wheels which depicts a horizontal wheel and vertical wheel.
Figure 12C:
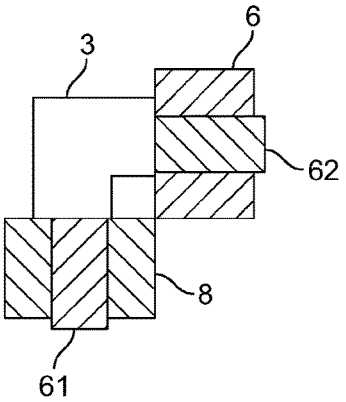
FIG. 12C is a cross-sectional view of an embodiment of a section of a bearing assembly comprising external wheels, wherein the plane on which the cross-section is taken may be seen in FIG. 12A.

FIGS. 12A-12C illustrate an alternative embodiment of bearing assembly 3, wherein bearings 6, 8 comprise external wheels mounted on axels 61, 62 that extend from bearing assembly 3. In some embodiments, bearing assembly 3 includes at least three horizontal axels 62 extending therefrom with horizontal wheels 6 mounted thereon. In other embodiments, bearing assembly 3 may include at least three vertical axels 61 extending therefrom with vertical wheels 8 mounted thereon. Bearing assembly 3 may comprise only horizontal axels 62 and horizontal wheels 6, only vertical axels 61 and vertical wheels 8, or both. FIG. 12B provides a detail perspective view of a horizontal wheel 6 mounted on a horizontal axis 62 and a vertical wheel 8 mounted on a vertical axis 61. FIG. 12C provides a cross-sectional view of a horizontal wheel 6 mounted on a horizontal axis 62 and a vertical wheel 8 mounted on a vertical axis 61.

Referring now to FIGS. 4A-4D, an embodiment of support bracket 4 is shown. In some embodiments, support bracket 4 comprises a generally flat annular ring whose outer radius may be substantially equal to the radius of rear portion of interior wall 161 of refrigerator 18, so as touch a rear portion of interior wall 161 of refrigerator 18 when inserted into refrigerator 18. The outer radius of support bracket 4 may also be configured to include a small clearance between the outer edge portion of support bracket 4 and a rear portion of interior wall 161.

The thickness of support bracket 4 may be configured to be sufficient to support the weight of all items that may be placed thereon, including bearing assembly 3, turntable 2, and any items to be stored on the turntable 2. In some embodiments, the thickness of support bracket 4 may be less than one inch, less than one-half inch, or less than one-quarter inch. However, it is contemplated that other thicknesses may be used in various embodiments of the invention.

In some embodiments, support bracket 4 may be made from metal, polymer plastic, or any other material that can adequately support the weight of, and resist the internal moments and shear stresses created by, the items that may be stored thereon. This may include strong alloys, like aluminum or steel, and strong plastics, like polycarbonate or carbon fiber. Support bracket 4 may also, in some embodiments, be coated with a corrosion resistant substance. Support bracket 4 may further comprise a coating to resist wear where the bearings 6, 8 of bearing assembly 3 contact support bracket 4. Additionally, support bracket 4 may be manufactured through plastic injection molding, laser sintering, casting, sheet metal punching, milling or other any other appropriate manufacturing process.

In some embodiments, support bracket 4 further comprises a flat surface 12 configured to support bearing assembly 3 and turntable 2. Flat surface 12 may be configured such that horizontal bearings 6 of bearing assembly 3 may roll thereon, allowing for rotation of a turntable 2 resting on bearing assembly 3. Flat surface 12 may be coated with a substance to prevent wear.

Support bracket 4 may also include, in some embodiments, an inner surface 13. Inner surface 13 may be configured such that vertical bearings 8 of bearing assembly 3 roll thereon. In some embodiments this may cause bearing assembly 3 to remain substantially concentric with support bracket 4. Inner surface 13 may be coated with a substance to prevent wear.

Support bracket 4 may also include support flanges 5, configured to rest in slotted, recessed, or grooved bracket supports 230 formed in interior walls 16, 161 of refrigerator 18. Support flanges 5 may be configured to secure support bracket 4 into the refrigerator 18 in a substantially horizontal orientation. In some embodiments, flanges 5 are also configured so that it is possible for a user to install or remove support bracket 4 from refrigerator 18.

In some embodiments, support bracket 4 may include at least three support flanges 5 spaced around the outer edge portion of support bracket 4. However, it is contemplated that, in some embodiments, more than three support flanges 5 may be utilized to secure support bracket 4 into refrigerator 18. For example, it is to be understood that in some embodiments support bracket 4 may include two, three, four, five, six, or more support flanges 5.

In some embodiments support flanges 5 are configured to be received into slotted bracket supports 230 located in refrigerator 18, in a front portion of interior wall 16, and also into a slotted bracket support 230 located in the rear of the refrigerator 18 in a rear portion of interior wall 161. However, in other embodiments support flanges 5 may be configured to be received only into bracket supports 23, 230 located on the sides of refrigerator 18.

In another embodiment of support bracket 4, the support bracket may not necessarily include any flanges. Rather, the interior walls 16, 161 of refrigerator 18 may be configured with ledges, shelves, cantilever, or other form of protruding bracket support 23 which may be configured to provide support for support bracket 4 when rested thereon. In other embodiments, support bracket 4 may include at least one support flange 5 configured to be received by a recessed bracket support 230 in an inner wall 16 of refrigerator 18 and be otherwise supported by at least one protruding bracket support 23 formed or attached to inner wall 16 of refrigerator 18. Bracket supports 23, 230 will be described in more detail below.

Figure 4A:
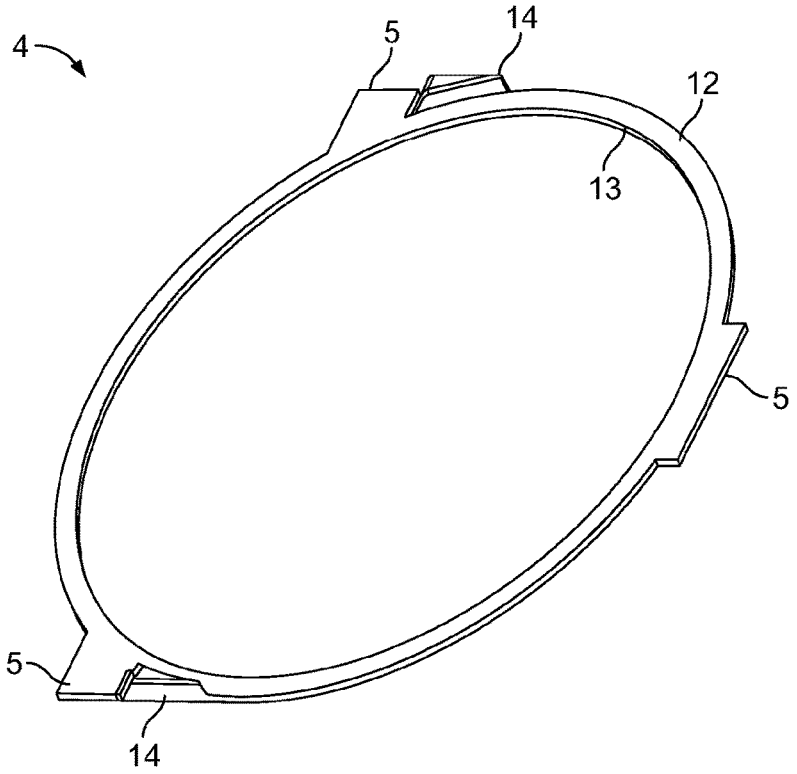
FIG. 4A is a diagram of an embodiment of a support bracket configured for use in a rotatable shelf assembly.
Figure 4B:
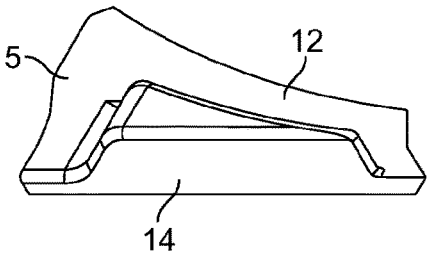
FIG. 4B is a diagram of an embodiment of a finger protection device that may be included on some embodiments of a support bracket.
Figure 4C:
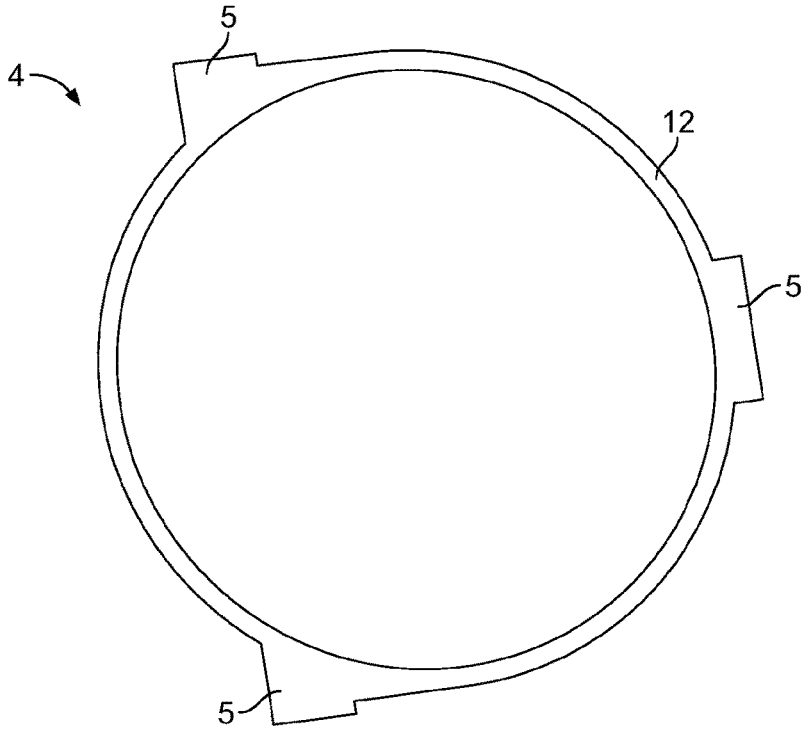
FIG. 4C is a diagram of a top view of an embodiment of a support bracket configured for use in a rotatable shelf assembly.
Figure 4D:
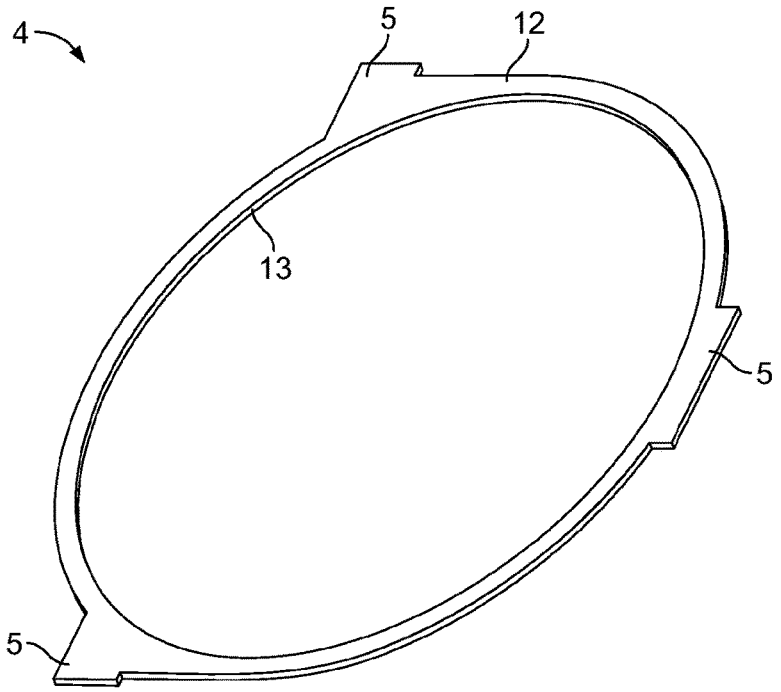
FIG. 4D is a perspective view of an embodiment of a support bracket configured for use in a rotatable shelf assembly.

FIG. 4B illustrates a feature that may be present in some embodiments of support bracket 4: at least one finger guard 14. In some embodiments finger guard 14 may be substantially wedge shaped and may be configured and oriented to prevent fingers or other items from being caught between turntable 2 and interior wall 16 of refrigerator 18 as turntable 2 rotates. In some embodiments, finger guard 14 may be formed separately and then attached mechanically or chemically to support bracket 5. In other embodiments, the finger guard 14 may be integrally formed with support bracket 4. In some embodiments finger guard 14 may be removable. Additionally, finger guard 14 may also be formed in or attached to interior wall 16, 161.

Figure 5A:
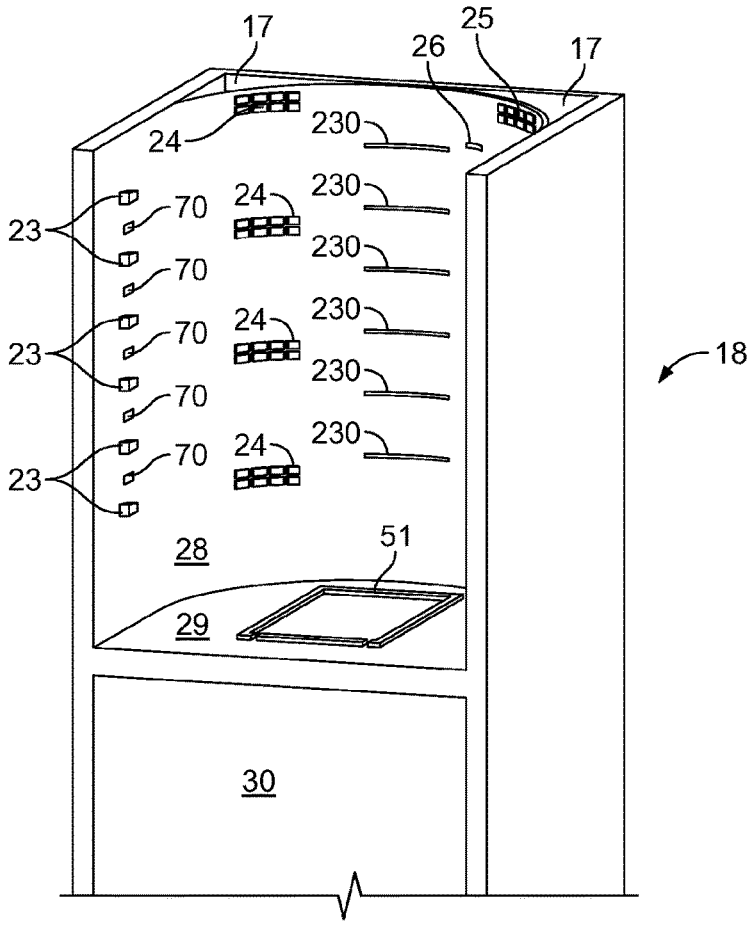
FIG. 5A is a diagram of a perspective view of an embodiment of a refrigerator body with door and roof removed, configured for use with some embodiments of the invention.
Figure 5B:
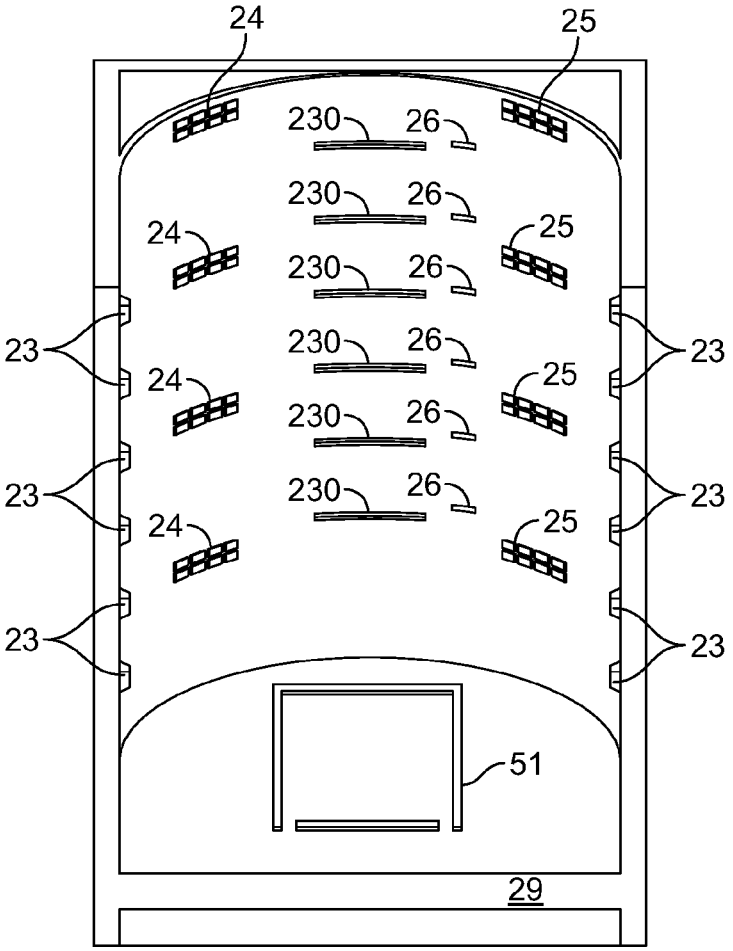
FIG. 5B is a diagram of an elevated front view of an embodiment of a body of a refrigerator compartment configured for use with some embodiments of the invention.

Referring now to FIGS. 5A and 5B, an embodiment of a body of a refrigerator 18 configured for use with some embodiments of the present invention is shown. In some embodiments, refrigerator 18 is divided into at least one refrigeration compartment 28 and at least one freezer compartment 30. The refrigeration compartment 28 may be separated from the freezer compartment 30 by at least one divider 29.

In some embodiments interior walls 16, 161 of refrigerator 18 may be configured for use with a rotatable shelf assembly 1. This may include side portions of interior walls 16 comprising substantially straight sections and a rear portion of interior wall 161 comprising a substantially curved section, as seen in FIG. 1C. The curved section may be of a radius selected to mate with the outer surface of support bracket 4 or turntable 1.

In some embodiments, both refrigeration compartment 28 and freezer compartment 30 are formed with interior walls 16, 161 as described above—i.e., with a curved rear section. However, in other embodiments, only one of the refrigeration compartment 28 or the freezer compartment 30 may have this curved inner wall 161.

In some embodiments, at least one cavity 17 is formed between the curved rear portion of interior wall 161 and the outer walls 162 of refrigerator 18, as seen in FIGS. 1C, 5A, and 5B. The at least one cavity 17 is separated from refrigeration compartment 28 and freezer compartment 30 by rear portion of interior wall 161, and may be configured to accommodate mechanical components and ductwork such that refrigerated air is supplied to both refrigeration compartment 28 and freezer compartment 30. Outer walls 162 may also be lined with insulation 15 to efficiently maintain refrigeration compartment 28 and/or freezer compartment 30 at their desired temperatures.

In some embodiments of the invention, interior walls 16, 161 may be configured to include various bracket supports 23, 230 that are configured to receive and support at least one support bracket 4. Bracket supports 23, 230 may be spaced at equal or non-equal intervals vertically and horizontally along interior walls 16, 161 so that at least one rotatable shelf assembly 1 may be installed into refrigerator 18 at a plurality of different prefigured locations, selectable by the user.

FIGS. 5A and 5B present one non-limiting example of a potential vertical spacing of bracket supports 23, 230 in one embodiment of the invention. As seen in those figures, six rows of bracket supports 23, 230 are spaced evenly and vertically along interior walls 16, 161. It will be appreciated, however, that more or fewer bracket supports 23, 230 may be spaced vertically along interior walls 16, 161. For example, in some embodiments, one, two, three, four, five, six, or more rows of bracket supports 23, 230 may be spaced vertically along interior walls 16, 161, thus providing one, two, three, four, five, six, or more possible locations at which a rotatable shelf assembly 1 or other fixed shelf assembly may be installed. Further, in some embodiments, the vertical spacing of support brackets need not be evenly spaced.

It should also be appreciated that in some embodiments, a rotatable shelf assembly 1 need not be installed into every vertically spaced row of bracket supports 23, 230; however, in other embodiments, a rotatable shelf assembly 1 may be installed into every row of bracket supports 23, 230. Additionally, in some embodiments, both rotatable shelf assembly 1 and traditional static shelving may be installed into or onto bracket supports 23, 230.

Bracket supports 23, 230 may also be spaced at equal or non-equal intervals horizontally along interior walls 16, 161 to provide support for support bracket 4 at multiple locations along an outer edge portion of support bracket 4. This configuration may provide additional support to support bracket 4.

One non-limiting example of the horizontal spacing of bracket supports 23, 230 can be seen in FIGS. 5A and 5B. In the embodiment pictured in FIG. 5B, three bracket supports 23 are spaced horizontally along interior walls 16, 161 such that a first bracket support 23 is located on the right section of the right interior wall 16, a second bracket support 230 is on the curved rear curved portion of interior wall 161, and third bracket support 23 is on the left section of interior wall 16. Thus, in this embodiment, support bracket 4 would be supported at three points along interior walls 16, 161.

It should be understood however, that other embodiments may include more or fewer bracket supports 23, 230 spaced in the horizontal direction. For example in some embodiments, the interior walls 16, 161 may be configured to include two, three, four, five, or more bracket supports 23, 230 spaced horizontally along interior walls 16, 161. Further, in some embodiments, bracket supports 23, 230 may not be spaced evenly along interior walls 16, 161.

In some embodiments, a single bracket support 23, 230 may be used to support a support bracket 4. This may be achieved by configuring a single shelf or groove that runs along interior walls 16, 161 that may be used to support a support bracket 4.

It is contemplated that various forms of bracket supports 23, 230 may be configured for use with various embodiments of the invention. A variety of embodiments of bracket supports is shown in FIGS. 5C-5H. In some embodiments, bracket support 23 may protrude out from interior walls 16, 161. This protrusion may be a small shelf, knob, or other form of cantilever support.

Figure 5C:
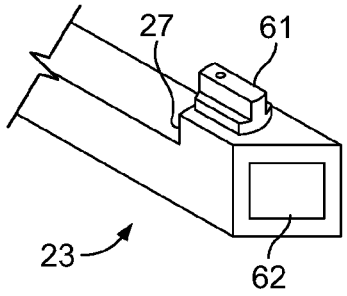
FIG. 5C is a diagram of an embodiment of a protruding bracket support that may be attached to or formed on an inner wall of a refrigerator to support a rotatable shelf assembly and which further comprises a latch in an unlocked position.
Figure 5D:
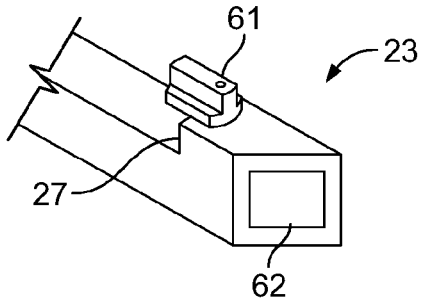
FIG. 5D is a diagram of an embodiment of a protruding bracket support that may be attached to or formed on an inner wall of a refrigerator to support a rotatable shelf assembly and which further comprises a latch in an locked position.
Figure 5E:
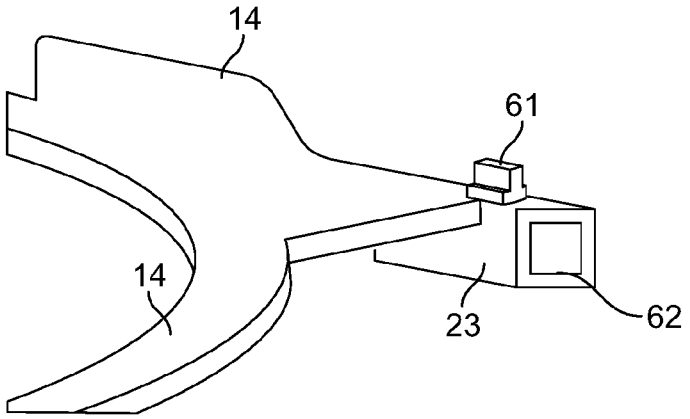
FIG. 5E is a detailed view an embodiment of a protruding bracket support engaging a support bracket with a latch in a locked position.

One non-limiting example of a protruding bracket support 23 is shown in FIG. 5C-5E. In this embodiment of bracket support 23, a notch 27 is included to further provide support for support bracket 4. Notch 27 may be sized to appropriately receive at least one flange 5 of support bracket 4. Notch 27 may further be configured to limit translational movement of support bracket 4 once installed into the refrigerator. Bracket support 23 may also include, in some embodiments, a latch 61 that may secure the upward motion of support bracket 4 once installed into bracket support 23. FIG. 5E illustrates a partial view of a support bracket 4 secured by a latch 61 into bracket support 23. Latch 61 may rotate into place to limit the upward motion of support bracket 4. In other embodiments, latch 61 may slide into place to limit the upward motion of support bracket 4. In some embodiments, latch 61 may lock after latch 61 slides or rotates into place. In some embodiments, bracket support 23 may not include latch 61.

Figure 5F:
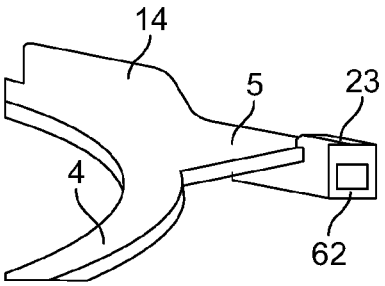
FIG. 5F is a detailed view of an additional embodiment of a protruding bracket support engaging a support bracket wherein the bracket support is configured to limit the upward motion of a support bracket.
Figure 5G:
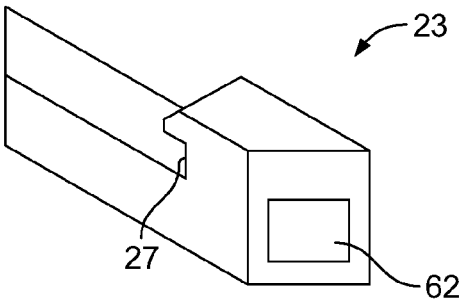
FIG. 5G is a diagram of a perspective view of an support bracket which may be configured to limit the upward motion of a support bracket.
Figure 5H:
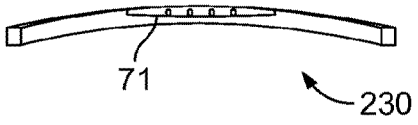
FIG. 5H is a diagram of an embodiment of a recessed bracket support which may include a spring.

FIG. 5G illustrates an alternative embodiment of a bracket support 23 configured to limit the upward motion of support bracket 4. In this embodiment, notch 27 may be configured to comprise an overhang. The overhanging notch 27 may limit the upward motion of support bracket 4 when installed therein, as seen in FIG. 5F. As pictured in FIG. 5H, a recessed bracket support 230 may further comprise a spring 71 configured to push a support bracket 4 forward when inserted into a recessed support bracket 23. This configuration may be used in conjunction with a bracket support 23 as pictured in FIGS. 5F and 5G. Spring 71 may provide a forward force that may help maintain support bracket 4 beneath overhanging notch 27.

It should be understood that various embodiments of the invention may include any combination of various embodiments of bracket supports 23, 230. For example, embodiments can include both a plurality of protruding bracket supports 23 and recessed bracket supports 230. In other embodiments, the invention may comprise only protruding or only recessed bracket supports. It is also contemplated that in certain embodiments the types of bracket supports 23, 230 selected should be configured to specifically receive or support a specific embodiment of support bracket 4.

As illustrated in FIGS. 5A and 5B, in some embodiments, interior walls 16, 161 may be configured to include at least one supply vent 24 and at least one return vent 25. In the embodiment of FIGS. 5A and 5B, four supply vents 24 are spaced vertically along rear portion interior wall 161 in one rear corner of refrigeration space 29 and four return vents 25 are spaced vertically in the opposite rear corner of refrigeration space 29. This example is, however, non-limiting, and greater or fewer supply vents 24 and return vents 25 are contemplated located at other positions in interior walls 16, 161. In some embodiments, supply vents 24 and return vents 25 are spaced evenly along the vertical length of interior walls 16, 161; however, in other embodiments the spacing need not be uniform. Further, in some embodiments, it is contemplated that at least one supply vent 24 and one return vent 25 may be provided for each possible shelf installation location. This means that in some embodiments, supply vents 24 and return vents 25 may be spaced so that a horizontal row of bracket supports 23, 230 may be interspersed between each row of supply vents 24 and return vents 25. In some embodiments supply vents 24 and return vents 25 are connected to ductwork and other mechanical components necessary to provide refrigerated air that are located in at least one cavity 17.

In one embodiment of the spacing of supply vents 24 and return vents 25, supply vents 24 may provide refrigerated air in one rear corner of the refrigerator and return vents 25 may be located in the opposite rear corner. This may produce a circular or substantially circular airflow pattern. This embodiment of vent placement may achieve improved temperature distribution throughout the refrigerator. However, it should be understood that this example is non-limiting, and that other vent positions and airflow patterns are contemplated.

In some embodiments interior walls 16, 161 may be made from or coated with a low-friction material; this may, in some embodiments, prevent items stored on rotatable shelf assemblies 1 from binding with inner wall 16 when the rotatable shelf assembly 1 rotates.

Figure 6A:
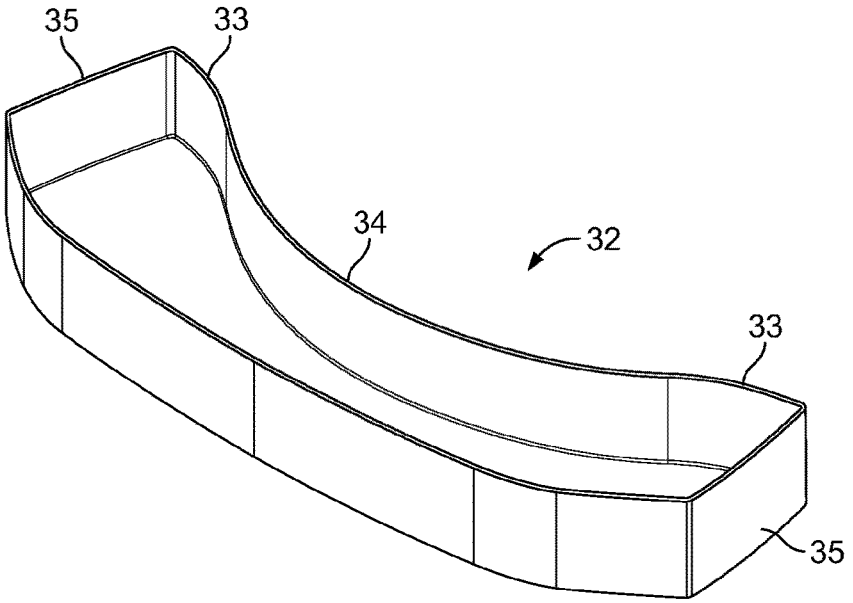
FIG. 6A is a perspective view of an embodiment of a refrigerator door shelf configured for use in some embodiments of the invention.
Figure 6B:
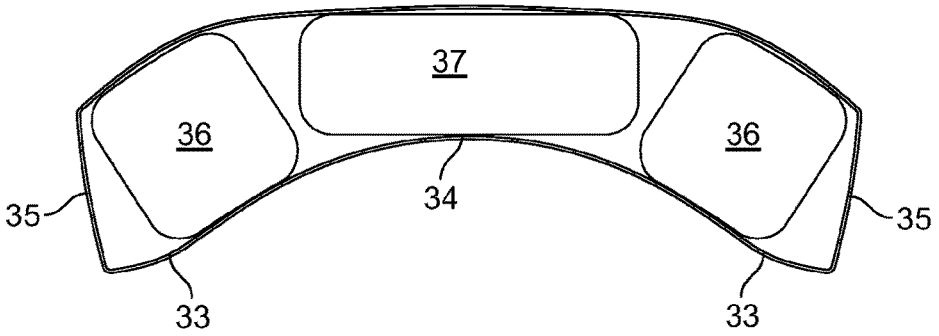
FIG. 6B is a top view of the door shelf seen in FIG. 6A, which further shows the locations of various areas within the door shelf.
Figure 13:
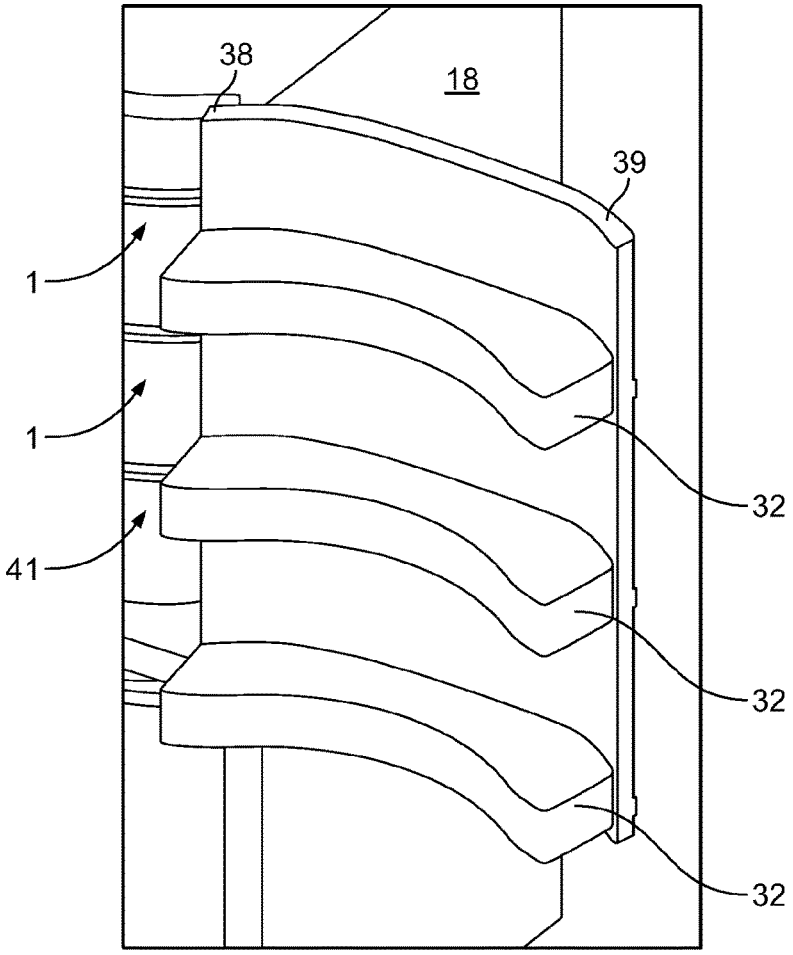
FIG. 13 is a diagram depicting the placement of refrigerator doors shelves on a refrigerator door in an open position.

Referring now to FIG. 13 and FIGS. 6A-6B, an embodiment of a refrigerator door 39 and at least one door shelf 32 configured for use in a refrigerator 18 with substantially circular shelves will be described. In some embodiments, door shelf 32 may be configured to provide storage in the space between a substantially circular shelf and door 39. In some embodiments door 39 comprises at least one door shelf 32 attached to its inner surface. Door 39 may include one or more door shelves 32 attached thereto and distributed vertically along the height of the door. In some embodiments, door shelves 32 may be configured to be removable from door 39. Further, in some embodiments door 39 may be configured to receive door shelves 32 at a plurality of vertical locations, such that a user may customize the placement of door shelves 32.

Door 39 may be attached to the refrigerator by a pivot 38 located on one of the sidewalls of refrigerator 18 and at one end of door 39. In some embodiments pivot 18 may be located on either the left or right side of refrigerator 18. The door 39 may further comprise a layer of insulation configured to help maintain the desired temperature inside the refrigerator 18. In some embodiments, door 39 may be attached to a pivot 38 at each of the ends of door 39. In this embodiment, the door 39, and door shelves 32, may be divided into two parts so that each part may pivotally open from the center. This type of door is commonly referred to as a French-style door.

Door 39 may also be shaped so that it arcs outward, away from the interior of the refrigerator. This may provide increased room for storage and for door shelves 32 inside the refrigerator. However, in other embodiments, door 39 may be shaped so that it may be substantially flat.

Referring now to FIG. 1C and FIGS. 6A and 6B, door shelf 32 will be described in greater detail. The shape of door 39 and door shelves 32 may, in some embodiments, be optimized to allow for increased storage space within the refrigerator. As used herein an arc is an arc with a significant length which is greater than 1 mm and significant width which is greater than 1 mm and a radius is a radius with a significant length and a significant width; the same applying to "arcs," "radii." "center arc," "center arcs," and so forth. The inner most wall of door shelf 32 may be formed from standard materials in the shape of three arcs. First, a center arc 34, may closely follow the outer edge portion of a circular shelf installed into the refrigerator. In some embodiments this center arc 34 may have a radius equal to or slightly larger than the outermost radius of a rotatable shelf assembly 1. Several non-limiting examples of center arc 34 may be at 0, 0.1, 0.2, or 0.25 inches larger than the outermost radius of a rotatable shelf assembly 1. The other two arcs 33 are located at the extremities of the inner wall of door shelf 32. The other arcs 33 may be configured to arc away from the circular shelf and may further be configured to allow a narrow clearance between door shelf 32 and the circular shelf as door 39 is rotated outward. In some embodiments arcs 33 on each end of the inner edge portion of door shelf 32 are mirror image configurations of each other. In other embodiments, only one side of door shelf 32 includes arc 33.

In some embodiments of door shelf 32, sidewalls 35 of door shelf 32 may also be formed in the shape of arcs. These arcs may be configured to provide clearance between door shelf 32 and the ends of the refrigerator walls 162 as door 39 is rotated outwards. In other embodiments, sidewalls 35 may be substantially straight.

Referring now to FIG. 6B, one non-limiting embodiment of a door shelf 32 is described in detail. In this embodiment, the dimensions of the door shelf 32 and outer door 39 are such that the door shelf is configured to accommodate a standard one-gallon jug at each end 36 of the door shelf 32. In some embodiments, the door shelf is configured to accommodate a container that is 9.75 inches high with a substantially square base with the dimensions of 5.75 inches by 5.75 inches. Further, the center section 37 of the door shelf 32 may be configured to accommodate a standard egg carton, which may be generally 12 inches long, generally 4 inches wide and generally 2.75 inches deep or for 18-egg carton which is generally, 2.75 inches by generally 12 inches by generally 6.25 inches. In some embodiments the door shelf is configured to accommodate an egg carton in the middle section 37 and at least one one-gallon container of milk on the sides 36 of the door shelf 32.

In some embodiments, the corners and wall intersections of door shelf 32 may be filleted. Possible manufacturing process for door shelf 32 may include plastic injection molding, blow molding, and plastic thermoforming, or any other suitable process. In some embodiments, door shelf 32 may be made from polycarbonate, acrylic, vinyl, or other plastics, or any other suitable material.

Referring to FIG. 7, FIG. 7 is described with FIGS. 34-39.

Figure 8A:
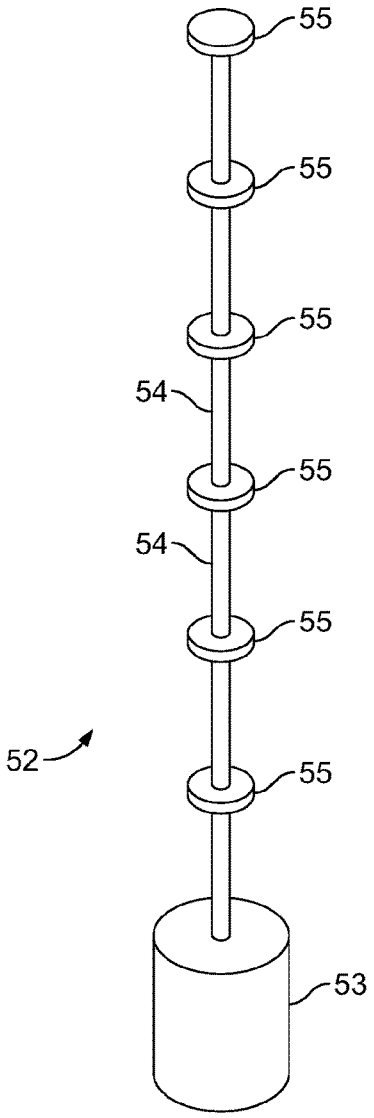
FIG. 8A is a diagram of an embodiment of a motorized rotation assembly configured to cause the rotation of turntables disposed within a refrigerator.
Figure 8B:
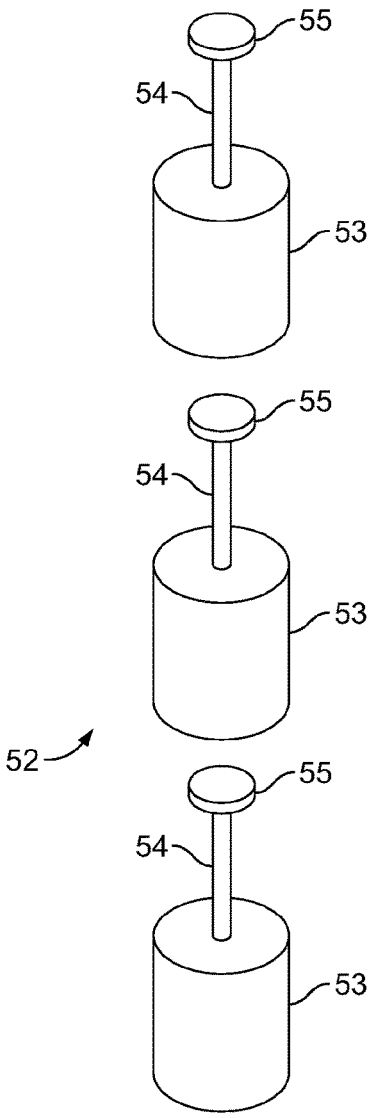
FIG. 8B is a diagram of an alternative embodiment of a motorized rotation assembly comprising a plurality of electric motors.

In some embodiments of the invention, at least one rotatable shelf assembly 1 or one rotating inner drum 43 may be coupled to a motor 53, such as an electric motor, that may be configured to cause the rotation of at least one turntable 2 or drum 43. Referring now to FIGS. 8A and 8B various embodiments of motorized rotation assemblies 52 are shown. In FIG. 8A, an embodiment of a motorized rotation assembly 52 may comprise an electric motor 53 coupled to a shaft 54 on which a plurality of rotation wheels 55 are disposed. In this embodiment, an electric motor 53 may be configured to cause the rotation of shaft 54, which thereby causes the rotation of a plurality or rotation wheels 55 which may be rigidly attached to shaft 54.

In some embodiments, at least one motorized rotation assembly 52 may be disposed in at least one cavity 17 seen in FIGS. 1C and 5A. The spacing of a plurality of rotation wheels 55 may be configured to align with the spacing of a plurality of slits 26 disposed on interior walls 16, 161 of refrigerator 18, as seen in FIGS. 5A and 5B. Slits 26 may be configured in size and shape so as to allow a substantially small portion of rotation wheels 55 to protrude through slits 26 into refrigeration compartment 28. In some embodiments of the invention, at least one rotation wheel 55, protruding from cavity 17 through slit 26 into refrigeration compartment 29, may make contact with an outer edge portion of at least one turntable 2. The contact portion between rotation wheel 55 and an outer edge portion of turntable 2 may be configured to cause turntable 2 to rotate when electric motor 53 is activated.

As pictured in FIG. 8A, in some embodiments a single electric motor 53 may be coupled to a plurality of rotation wheels 55 such that when electric motor 53 is activated a plurality of rotation wheels 55 all turn in unison. The activation of electric motor 53 may also cause a plurality of turntables 2 disposed inside a refrigerator 18 to all turn unison. However, as seen in FIG. 8B, in some embodiments of the invention, a plurality of electric motors 53 may be coupled to individual rotation wheels 55. This may allow the rotation of rotation wheels 55 and turntables 2 individually, when each corresponding electric motor 53 is activated.

In some embodiments, the invention may include a motor 53 to stop the rotation rapidly, or let the turntable shelf slow down gradually. A rotation damper may be placed around shaft 54, or contacting shaft 55 to resist rotation speed of 54, or 55. This is damper is made for when motor 53 receives not voltage from 72, the rotation of turntable 1 will quickly stop.

In some embodiments, the invention may include a motor 53 with a solenoid function built in motor 53. When the voltage from control circuitry 72 receives a voltage to revolve turntable 1 and drum 43, the internal magnets of motor 53 push the commutator of 53 forward interlocking or contacting shaft 54. When voltage from 72 ceases, the commutator will disengage and let 54, and 55 freely rotate. This would allow the user to feel no resistance of the motor 53 while attempting to manually rotate assembly 1.

In some embodiments, the invention may include one, two, three, four, five, six, seven, eight, or more rotation wheels 55 coupled to one, two, three, four, five, six, seven, eight, or more electric motors 53. In some embodiments, rotation wheels 55 and electric motors 53 may be configured to operate in unison, while in other embodiments, rotation wheels 55 and electric motors 53 may be configured to be independently operable, with each electric motor 53 coupled only to one or some of the rotation wheels 55.

Rotation wheels 55 may, in some embodiments, comprise a high friction outer surface configured to engage an outer surface of turntable 2, which may also be configured to comprise a high friction outer surface. In some embodiments, outer surfaces of rotation wheels 55 and turntable 2 may be coated with or comprise high friction rubber, small bumps or ridges, or interlocking teeth.

Motorized rotation assembly 52 may be disposed within at least one cavity 17 and attached to the inner walls 161, 162 of at least one cavity 17 with springs configured to either pull or push motorized wheels 55 through slits 26.

Electric motors 53 may be configured to allow rotation in a clockwise direction or a counter-clockwise direction. Electric motors 53 may further be connected, in some embodiments to control circuitry 72 configured to activate electric motors 53 when predetermined events occur. For example, in some embodiments, electric motors 53 may be configured to activate, causing rotation of turntables 2 or inner drum 43 (shown in FIG. 7) when the refrigerator door 39 is opened, when a compressor 63 of refrigerator 18 is running, or when both the refrigerator door 39 is opened and when a compressor 63 of refrigerator 18 is running. FIGS. 9E and 9F provide a non-limiting examples of logic that control circuitry 72 may use to provide automated rotation of at least one rotatable shelf assembly 1. In some embodiments, further discussed below, electric motors 53 may be configured to be controllable in response to user hand gestures.

In some embodiments, electric motors 53 may be connected to operation controls disposed within the refrigeration space 28, on door 39, or on an outer surface of refrigerator 18. Operation controls may include switches 71, which may include buttons or proximity sensors 70, configured to allow a user to control the rotation of turntables 2. Switches may be configured to control which turntables 2 rotate and in which direction the rotation occurs. The placement of proximity sensors in some embodiments of the invention, on the side portions of interior walls 16 may be seen in FIGS. 5A and 5I. They may be touchless sensors for sanitation purposes.

Figure 9A:
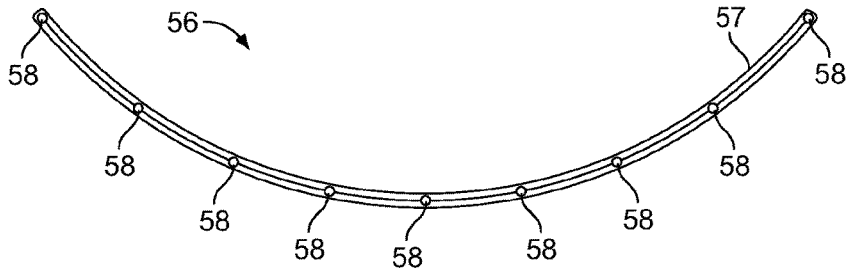
FIG. 9A is a diagram of an embodiment of a sensor array configured for use in some embodiments of the invention.
Figure 9B:
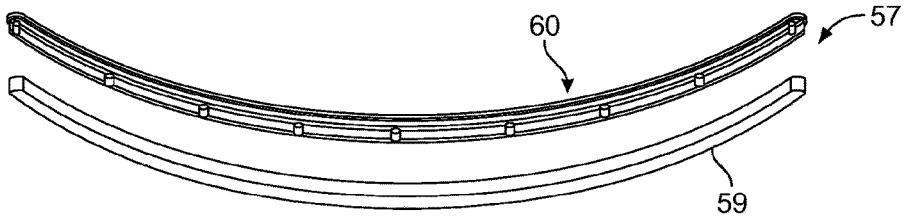
FIG. 9B is a diagram of an exploded view of a two-part housing for use in an embodiment of a sensor array.

Referring now to FIGS. 9A and 9B, an embodiment of a sensor array 56 is shown that may be used in some embodiments of the invention. Sensor array 56 may comprise a housing 57 and a plurality of sensors 58 disposed therein. In some embodiments the housing 57 is formed from an upper shell 60 and a lower shell 59, with the sensors 58 disposed on upper shell 60, on lower shell 59, or between upper shell 60 and lower shell 59. The housing 57 may be shaped in an arc with a radius configured to substantially follow the outer radius of rotatable shelf assembly 1. In other embodiments, the sensor array housing 57 may be configured to be substantially straight.

Sensor array 56 may comprise a strip of several sensors 58 positioned around an arc that has a radius substantially similar to the outside radius of rotatable shelf assembly 1. Sensor array 56 may be mounted on the ceiling of refrigerator 18, as seen in FIGS. 1A and 9D, or embedded in refrigeration space 28 and assembled in projected alignment with the outer diameter of rotatable shelf assembly 1. Sensor array 56 may also be installed in the base of refrigerator 18 or divider 29 with the top of the upper shell 60 level or substantially level with base of refrigerator 18 or divider 29; additionally sensor array 56 may also be located in any position in the refrigerator that allows for detection of objects by sensor array 56. Sensors 58 may be angularly arrayed or arranged in a horizontal-pattern. In some embodiments a sensor array may be positioned in a substantially vertical alignment along the left inner wall of refrigerator 18 or the right inner wall of refrigerator 18. The spacing of sensors 58 may be configured so as to not exceed the width of an average hand or not to exceed six inches. In some embodiments, the sensor array 56 may comprise 8, 9, 10, 11, 12, 13, 14, 15, 16, 17, 18, 19, 20, 21, 22, 23, 24, or more sensors 58, although it should be understood that greater or fewer sensors 58 are contemplated. The spacing of the sensors 58 may be 0.5, 1.0, 1.5, 2.0, 2.5, 3.0, 3.5, 4.0, 4.5, 5.0, 5.5, or 6.0 inches apart, although it should be understood that larger or smaller spacing distances are contemplated; additionally the spacing between two adjacent sensors may be equal or non-equal.

In some embodiments, sensor array 57 may be attached to either the roof or floor of a refrigeration compartment 29 of a refrigerator 18 and a reflector or additional sensor array 57 may be aligned at the opposing end. Sensor array 57 may further be positioned so that the sensors 58 are just beyond the outer boundary of a rotatable shelf assembly 1. The positioning of sensor array 57 may be configured to allow for sensing of a user's hand by the sensor array as it enters over rotatable shelf assembly 1 or is waived in front of rotatable shelf assembly 1.

Figure 5I:
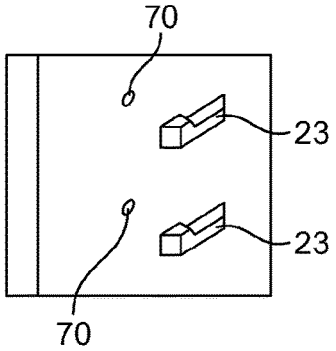
FIG. 5I is a diagram of the placement of sensors relative to bracket supports for use in some embodiments of the invention.

Sensors 58, may, in some embodiments, comprise proximity sensors or any other suitable type of sensor. In some embodiments, the proximity sensor may comprise an infrared sensor. Other touchless sensors 70 may be located on the right and left side portions of interior wall 16, as seen in FIGS. 5A and 5I. Further, protruding support brackets may also comprise additional sensors 62, as seen in FIGS. 5C-5G. In some embodiments, sensors 58 are a single sensor which is configured to detect the absence or presence of an object.

Figure 9C:
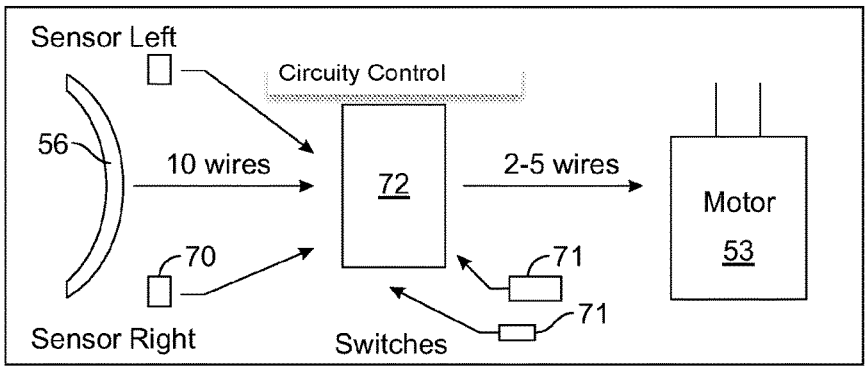
FIG. 9C is a wiring diagram for use with some embodiments of the invention.
Figure 9D:
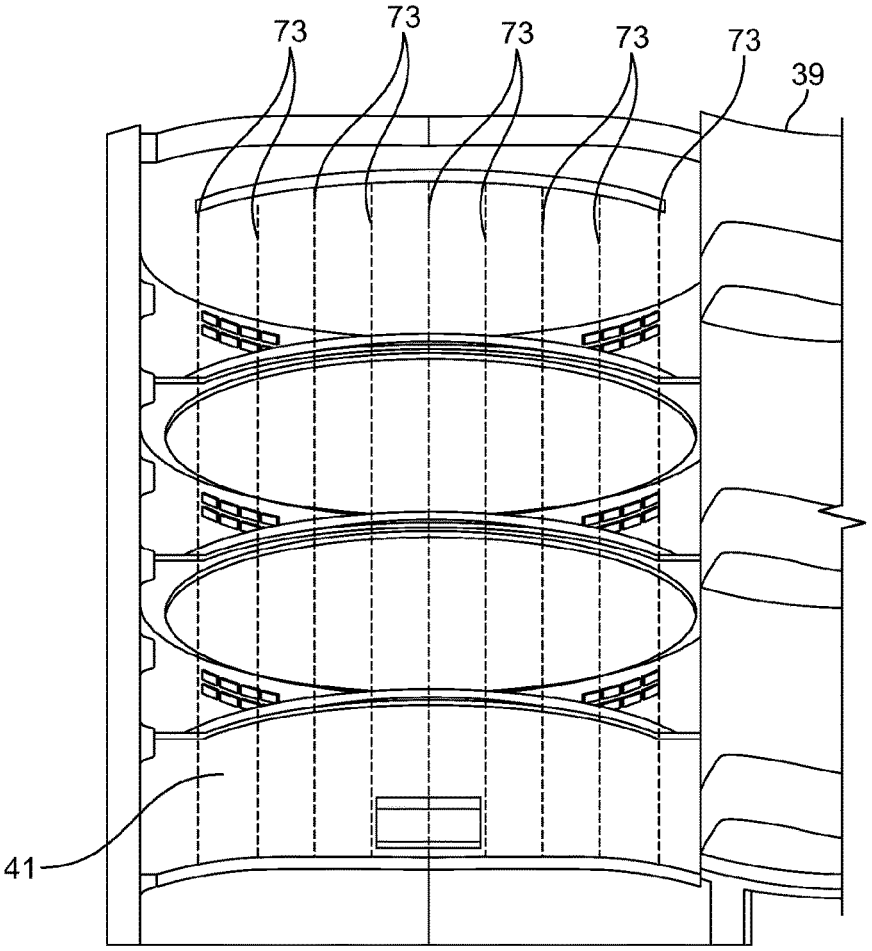
FIG. 9D is a diagram illustrating the placement of sensor beams in some embodiments of the invention.
Figure 9E:
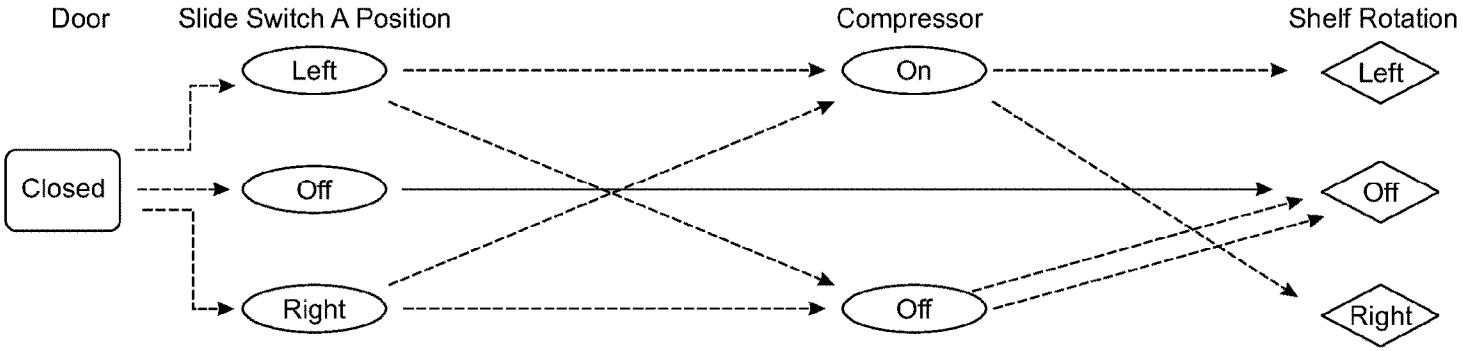
FIG. 9E is a logic flowchart illustrating automation programming in some embodiments of the invention when the refrigerator door is in a closed position which may be used to cause the rotation of rotatable shelving when a compressor of a refrigerator is running.
Figure 9F:
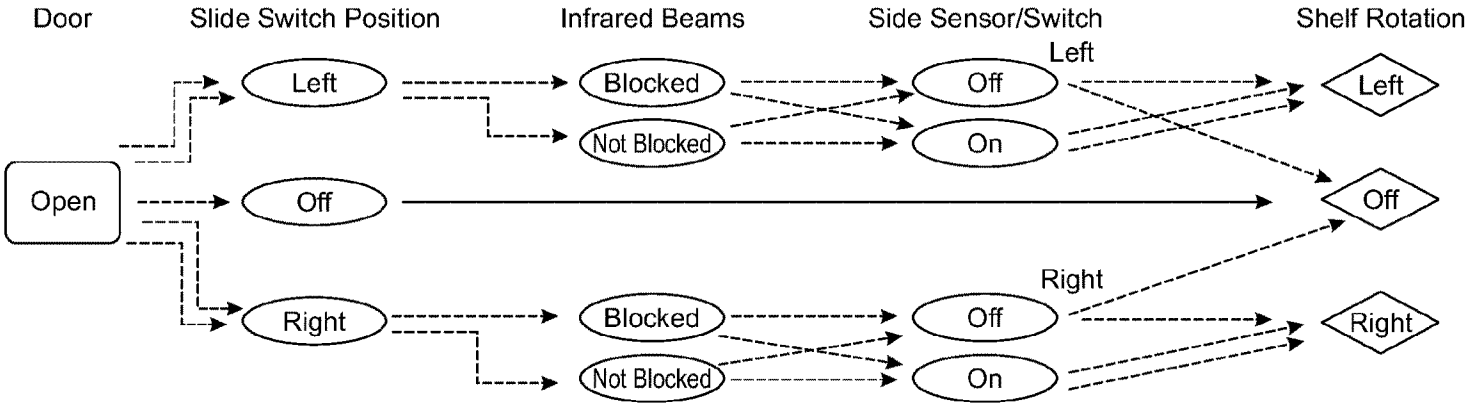
FIG. 9F is a logic flowchart illustrating automation programming in some additional embodiments of the invention when a refrigerator door is in an open position which may be used to control clockwise and counter-clockwise rotation of rotatable shelving.

FIG. 9C illustrates a wiring diagram that may be used with some embodiments of the invention. Sensors 58 of sensor array 56 may be wired to control circuitry 72. Similarly touchless sensors 70 located on the right and left side portions of interior wall 16 may be wired to control circuitry 72. Switches 71 may also be connected to control circuitry 72. Control circuitry 72 may then be wired to electric motors 53. In some embodiments, control circuitry 72 is wired to a plurality of electric motors 53 and may control each of the plurality of electric motors 53 individually, while in other embodiments control circuitry 73 is wired to a single electric motor 53. Control circuitry 72 may further be programmed to control the activation of electric motors 53 in response to user inputs sensed by sensors 58, 72 and/or received from switches 71 and touchless sensors 70.

Referring now to FIG. 9D, an embodiment of a sensor array 57 comprising nine sensors 58 is depicted. In this example, the nine sensors 58 create nine sensor beams 73, wherein each individual sensor 58 creates a single vertical sensor beam 73 that passes in front of a portion of at least one rotatable shelf assembly 1 installed within refrigerator 18. In this way an array of sensor beams 73 is formed in the opening of the refrigerator 18, in front of at least one rotatable shelf assembly 1. This array of sensor beams 73 may be positioned to detect inputs from a user's hand passing through the sensor beams 73 in front of or over a rotatable shelf assembly 1 installed within refrigerator 18. An input, for purposes of this disclosure, is defined as the signal received from a single sensor 58 when that sensor's sensor beam 73 is broken, or, in other words, when a user's hand or any other objects which are larger than a predetermined threshold pass through the sensor beam 73. (For example, the threshold may be configured so that control circuitry 72 may detect a thin object such as a pencil but not miniscule objects such as smoke or dust particles.)

Figure 9G:
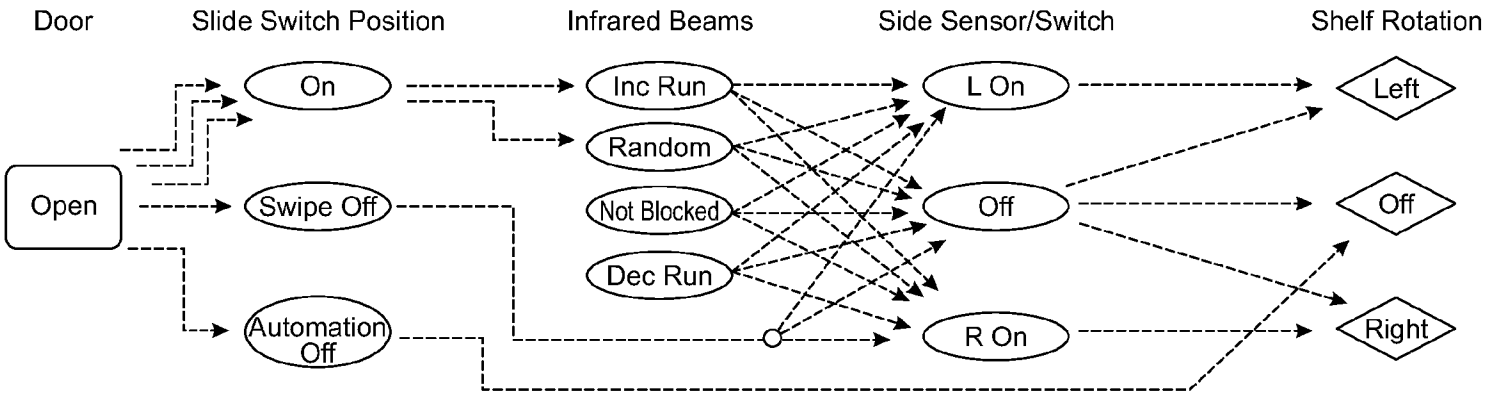
FIG. 9G is a logic flowchart illustrating automation programming in some additional embodiments of the invention which may be used to control clockwise and counter-clockwise rotation of rotatable shelving in response to user hand gestures.

Control circuitry 72 may be connected to sensors 58, as seen in FIG. 9C, so that control circuitry 72 may process inputs received from sensors 58. An output of control circuitry 72 may further be connected to electric motors 53 such that control circuitry 72 can activate or deactivate electric motors 53 in response to the inputs received from sensors 58. Control circuitry 72 may further be connected to switches 71 and touchless sensors 70 that may be configured to provide further automation control, including, but not limited to, enabling or disabling automation and selecting between various control schemes, as seen in FIGS. 9E-9G. Control circuitry 72 may further comprise a timer that is configured to record the time between different inputs.

Control circuitry 72 may thus be configured to control the rotation of turntables 2 in response to patterns in the inputs received from sensors 58 which are received within a specified time limit. For purposes of this disclosure, a pattern is defined to be a series of inputs, received from various sensors, within a specified time limit. Various patterns in the inputs received from the sensors 58 may cause the control circuitry 72 to start or stop the rotation of turntable 2 in either a clockwise or counter-clockwise direction, reverse the direction of rotation, or alter the speed of the rotation, either by causing the rotation to accelerate or decelerate.

For example, if control circuitry 72 receives a first input from a first sensor followed by a second input from a second sensor immediately adjacent to the first sensor, within a specified time limit, and then receives no additional input within a second specified time limit, from the time the second input was received, this pattern may signal the control circuitry stop the rotatable shelf assembly from rotating. This input pattern may reflect the input pattern created when a user reaches directly over or in front of the turntable 2. In other embodiments, the first and second input may not need to be received from immediately adjacent sensors in order to signal control circuitry 72 to stop rotation of turntable 2. Further, in other embodiments, the pattern signaling control circuitry 72 to stop rotation of turntable 2 may comprise three or more input signals received from nonadjacent sensors.

Similarly, if control circuitry 72 receives sequential inputs from sequential sensors—i.e., if it receives a first input from a first sensor followed by a second input from a second sensor followed by a third input from a third sensor, where the first sensor is located immediately adjacent to the second sensor on one side of the second sensor, and the third sensor is located immediately adjacent to the second sensor on the opposite side of the second sensor, within a specified time limit—this may signal control circuitry 72 to rotate turntable 2 in either a clockwise or counter-clockwise direction. This input pattern may reflect the pattern created when a user waves his hand, either to the right or the left, through the array of sensor beams 73. In other embodiments these patterns may be modified. For example, control circuitry 72 may require that three, four, five, six, or more sequential inputs be received to trigger the rotation of turntable 2.

The direction in which the sensor beams 73 are broken, will create a pattern of inputs in the corresponding direction. Control circuitry 72 may be configured to recognize the direction in which the inputs are received and rotate turntable 2 in that direction. For example, if a first input is received, followed by a second input from a sensor immediately to the right of a first sensor, followed by a third input from a sensor immediately to the right of the second sensor, this may cause the control circuitry 72 to rotate turntable 2 in a clockwise direction. If a first input is received, followed by a second input from a sensor immediately to the left of a first sensor, followed by a third input from a sensor immediately to the left of the second sensor, this may cause the control circuitry 72 to rotate turntable 2 in a counter-clockwise direction. In some embodiments, the directions of these two examples may be reversed.

In some embodiments, a timer in control circuitry 72 may require that each additional input be received within 1.5 seconds of the last input. Thus, if a first input is received and a second input is received 2 seconds later, the control circuitry may possibly not recognize a pattern, as the two inputs were not received within the specified time limit. In some embodiments the time limit may require that consecutive inputs are received within 2, 1.5, 1, 0.5, 0.25 or less seconds of the preceding input. Further, in other embodiments, the time limit may be shortened after each additional input is received. For example, control circuitry 72 may be configured to require that a second input is received within 1.5 seconds of a first input but that a third input be received within 0.5 seconds of the second.

Control circuitry 72 may further be configured, in some embodiments, to require different minimum numbers of inputs within the specified time limits to recognize a pattern. For example, in one embodiment, control circuitry 72 may be configured to require that more than a single input be received within the time limit to recognize a pattern and trigger an action. Control circuitry 72 may further be configured to recognize that a minimum of two inputs within a specified time limits as a pattern. For example, if a first input is received and a second input is received before the time limit expires, control circuitry 72 may be configured to recognize this as a pattern and trigger an action, even if no further inputs are received. Control circuitry 72 may likewise be configured to require three or more inputs to be received before recognizing a pattern and triggering an action.

In some embodiments, control circuitry 72 may be configured to recognize a maximum number of inputs as a pattern that triggers an action. Control circuitry 72 may be configured to disregard additional inputs after a maximum number of inputs are received. For example, control circuitry 72 may be configured to recognize a maximum of three inputs within a specified time limit as a pattern. If control circuitry 72 receives consecutive inputs from a first, second, third, and fourth sensor, the fourth sensor's input is discarded because the first, second, and third sensors' inputs were already recognized as a pattern. In some embodiments, control circuitry 72 may be configured so that two, three, four, five, or more consecutive inputs are recognized as the maximum number of inputs required to form a pattern and trigger an action. Control circuitry 72 may also be configured to include a delay time before an additional input may be received after a pattern is recognized. In some embodiments, the control circuitry 72 may be configured to discard additional inputs until 0.1, 0.25, 0.5, or more seconds after a pattern is recognized.

In some embodiments, control circuitry 72 may further be configured to control the speed of rotation of a rotatable shelf assembly in response to input patterns received. In some embodiments, this may be achieved by recording the time that elapses between consecutive inputs and adjusting the speed of rotation accordingly. For example, if two consecutive inputs are received with 1 second elapsing there between, control circuitry may cause the rotation of turntable 2 at a first speed. However, if two consecutive inputs are received with 0.5 seconds elapsing there between, control circuitry 72 may cause the rotation of a rotatable shelf assembly 1 at a second speed, faster than the first. In other embodiments, the speed of rotation may be controlled recording the time that elapses between two consecutive input patterns of the same type, or in other words, two patterns that indicate that control circuitry 72 should perform the same function, like two consecutive patterns that indicate that control circuitry 72 should cause clockwise rotation. For example, if three consecutive inputs are received, forming a timed pattern, and then three more consecutive inputs are received, forming the same pattern, with 1 second elapsing there between, this may signal control circuitry 72 to cause the rotation of a rotatable shelf assembly 1 at a first speed. However, if three consecutive inputs are received, forming a pattern, and then three more consecutive inputs are received, forming the same pattern, with 0.5 seconds elapsing there between, this may signal control circuitry 72 to cause the rotation of a rotatable shelf assembly 1 at a second speed, faster than the first speed. The control circuitry 72 records the time differences between inputs of pattern one and pattern two. After this, control circuitry 72 calculates by the ratio of the average time differences of pattern 1 and pattern 2 and enables the new voltage value for 53 based on that ratio. In yet other embodiments, control circuitry 72 may be configured to accelerate the rotation of a rotatable shelf assembly with each consecutive similar pattern of inputs that is received. For example, if a pattern of three consecutive inputs is received followed by a second pattern of three consecutive inputs, where the two patterns are the same, control circuitry 72 may cause the rotation of a rotatable shelf assembly 1 to accelerate. If a third pattern of the same type is then received, control circuitry 72 may then cause the rotation to accelerate yet again. In this way a user may cause the rotation speed to increase by repeating the same pattern again. In some embodiments, repeating the same pattern, i.e., a pattern of consecutive inputs, but in the opposite direction, may signal control circuitry 72 to decelerate the rotation speed. In some embodiments, control circuitry 72 may be configured to allow maximum rotation speed, beyond which it will not increase rotation speed.

Referring now to FIG. 9G, in some embodiments, a slide switch may be included on refrigerator 18 to allow a user to select from among various options that will determine how the control circuitry 72 causes the rotation of turntables 2. The slide switch may comprise a three-position switch which allows the user to select between controlling the rotation of turntables 2 with hand motions and sensors located on the side portions of interior walls 16, controlling the rotation with only hand gestures, or disabling rotation of turntables 2. If a user selects to control the rotation of turntables 2 with hand motions and sensors, as indicated when the slide switch is in the "On" position in FIG. 9G, the control circuitry will respond to the various input patterns described above. In FIG. 9G, "Inc Run" represents a pattern of inputs where a first input is received from a first sensor, followed by a second input from a second sensor immediately to the right of the first sensors, followed by a third input from a third sensor immediately to the right of the second sensor, all within a specified time limit. "Dec Run" represents the opposite pattern, where a first input is received from a first sensor, followed by a second input from a second sensor immediately to the left of the first sensors, followed by a third input from a third sensor immediately to the left of the second sensor, all within a specified time limit. "Random" indicates that a pattern of inputs is received from non-adjacent sensors or For example, if control circuitry 72 receives a first input from a first sensor followed by a second input from a second sensor immediately adjacent to the first sensor, within a specified time limit, and then receives no additional input within a second specified time limit, from the time the second input was received, this pattern may signal the control circuitry stop the rotatable shelf assembly from rotating. FIG. 9G, further illustrates an embodiment where touchless sensors located on right and left side portions of interior wall 16 are further used to control the rotation. "L On" in the figure, represents a scenario where an input is received from the left sensor, and "R On" indicates a scenario where an input is received from the right sensor. FIG. 9G thus presents a flow chart of the potential interaction of the various sensors that may be available in one embodiment of the invention.

Referring now to FIGS. 9E and 9F, flow charts representing how possible door positions, switch positions, and sensor inputs may be configured to cause rotation of turntables 2 are shown. As seen in FIG. 9E, when door 39 is in a closed position, turntable 2 rotation may or may not occur based upon which option a user has selected with the slide switch and whether or not the refrigerator's compressor 63 is running. In certain configurations, control circuitry 72 may be configured to cause rotation of turntable 2 when compressor 63 is running. FIG. 9F, illustrates possible automation results of some embodiments when the refrigerator's door 39 is in an open position. As seen in FIG. 9F, rotation may occur dependent on the selection of the slide switch, inputs received from the sensors, i.e., the "infrared beams" in the figure, and inputs received from touchless sensors 70 located on the right and left side portions of interior wall 16. The refrigerator may also include a sensor array; the sensor array may be configured for a mode which will cause the motor to stop with or without control circuitry 72 if any beam is broken and any input is received. In some embodiments, when a hand approaches rotatable shelf assembly 1, the when the sensor array detects that a single beam has been broken, then the refrigerator will cause the rotating shelf to stop rotating. Additionally, various hand gestures and swiping gestures may be used to control the rotation of the rotating shelf assembly via 1 via control circuitry 72.

Figure 10A:
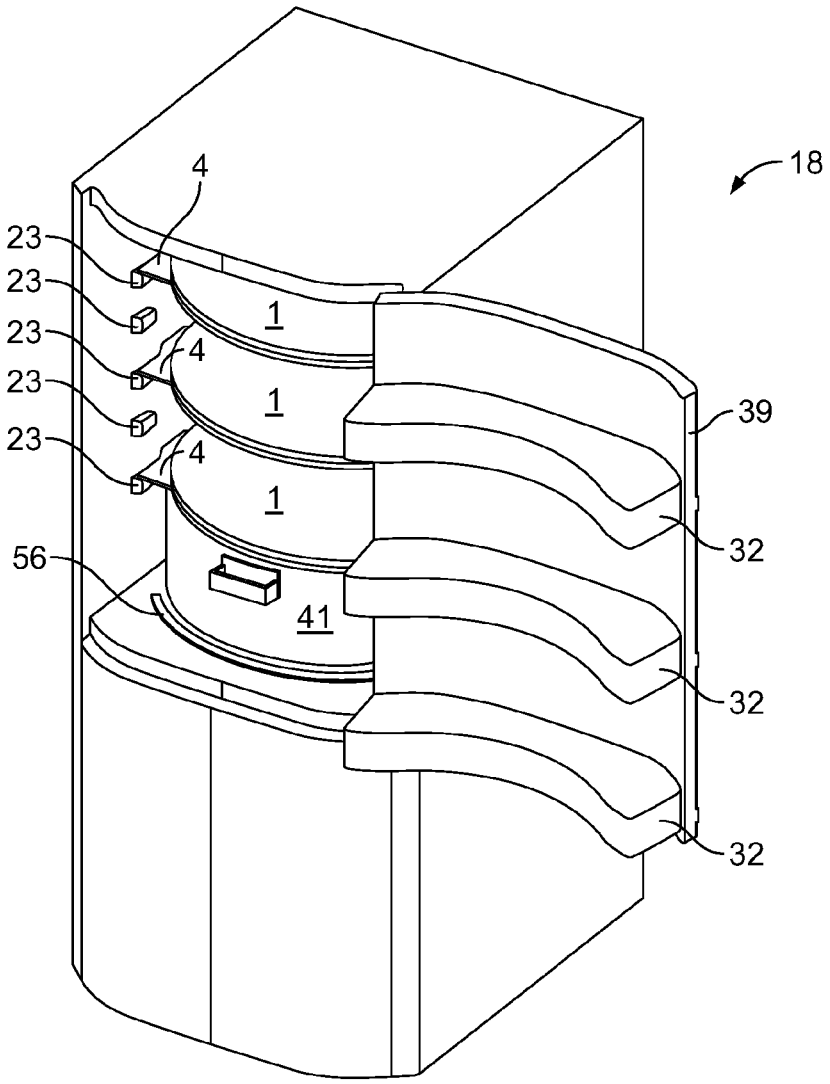
FIG. 10A is a perspective view of a refrigerator comprising some embodiments of the invention with the refrigerator door in an open position.
Figure 10B:
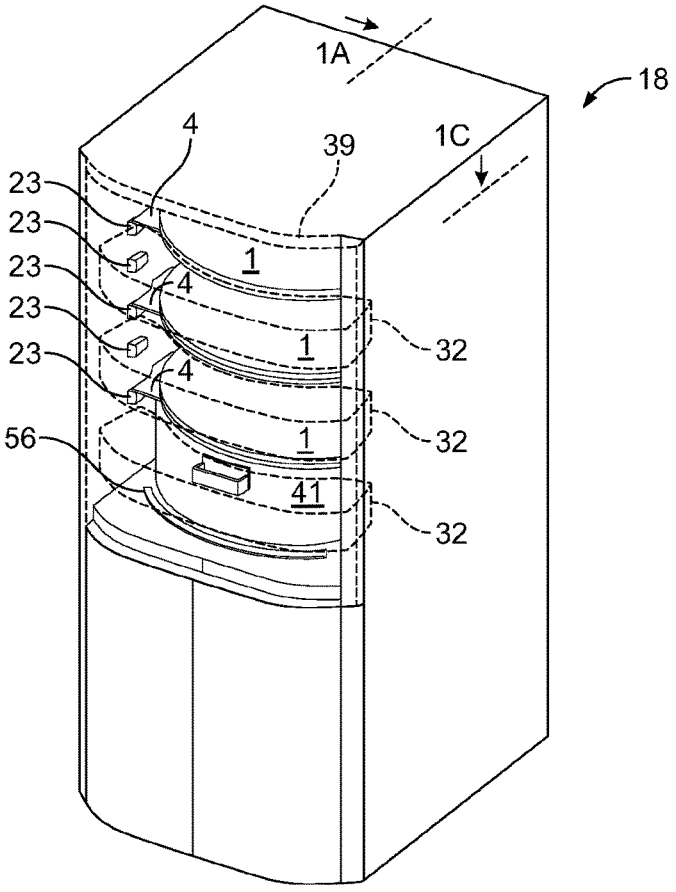
FIG. 10B is a perspective view of the refrigerator of FIG. 10A with the refrigerator door fully closed and the refrigerator door and refrigerator door shelves shown with broken lines.

Referring now to FIG. 10A, an embodiment of the invention is shown, comprising refrigerator 18 with three of rotatable shelf assembly 1 disposed therein. A rotatable drawer assembly 41 is also included. (Rotatable drawer assembly 41 is the third rotatable shelf assembly 1). Door 39 comprises three door shelves 32 and is shown in an open position. FIG. 10B illustrates the embodiment shown in FIG. 10A but with door 39 in a closed position. Door 39 and door shelves 32, however, are depicted in dashed lines so that the interior of refrigerator 18 may still be seen.

Figure 15A:
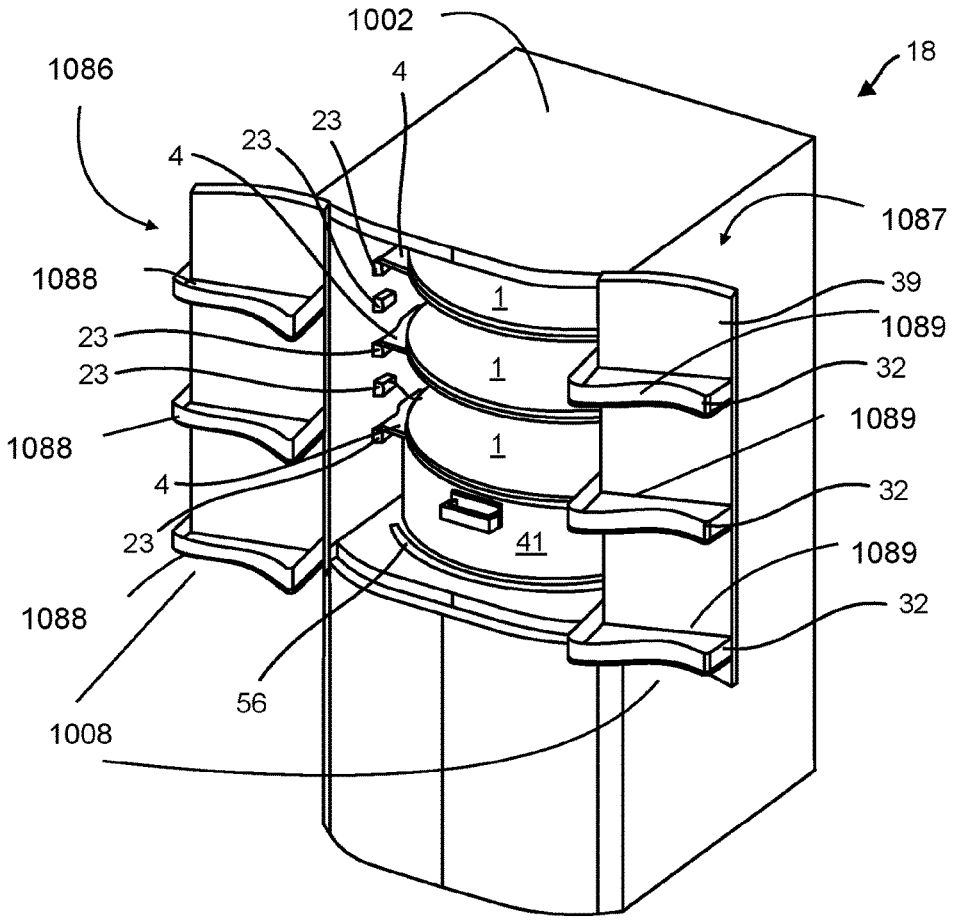
FIG. 15A is a perspective view of a refrigerator comprising some embodiments of the invention with French-style doors which are in the open position.

Referring now to FIG. 15A, an embodiment of the invention is shown comprising refrigerator 18 with three of rotatable shelf assembly 1 disposed therein. A rotatable drawer assembly 41 is a type of rotatable shelf assembly and is depicted in FIG. 15A. (Rotatable drawer assembly 41 is depicted in FIG. 15A as the third rotatable shelf assembly 1; however it should be noted that embodiments of the refrigerator may contain any number of rotatable shelf assembly and any number of rotatable drawer assembly in any order; for example, rotatable drawer assembly 41 may also be positioned on the top shelf and rotatable shelf assemblies may be located in the middle and bottom shelves). French-style door-set 1008 comprises six door shelves 32 in this embodiment and is shown in an open position. A French-style door set 1008 comprises a left French-style door 1086 and a right French-style door 1087. As shown here, the left French-style door 1086 has the same length as the right French-style door 1087, but in other embodiments the two French style-doors of a French-style set may have different lengths from each other. A nonlimiting example would be a difference in length that falls within the range of 0.5 inches to 8 inches. Cabinet shell 1002 houses rotatable shelf assembly 1. The number of door shelves 32 may range between 1 and 20.

Figure 15B:
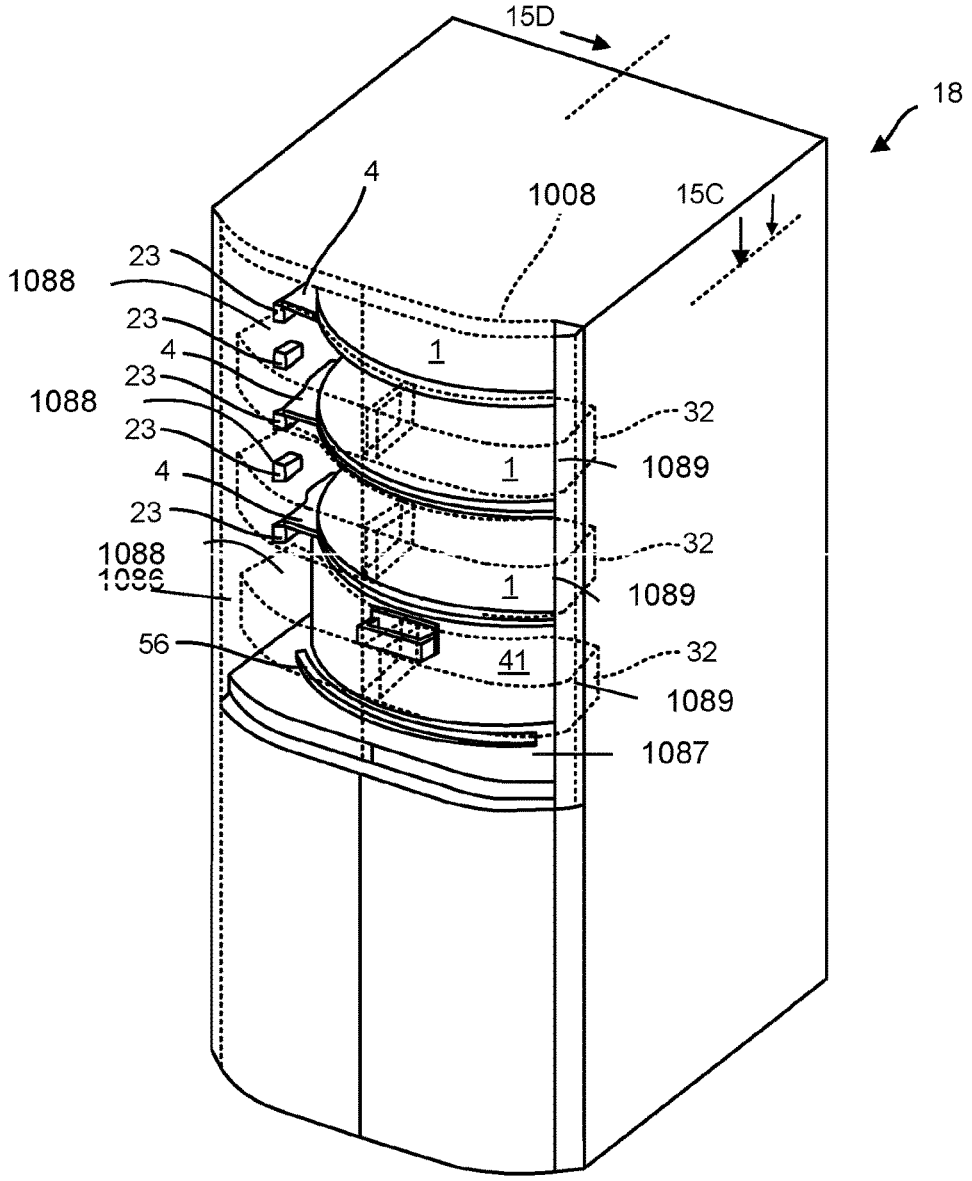
FIG. 15B is a perspective view of the refrigerator of FIG. 2A with the refrigerator's French-style doors fully closed and the refrigerator doors and refrigerator door shelves shown with broken lines.

FIG. 15B illustrates the embodiment shown in FIG. 15A but with French style-door 1008 in a closed position. Door 39 and door shelves 32, however, are depicted in dashed lines so that the interior of refrigerator 18 may still be seen. Left French-style door 1086 and right French-style door 1087 as well as a plurality of door shelf of left French-style door 1088 and a plurality of door shelf of right French-style door are shown.

Figure 15C:
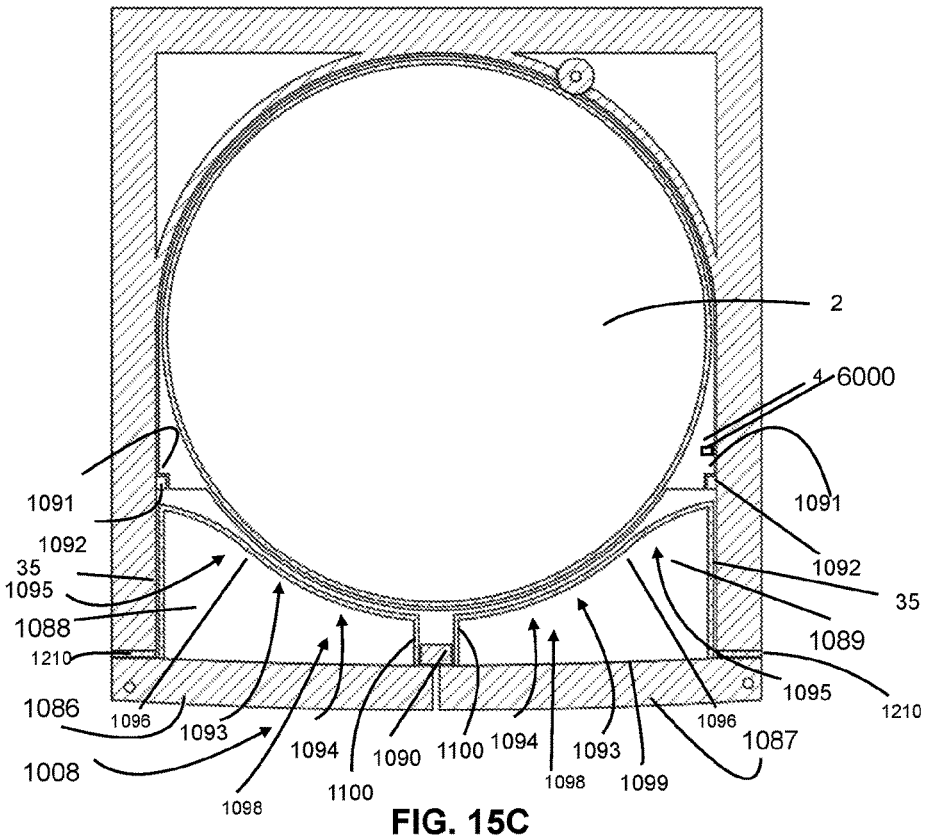
FIG. 15C is a diagram of a cross-sectional view with a cross section taken from a refrigerator such as the one shown in FIG. 15A, from a top perspective, of an embodiment of a refrigerator with a rotatable shelf assembly installed therein.

FIG. 15C depicts a diagram of a cross-sectional view with a cross section taken from a refrigerator such as the one shown in FIG. 15A, from a top perspective, of an embodiment of a refrigerator with a rotatable shelf assembly installed therein. FIG. 15C is similar to FIG. 3C; unless otherwise noted, the element numberings remain the same in FIG. 15C as in FIG. 1C.

As shown in FIG. 15C, some embodiments of the invention may be configured to efficiently utilize the interior space of a refrigerator 18. An interior wall 16 of refrigerator 18 may be shaped so that the rear portion of interior wall 161 follows a substantially constant radius that is configured to touch an outer surface of support bracket 4. Side portions of interior wall 16 may be substantially straight. The space between the interior walls 16, 161 of refrigerator 18 and outer walls 162 may be filled with insulation 15 to insulate the temperature of air within the refrigerator from the temperature of air outside of the refrigerator. The rear portion of interior wall 161 may curve at a radius to create at least one cavity 17 in the rear corners of refrigerator 18 between the rear portion of interior wall 161 and outer walls 162. Mechanical components and/or ductwork may be configured within the at least one cavity 17 to provide refrigerated air to refrigeration compartment 29. As in all disclosed diagrams of a refrigerator 18, an embodiment of a motorized rotation assembly 52 may comprise an electric motor 53 coupled to a shaft 54 on which a plurality of rotation wheels 55 are disposed. In this embodiment, an electric motor 53 may be configured to cause the rotation of shaft 54, which thereby causes the rotation of a plurality or rotation wheels 55 which may be rigidly attached to shaft 54. As disclosed, various circuitry wiring may connect a switch 6000 or sensor. Switch 6000 may be turned on or off by a user, or switch 6000 may be configured so that when turned to one position an associated rotatable disc-shaped assembly will rotate in clockwise or counterclockwise direction. As would be understood by one skilled in the art, various configurations may be used to control the rotation of turntable 2 and/or rotatable disc-shaped assembly.

Referring to FIG. 15C, support bracket notch 1091 is located in preferred embodiments at a front corner of a support bracket 4; notch 1091 may be configured to engage with a notch bracket 1092 to limit the forward movement of support bracket 4, which may reduce the probability of having a rotational shelf assembly 1 unintentionally slip below the horizontal plane when a user is rotating turntable 2. Notch bracket 1080 may be any type of bracket; in preferred embodiments notch bracket 1080 may be an L-shaped mount 1190 which has a horizontal portion which a support bracket may rest upon and a vertical portion which may limit the forward movement of a support bracket, a vertical pilaster that extends from the interior wall of the refrigerator and directly engages notch bracket 1080 (see FIG. 31B), or a vertical pilaster with slots that receives a notch bracket and/or a mounting bracket. Front edge 1099 of door shelf abuts back portion of door; in some embodiments front edge 1099 may be part of a shelf or may be defined by the door itself.

Referring now to FIG. 15C, door shelf 32 will be described in greater detail. In FIG. 1C, door shelf 32 is one continuous piece or is formed from multiple pieces which join together to form one continuous piece; in FIG. 15C, door 39 is equivalent with a French-style door set 1008, as described earlier comprises a left French-style door 1086 and a right French-style door 1087. Door shelf 32 comprises a door shelf 1088 of left French-style door 1086 and a door shelf 1089 of right French-style door. (The application will disclose at least two different embodiments of shelves for French-style doors; it is anticipated that in some embodiments of refrigerator 18, the two different embodiments of shelves for French-style door are present in the same refrigerator 18; additional embodiments of French-style door shelves may also be present in the same refrigerator 18.) Insulation flap 1090 may be made of insulation material such as rubber or other material which is useful for insulating such as poly urethane foam, and may be located in the position as shown in the diagram; additional embodiments include the 1090 being coupled to the abutting left French-style door, the right French-style door, or both, by common affixation means such as glue, magnets, nails, screws. Insulation flap 1090 may be encased in vinyl or comprise magnets. One or more sides of the insulation flap may be detachably coupled to a French-style door or a French-style door shelf. The shape of door 39 and door shelves 32 may, in some embodiments, be optimized to allow for increased storage space within the refrigerator. As used herein an arc is an arc with a significant length which is greater than 1 mm and significant width which is greater than 1 mm and a radius is a radius with a significant length and a significant width; the same applying to "arcs," "radii." "center arc," "center arcs," and so forth.

For the embodiment of FIG. 15C. French-style door set 1008 comprises a left French-style door 1086 (which comprises one or more door shelf 1088 of left French-style door 1086—one door shelf 1088 of left French-style door 1086 is shown in this figure) and a right French-style door 1087 (which comprises one or more door shelf 1089 of right French-style door 1087—one door shelf 1088 of left French-style door 1087 is shown in this figure.)

The inner most wall, also known as back wall 1093 of door shelf 1088 of left French-style door 1086 and back wall 1093 of door shelf 1089 of right French-style door 1087 may be formed from standard materials in the shape of two arcs. First, a proximal arc 1094, may closely follow the outer edge portion of a circular shelf, also known as a rotatable disc-shaped shelf 2 or turntable 2, installed into refrigerator 18. In some embodiments this proximal arc 1094 may have a radius equal to or slightly larger than the outermost radius of a rotatable shelf assembly 1 or turntable 2. Several non-limiting examples of center arc 34 may be at 0, 0.1, 0.2, 0.25, 0.5, 1, or 2 inches larger than the outermost radius of a rotatable shelf assembly 1 or turntable 2. Adjacent to proximal arc 1094 may be a distal arc 1095, and in between proximal arc 1094 and distal arc 1095 may be an inflection point! such that distal arc 1095 may be located at the distal end of back wall 1093, also known as the extremities of back wall 1093 of either the door shelf 1088 or the door shelf 1089 which is closer to the interior side wall of refrigerator when compared to the inner side of the door shelf 1089. The distal arc 1095 may be configured to arc away from the circular shelf and may further be configured to allow a narrow clearance between door shelf 1088 of left French-style door 1086 and turntable 2 when left French-style door 1086 is being rotated open or between door shelf 1089 of right French-style door 1087 and turntable 2 when right French-style door 1087 is being rotated open.

Proximal arc 1094 of back wall 1093 contours between 3% and 25% of the perimeter of turntable 2. Back wall 1093 in some embodiments is ogee shaped which means that the back wall 1093 has at least two arcs which curve in opposite directions; in the most preferred embodiments the proximal arc is concave and the distal arc is convex. Proximal arc 1094 defines the edge of proximal area, which is that part of the door shelf 1088 or door shelf 1089 that is bounded by proximal arc 1094 of the back wall 1093, the front edge 1099 of the door shelf which is the edge which is furthest from turntable 2, the side edge of the door shelf 1100, and a line drawn between the inflection point of the back wall of the shelf and the front edge 1099 of the door shelf; the distal area is that portion of door shelf 1088 or door shelf 1089 that is not the proximal area.

In some embodiments of door shelf 32, sidewalls 35 of door shelf 32 may also be formed in the shape of arcs. These arcs may be configured to provide clearance between door shelf 32 and the ends of the refrigerator walls 162 as door 39 is rotated outwards. In other embodiments, sidewalls 35 may be substantially straight.

Figure 15D:
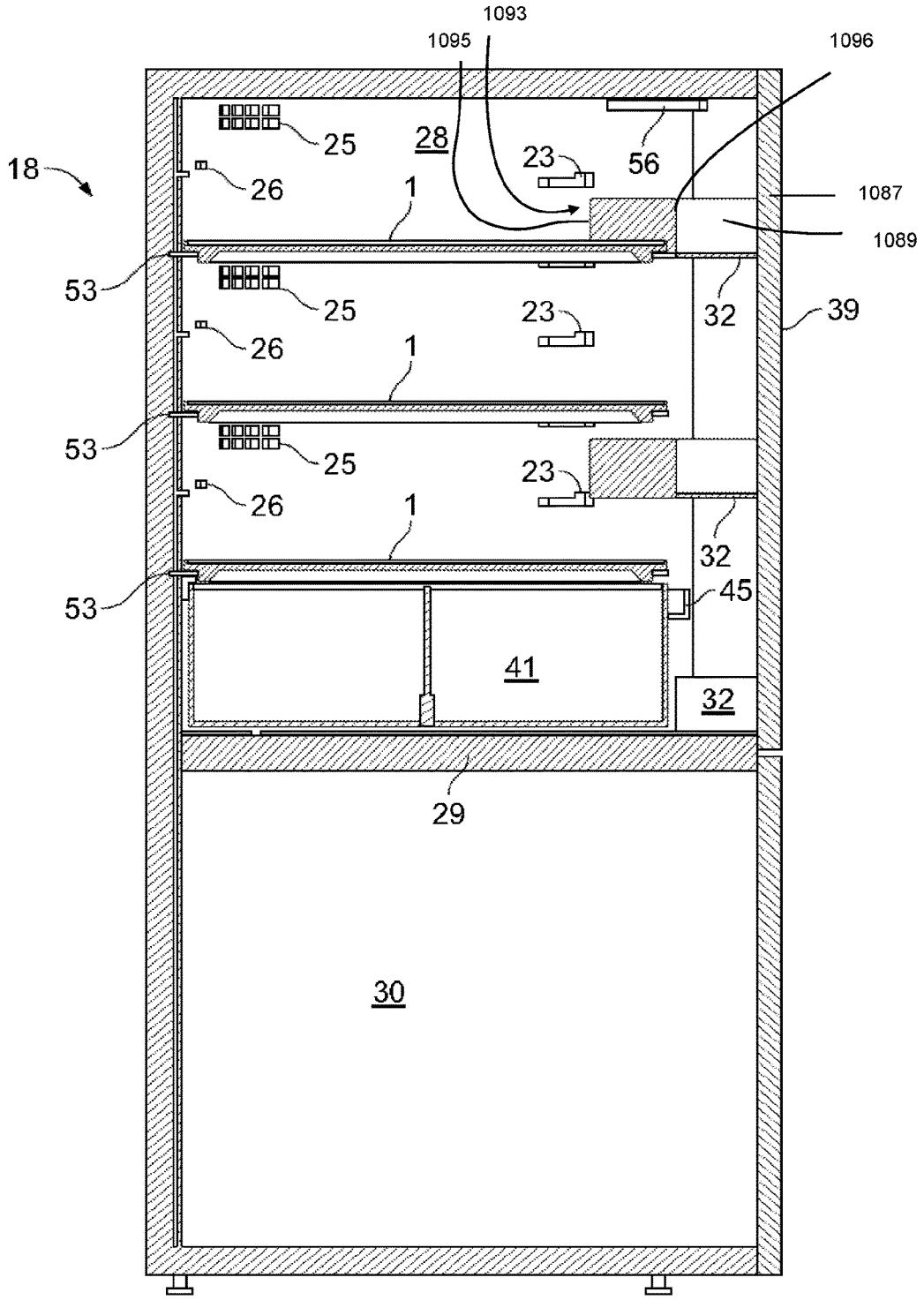
FIG. 15D is a cross-sectional view, from a side perspective, of a refrigerator such as the one shown in FIG. 15B, with more than one rotatable shelf assembly installed therein.

FIG. 15D is a cross-sectional view, from a side perspective, of a refrigerator such as the one shown in FIG. 15B, with more than one rotatable shelf assembly installed therein. Element numbers for FIG. 1A apply, with the following exceptions: a right French-style door 1087 is depicted, a door shelf 1089 of right French-style door 1087 is depicted with a distal arc 1095 of back wall 1093, which is next to inflection point 1096.

Figure 15E:
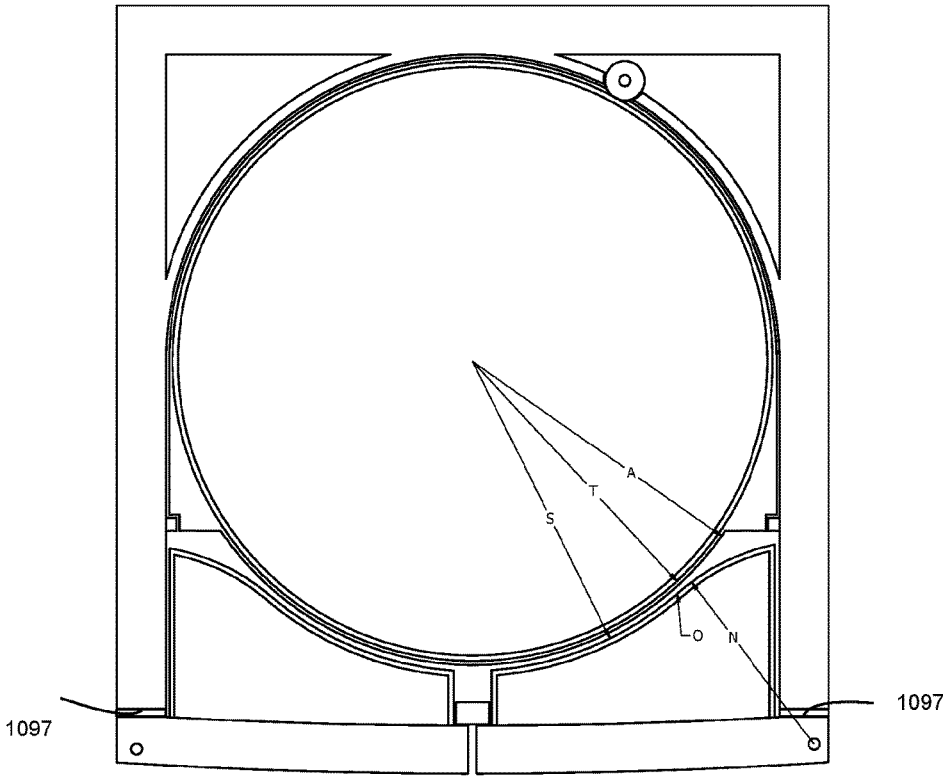
FIG. 15E is a diagram of a cross-sectional view with a cross section taken from a refrigerator such as the one shown in FIG. 15B, from a top perspective, of an embodiment of a refrigerator with a rotatable shelf assembly installed therein, showing radii that may be used when determining the shape, size, and placement of the back wall of door shelves.

FIG. 15E depicts how some of the back wall 1093 size and position are calculated. Element numbers are the same as in 15C; the reader is encouraged to correlate element numbers of 15C with unlabeled elements of FIG. 15E which are relatively similar in size or location. An insulating portion 1097 is comprised of insulating material and shaped so that it fits between the door 39 and the cabinet shell 1002 of refrigerator 18. The radius ending with an arrow that is labeled "S" is representative of a radius that has an endpoint at the center of the rotatable disc shaped shelf and ends on and may be used to define the proximal portion ("proximal arc") of door shelf 1088 or door shelf 1089. The radius ending with an arrow that is labeled "T" is representative of a radius that has an endpoint at the center of the rotatable disc-shaped shelf and ends on and may be used to define the edge of the turntable 2 ("rotatable disc shaped shelf"). The radius ending with an arrow and that is labeled "A" is representative of a radius that has an endpoint on and may be used to define the circular edge of the support bracket. The point that is labeled with an arrow and "O" represents the inflection point. In arrow that is labeled "N" is representative of a radius that has an beginning point at the center of the nearest door hinge, upon which center the door rotates around a vertical axis that is concentric with the center when the door is rotated open, and an end point on the distal arc ("distal portion") of the back wall of door shelf 1088 or door shelf 1089. The distal arc is defined by the radius that is labeled "N". In some embodiments the point at which radius N and radius S are tangent to each other is the inflection point of the ogee-shaped back wall of door shelf 1088 or door shelf 1089; as described earlier, the inflection point is where the proximal arc, which in the more preferred embodiments is concave, ends and where the distal arc, which in the more preferred embodiments is convex, begins. In some embodiments, the inflection point is 20 mm or less from the point at which radius N and radius S are tangent to each other. In other embodiments, the inflection point may be adjusted such that there is clearance between the back wall of door shelf 1088 or door shelf 1089 and the turntable 2 when the door is opened.

Figure 16A:
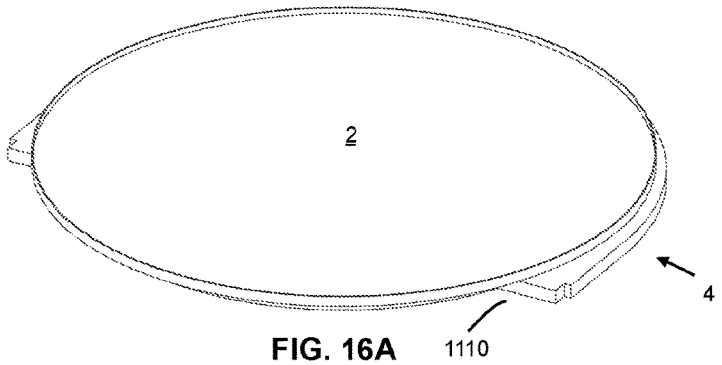
FIG. 16A is an isometric view of an embodiment of a rotatable disc-shaped shelf coupled to the top of a support bracket having a recessed edge.

FIG. 16A is an isometric view of an embodiment of a rotatable disc-shaped shelf 2 coupled to the top of a support bracket 4 having a recessed edge 1110; a bearing assembly is not depicted but is located between the rotatable disc-shaped shelf 2 and the support bracket 4. Various embodiments of recessed edge 1110 are contemplated, including a circular recessed edge (see FIG. 16B) which is defined by a shorter radius for a portion of support bracket 4 which is exposed to the front the refrigeration compartment when installed in refrigerator 18 compared to the radius of all or most of the support bracket which is not exposed to the front of the refrigeration compartment when installed in refrigerator 18. In some embodiments, recessed edge 1110 is a straight edge (see FIG. 16A) that is configured such that a portion of support bracket 4 which is exposed to the front the refrigeration compartment when installed in refrigerator does not protrude as far forward towards the front of the refrigerator and a turntable 2 which is coupled with the support bracket 4. For purposes of clarity, FIG. 16A and FIG. 16B are not the same views of the same embodiment.

Figure 16B:
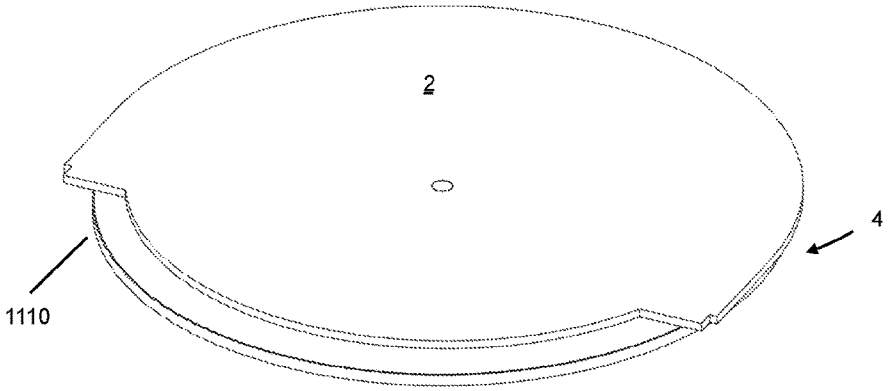
FIG. 16B is an isometric view of the bottom side of an embodiment of a rotatable disc-shaped shelf coupled to the top of a support bracket having a recessed edge.

FIG. 16B is an isometric view of the bottom side of an embodiment of a rotatable disc-shaped shelf 2 coupled to the top of a support bracket 4 having a recessed edge 1110.

Figure 16C:
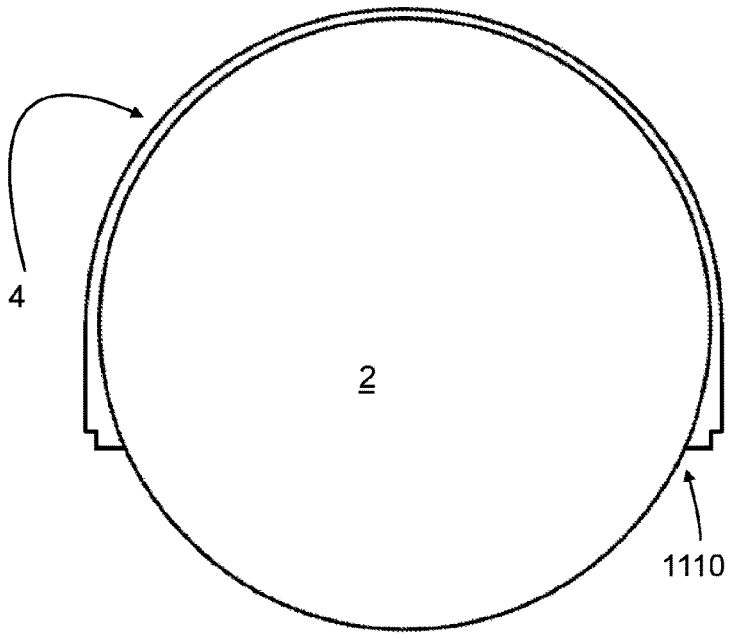
FIG. 16C is a top view of an embodiment of a rotatable disc-shaped shelf coupled to the top of a support bracket having a recessed edge.
Figure 16D:
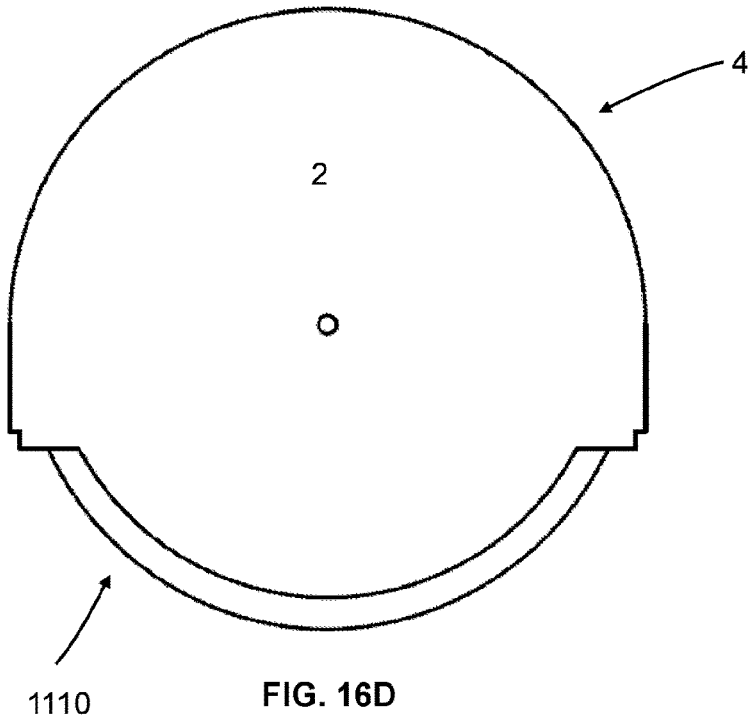
FIG. 16D is a bottom view of the bottom side of an embodiment of a rotatable disc-shaped shelf coupled to the top of a support bracket having a recessed edge.
Figure 16E:
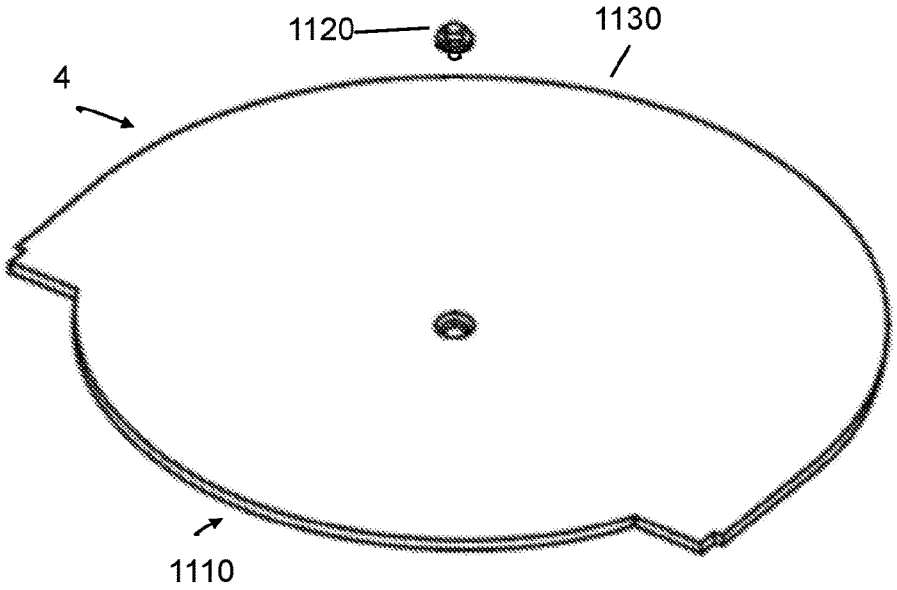
FIG. 16E is an isometric view of an embodiment of the support bracket displayed in FIG. 16A.

FIG. 16C is a top view of an embodiment of a rotatable disc-shaped shelf 2 coupled to the top of a support bracket 4 having a recessed edge 1110;

FIG. 16D is a bottom view of the bottom side of an embodiment of a rotatable disc-shaped shelf 2 coupled to the top of a support bracket 4 having a recessed edge 11110;

FIG. 16E is an isometric view of an embodiment of the support bracket 4 displayed in FIG. 16A. A pin 1120 is depicted, which in some embodiments has an edge which can be coupled on end with a pin receiver 1130 of support bracket 4 and also coupled on the other end with a bearing assembly. In some embodiments, pin 1120 is not only coupled with bearing assembly 3 but also coupled with a pin receiver of a turntable; in some embodiments, pin 1120 is configured to assist with keeping turntable 2 concentric or relatively concentric with support bracket 4 while turntable 2 is being rotated and subjected to centrifugal forces.

Figure 17A:
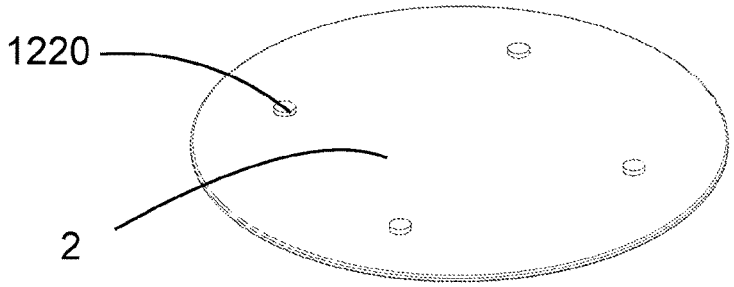
FIG. 17A is a bottom perspective view of a diagram of a rotatable shelf with a retaining member that consists of four parts.
Figure 17B:
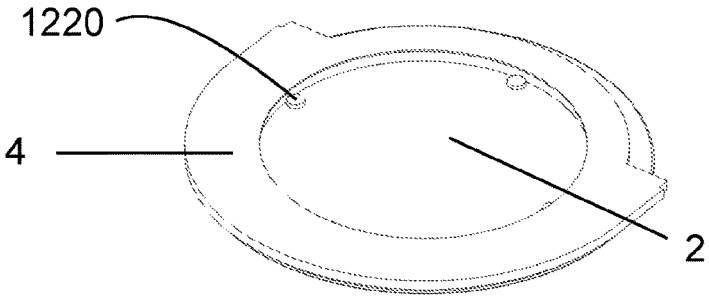
FIG. 17B is a bottom perspective view of the embodiment of FIG. 44A and a support bracket.

FIG. 17A is a bottom perspective view of a diagram of a rotatable shelf with a retaining member that comprises four of retaining member portion 1220, which may be button-shaped or be column-shaped; retaining member 1170, 22 in some embodiments is a ring of extruded material; in other embodiments retaining member 1170 is 3 of retaining member portions 1220 that are button-shaped and are between 10% and 200% of the height of bearing assembly 3; retaining member 1170 is configured to limit the sliding of bearing assembly so that bearing assembly and/or turntable 2 maintain relatively concentric with support bracket 4;

FIG. 17B is a bottom perspective view of the embodiment of FIG. 44A and a support bracket; support bracket 4 is partly ring-shaped, and the ring-shaped section is configured to snugly surround retaining member portions 1220 or retaining member 1170 which may be ring-shaped. Bearing assembly 3 may be inserted into an inset of support bracket (not shown in FIG. 17B).

Figure 17C:
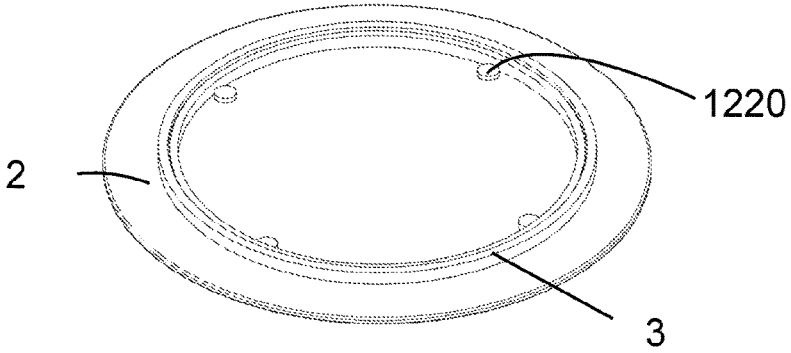
FIG. 17C is a bottom perspective view of the embodiment of FIG. 44B with a bearing assembly.

FIG. 17C is a bottom perspective view of the embodiment of FIG. 44B with a bearing assembly; bearing assembly 3 may be inserted into an inset of support bracket.

Figure 18A:
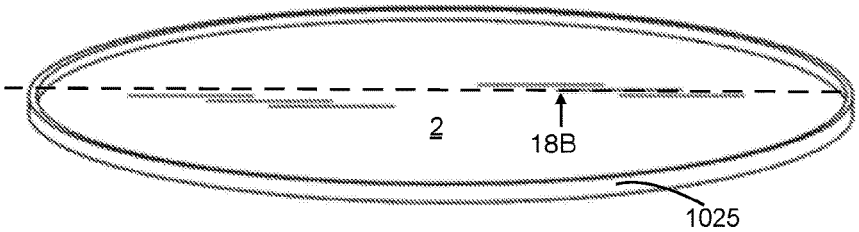
FIG. 18A is a diagram of a perspective view of an embodiment of a rotatable disc-shaped shelf, which includes a lip.
Figure 18B:
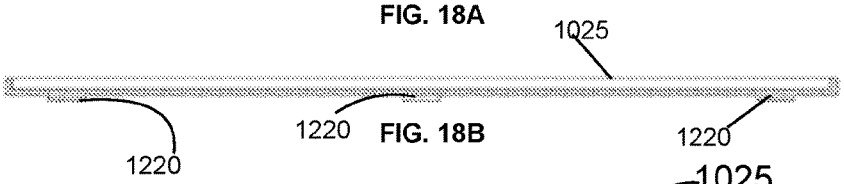
FIG. 18B is a cross-sectional view, from a side perspective, of a rotatable disc-shaped shelf such as the one shown in FIG. 18A, which includes a lip.

FIG. 18A is a diagram of a perspective view of an embodiment of a rotatable disc-shaped shelf, which includes a lip 1025, which is shown in FIGS. 18A, 18B, 19A, 19B, 20A and 20B. Lip 1025 in some embodiments completely surrounds the perimeter and may be coupled to the top surface or outer edge of the circumference portion of turntable 2; circumference portion is ring-shaped and is at or on the circumference of turntable 2. A plurality of retaining member portion 1220 are depicted in FIGS. 18A, 18B, 19A, 19B, 20A and 20B; see FIGS. 17A and 17B descriptions. FIG. 18B is a cross-sectional view, from a side perspective, of a rotatable disc-shaped shelf such as the one shown in FIG. 18A, which includes a lip; in FIG. 18A, lip 1025 forms a 90 degree or substantially 90 degree angle with the top surface of turntable 2.

Figure 19A:
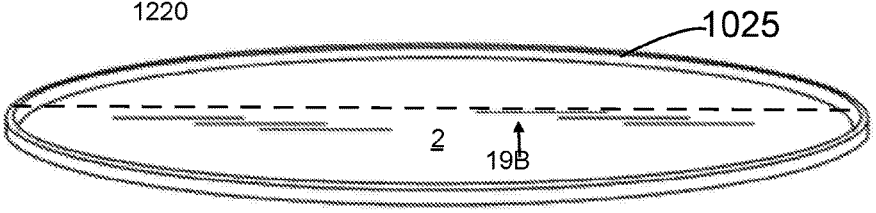
FIG. 19A is a diagram of a perspective view of an embodiment of a rotatable disc-shaped shelf, which includes a lip.

FIG. 19A is a diagram of a perspective view of an embodiment of a rotatable disc-shaped shelf, which includes a lip.

Figure 19B:
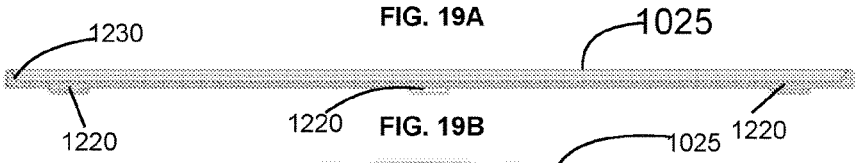
FIG. 19B is a cross-sectional view, from a side perspective, of a rotatable disc-shaped shelf such as the one shown in FIG. 19A, which includes a lip.

FIG. 19B is a cross-sectional view, from a side perspective, of a rotatable disc-shaped shelf such as the one shown in FIG. 19A, which includes a lip and a chamfered edge 1230 which is an edge with a chamfer.

Figure 20A:
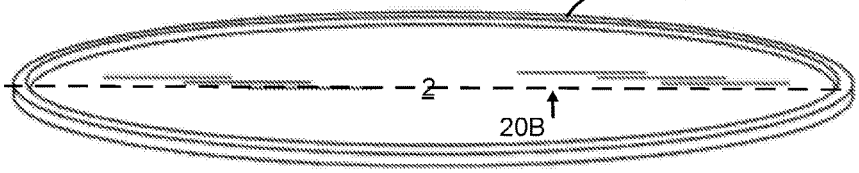
FIG. 20A is a diagram of a perspective view of an embodiment of a rotatable disc-shaped shelf, which includes a lip.

FIG. 20A is a diagram of a perspective view of an embodiment of a rotatable disc-shaped shelf, which includes a lip.

Figure 20B:
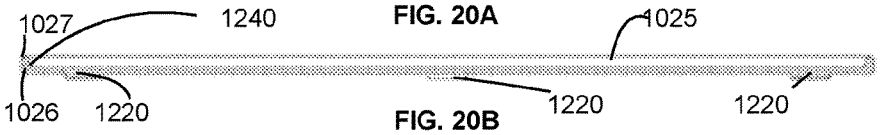
FIG. 20B is a cross-sectional view, from a side perspective, of an embodiment of a rotatable disc-shaped shelf such as the one shown in FIG. 20A, which includes a lip.

FIG. 20B is a cross-sectional view, from a side perspective, of an embodiment of a rotatable disc-shaped shelf such as the one shown in FIG. 20A, which includes a lip and a filleted edge 1240.

Figure 21A:
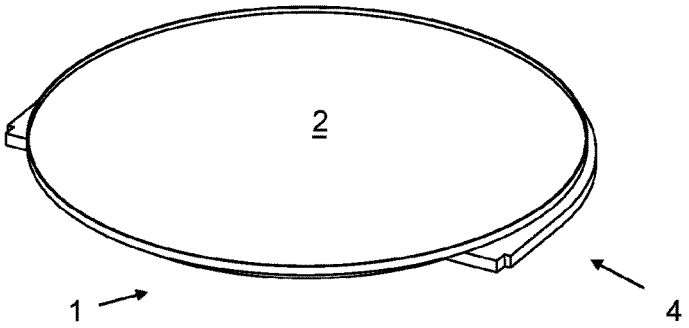
FIG. 21A is a perspective view, from a top perspective, of an embodiment of a rotatable disc-shaped shelf assembly.

FIG. 21A is a perspective view, from a top perspective, of an embodiment of a rotatable disc-shaped shelf assembly 1; turntable 2 is positioned above support bracket 4; bearing assembly 3 is ring-shaped and is sandwiched between turntable 2 and support bracket 4.

Figure 21B:
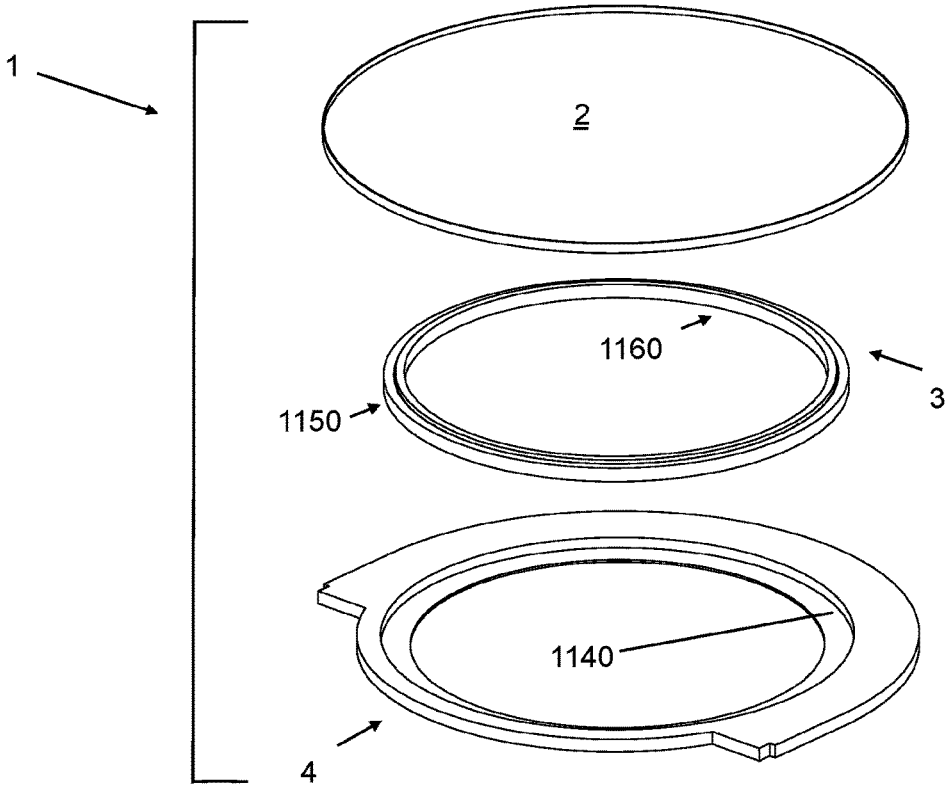
FIG. 21B is an exploded view of the embodiment shown in FIG. 21A.

FIG. 21B is an exploded view of the embodiment shown in FIG. 21A; as discussed in FIG. 21A description, bearing assembly 3 is ring-shaped comprising an outer ring and an inner ring; bearings, such as ball bearings, are located between the two rings of the bearing assembly; bearing holders are that portion of the bearing assemblies which are in physical contact with the bearings; a bearing holder may consist of two halves—the inner ring of the bearing assembly may contain a bearing holder which is in physical contact with the portion of the bearing which is facing the inner bearing ring and a second bearing holder may be in physical contact with the portion of the bearing which is facing the outer ring of the bearing assembly. The bearing holder of the inner ring and the bearing holder of the outer ring form a bearing groove which allows a bearing to be located between the two bearing holders, for the bearing to rotate with minimal friction between the bearing and the bearing holders; in the preferred embodiments, the bearing assembly has at least three bearing holders and at least three bearings. In the preferred embodiments, a bearing holder is matched 1:1 with a bearing; however, in some preferred embodiments a bearing assembly may comprise over 20 bearing holder and over 20 bearings. In FIG. 21B, the inner ring of the bearing assembly is elevated with respect to the outer ring of the bearing assembly, and the support bracket comprises a groove 1140. The depicted bearing assembly is configured to rest or nest inside groove 1140

The configuration of the inner ring is of the bearing assembly is such that a turntable can be placed in physical contact with the inner bearing ring and the outer bearing ring can be placed in physical contact with the groove 1140 of the support bracket 4. This configuration allows turntable 2 and the inner ring of the bearing assembly to be rotated in unison and with respect to the outer ring of the bearing assembly. In the most preferred embodiments groove 1140 is circular and is an indentation in support bracket 4. The depth of support bracket 4 may be optimized by being nearly the same height as the bearing assembly but in the most preferred embodiments is less than the height of the bearing assembly to allow the bearing assembly to protrude above the surface of support bracket 4, which provides for a resting place for turntable 2. In some embodiments, groove 1140 may comprise additional grooves which may be configured to mate with protrusions on the bearing assembly.

Figure 21C:
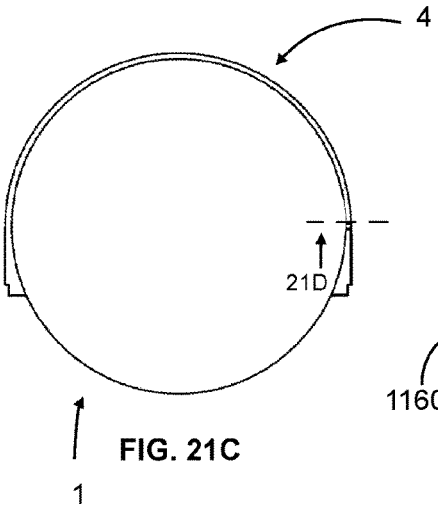
FIG. 21C is a top view of an embodiment of a rotatable disc-shaped assembly as shown in FIG. 21A.
Figure 21D:
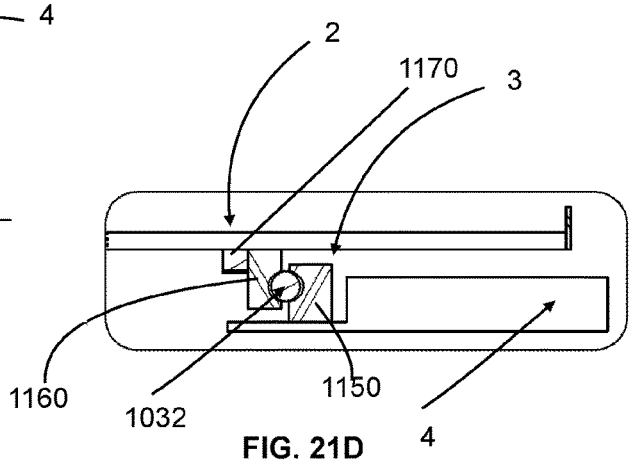
FIG. 21D is a cross sectional view of an embodiment of a rotatable disc-shaped assembly as shown in FIG. 21C.

FIG. 21C is a top view of an embodiment of a rotatable disc-shaped assembly 1 as shown in FIG. 21A, including a support bracket 4; and FIG. 21D is a cross sectional view of an embodiment of a rotatable disc-shaped assembly as shown in FIG. 21C; turntable 2 rests upon a bearing assembly 3 which comprises an outer ring 1150 and an inner ring 1160. Bearing 1032 is nested between outer ring 1150 and an inner ring 1160. In this embodiment outer ring 1150 rests upon support bracket 4. The bearing assembly in this embodiment is ring-shaped and has a plurality of bearing 1032; in this embodiment at least 10 bearing 1032. Retaining member 1170 is extruded from turntable 2 or attached to turntable 2 and is configured to maintain the concentricity of bearing assembly 3 with turntable 2. See earlier descriptions of retaining member 1170 for its function.

Figure 22A:
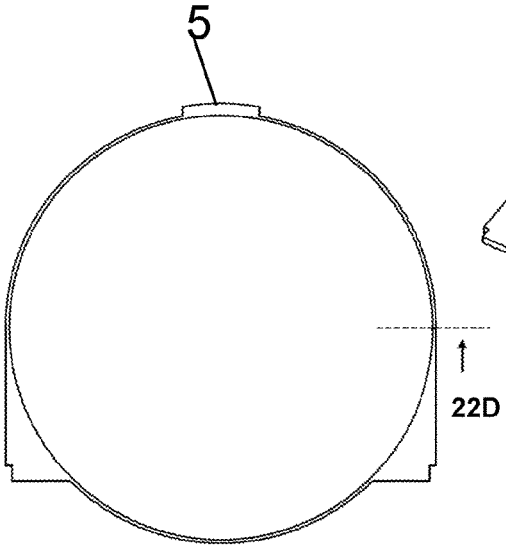
FIG. 22A is a top view of an embodiment of a rotatable shelf assembly.

FIG. 22A is a top view of an embodiment of a rotatable shelf assembly; see the description of FIG. 21A; additionally, support flange 5 of support bracket 4 is configured to be received by a recessed bracket support. FIG. 22A is similar to FIG. 21A; see the FIG. 21A description.

Figure 22B:
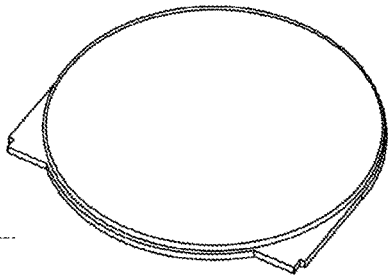
FIG. 22B is an isometric view of an embodiment of the rotatable shelf assembly shown in FIG. 22A.

FIG. 22B is an isometric view of an embodiment of the rotatable shelf assembly shown in FIG. 22A.

Figure 22D:
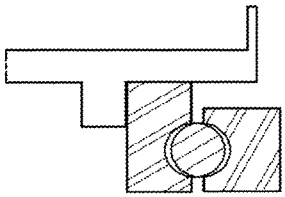
FIG. 22D is a cross-sectional view of the rotatable shelf assembly of FIG. 22A showing a bearing assembly coupled to the bottom side of a rotatable disc-shaped shelf (the support bracket is not depicted in this view).
Figure 22C:
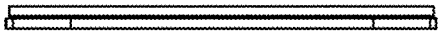
FIG. 22C is a side perspective view of an embodiment of the rotatable shelf assembly shown in FIG. 22A, from the perspective of the front of the rotatable shelf assembly shown in FIG. 22A; the front is the part where the disc-shaped shelf overhangs the support bracket.

FIG. 22C is a side perspective view of an embodiment of the rotatable shelf assembly shown in FIG. 22A, from the perspective of the front of the rotatable shelf assembly shown in FIG. 22A; the front is the part where the disc-shaped shelf overhangs the support bracket;

FIG. 22D is a cross-sectional view of the rotatable shelf assembly of FIG. 22A showing a bearing assembly coupled to the bottom side of a rotatable disc-shaped shelf (the inner surface of the support bracket 4 is depicted in this view as the outer bearing holder which is located directly to the right of the depicted bearing). Bearing 1032 is sandwiched between inner ring 1160 and outer ring 1150 of bearing assembly 3, which is ring-shaped. As described elsewhere the portion of inner bearing ring that physically contacts the bearing is an inner bearing holder (which is part of a bearing holder) and the portion of outer bearing ring that physically contacts the bearing is an outer bearing ring holder (which is part of the bearing holder).

Figure 22E:
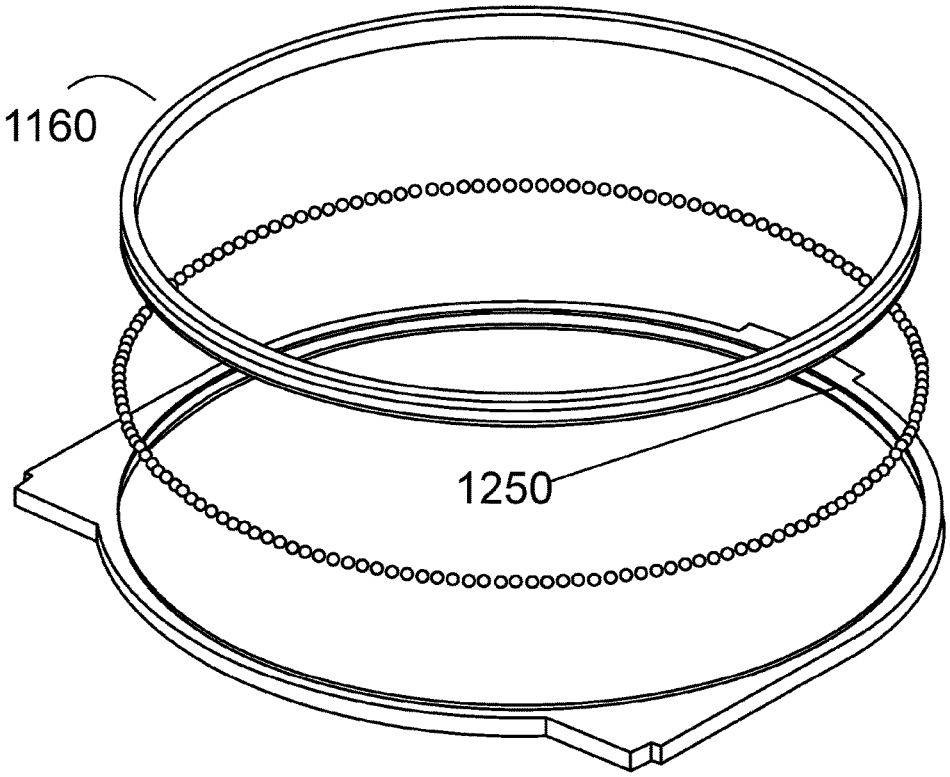
FIG. 22E shows an exploded view of the embodiment of FIG. 22A.

FIG. 22E depicts the inner surface of support bracket 4; inner surface 1250 is ring-shaped in this embodiment and extends along the support bracket 4. Inner surface 1250 serves to function as the outer ring 1150 of FIG. 21D.

FIG. 23A is a top perspective view of an embodiment of a bearing assembly wherein the outer ring is elevated with respect to the inner ring (in some embodiments neither ring is elevated with respect to the other); FIG. 23 descriptions see FIG. 21 which is similar to FIG. 21 unless noted.

Figure 23F:
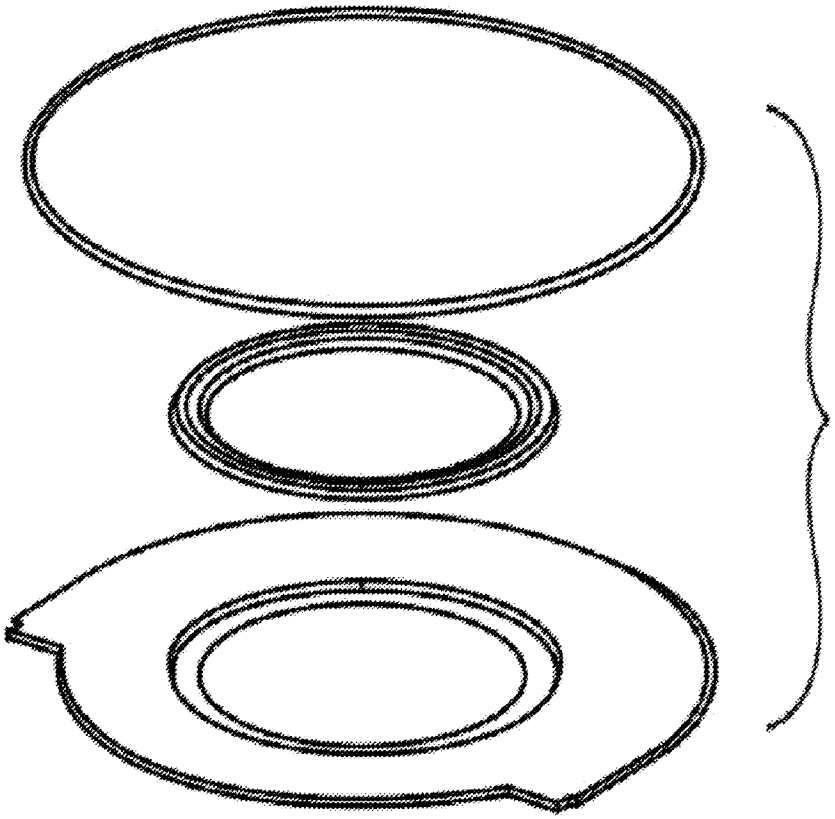
FIG. 23F is an exploded view of a bearing assembly.

FIG. 23B is a an enlarged top perspective view of a portion of the embodiment of the bearing assembly depicted in FIG. 23A; a plurality of bearings are visible and are sandwiched by an inner bearing ring and an outer bearing ring;

FIG. 23C is a side view of an embodiment of the bearing assembly depicted in FIG. 23A;

FIG. 23D is a cross-sectional view of an embodiment of the bearing assembly depicted in FIG. 23A;

FIG. 23E is an isometric view of an embodiment of the bearing assembly depicted in FIG. 23A; FIG. 23F is an exploded view of a bearing assembly.

Figure 24A:
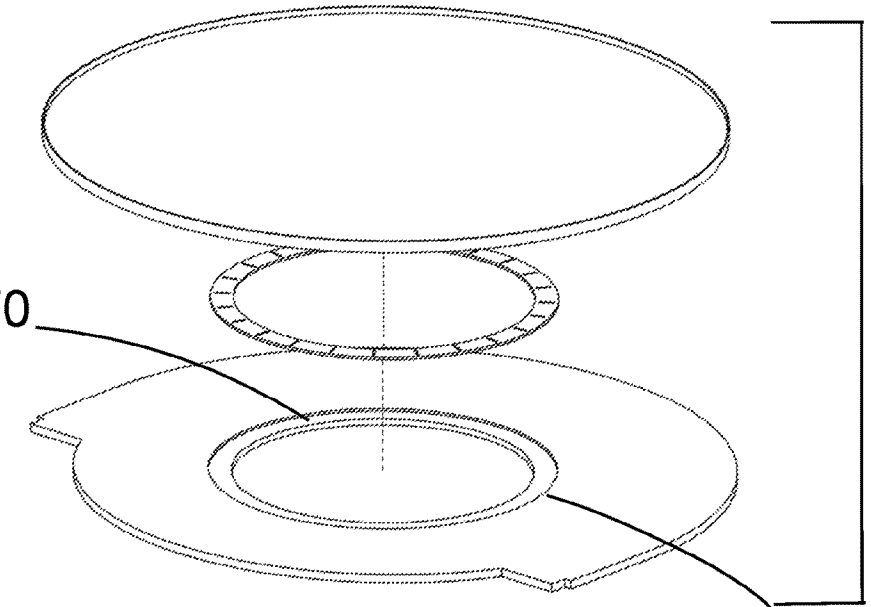
FIG. 24A is an exploded view of an isometric view of an embodiment of a rotatable shelf assembly comprising an embodiment of a rotatable shelf, an embodiment of a bearing assembly, and an embodiment of a support bracket having a groove.
Figure 24C:
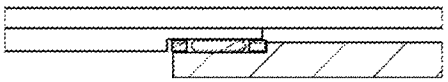
FIG. 24C is a cross-sectional view of the embodiment depicted in FIG. 24B.
Figure 24B:
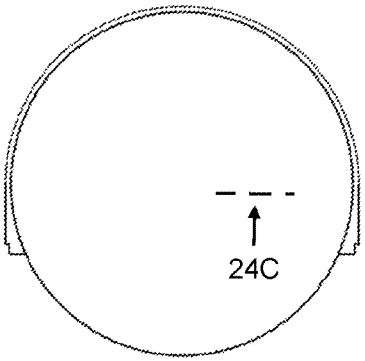
FIG. 24B is a top view perspective diagram of the embodiment depicted in FIG. 24A when the embodiment is not depicted in an exploded view.
Figure 24D:
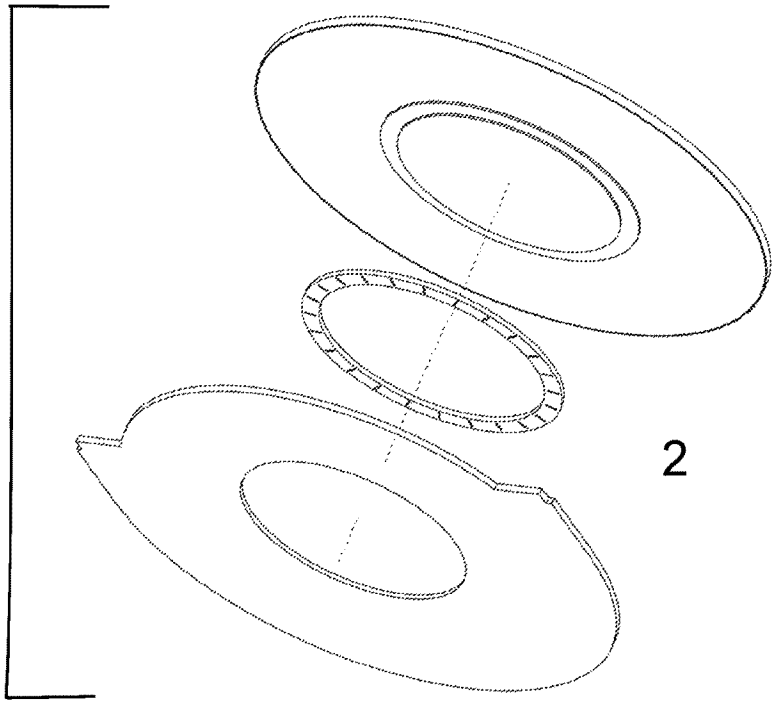
FIG. 24D is an isometric, exploded view from the bottom perspective of the embodiment depicted in FIG. 24A.

FIG. 24A is an exploded view of an isometric view of an embodiment of a rotatable shelf assembly comprising an embodiment of a rotatable shelf, an embodiment of a bearing assembly, and an embodiment of a support bracket having a groove or inset in the center of the support bracket 4 and is configured to receive a bearing assembly. In some embodiments the inset has circular retaining member 1170. An outer retaining member 1170 is configured to limit the lateral movement of the outer edge of bearing assembly 3 See descriptions for FIG. 14A-C for a description of a typical bearing assembly that may be used with support bracket 4. In some embodiments bearing assembly is like the bearing assembly of FIG. 14A-C however between 1 and 10 spokes are configured to reinforce the bearing ring while the bearing ring carries a load, and in this type of embodiment support bracket 4 typically does not have an inner retaining member FIG. 24B is a top view perspective diagram of the embodiment depicted in FIG. 24A when the embodiment is not depicted in an exploded view;

FIG. 24C is a cross-sectional view of the embodiment depicted in FIG. 24B;

FIG. 24D is an isometric, exploded view from the bottom perspective of the embodiment depicted in FIG. 24A; note turntable 2 is configured with an inset 1036 (also known as a groove) which is generally in the shape of bearing assembly 3; however, in the preferred embodiments, the inner wall of inset 1036 is less than the height of bearing assembly 3. In some embodiments, the height of the inset of support bracket 4 and the height of the inset of turntable 2 when added together is near the height of the bearing assembly but in most embodiments is less than the height of the bearing assembly (when including the height of any rollers or bearings that extend beyond the body of the bearing assembly). The height (also known as the depth) of any inset may be determined such that a turntable that rests upon and is in physical contact with bearing assembly or bearings of bearing assembly which are inserted into the inset of the support bracket 4 is able to be rotated on the bearings.

FIG. 23E is an exploded view of a diagram of an embodiment of a support bracket, a plurality of bearings, and a bearing assembly that is ring-shaped as depicted in FIG. 23D.

Figure 24E:
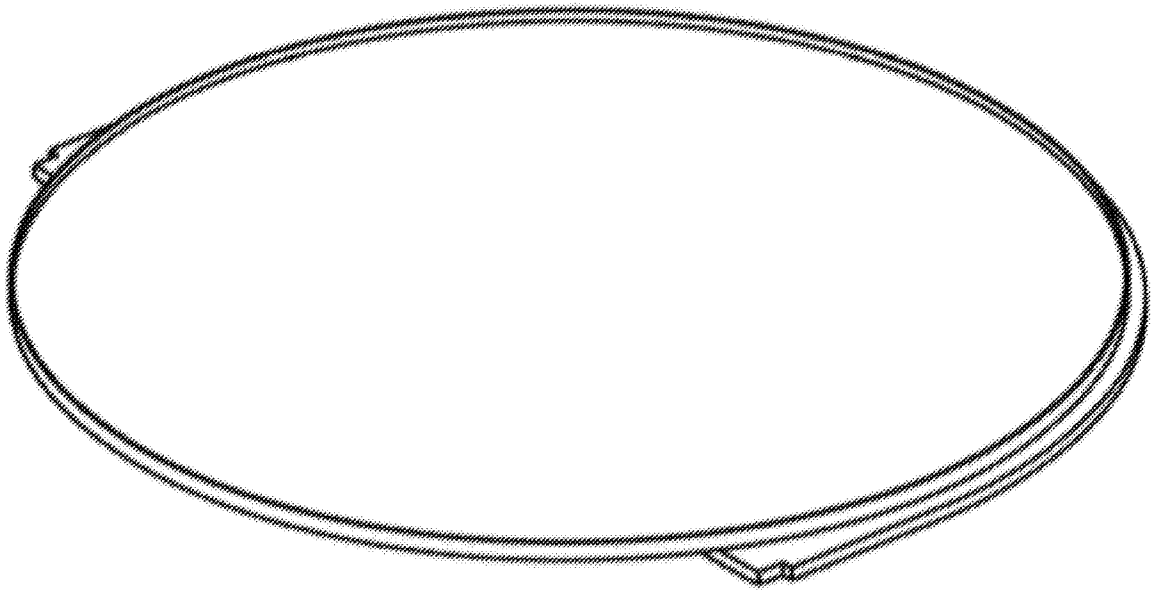
FIG. 24E is an isometric view of the assembled embodiment depicted in FIG. 24B.

FIG. 24E is an isometric view of the assembled embodiment depicted in FIG. 24B. Turntable which rests on top of a support bracket is rotatable on a bearing assembly inserted into an inset of the turntable and an inset of the support bracket; the bearing assembly and insets are not visible in this diagram.

Figure 25A:
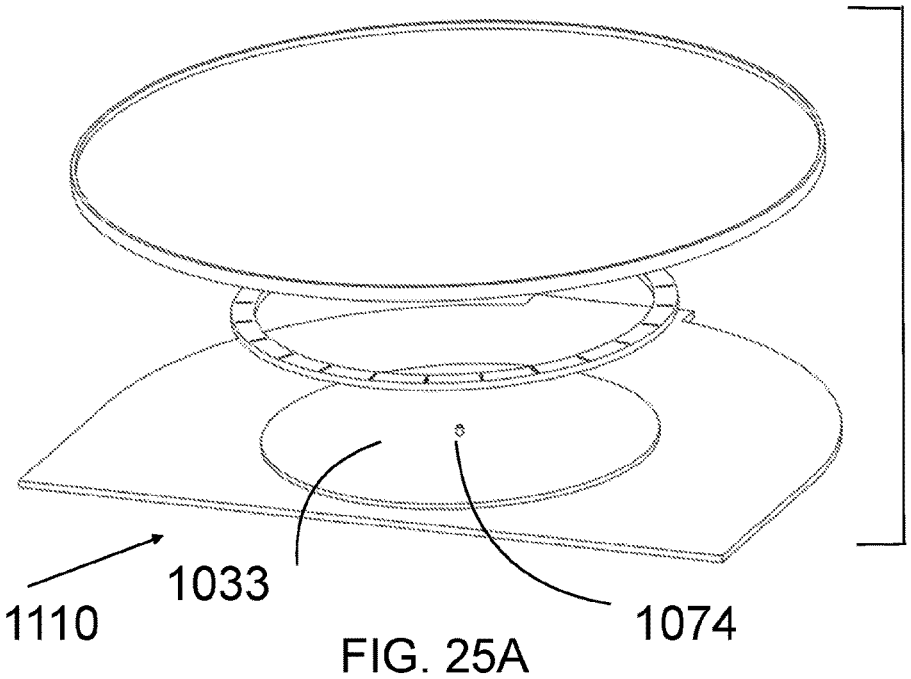
FIG. 25A is an isometric perspective view of a diagram showing an exploded view of a rotatable shelf assembly.

FIG. 25A is an isometric perspective view of a diagram showing an exploded view of a rotatable shelf assembly; as discussed earlier, support bracket 4 has a recessed edge 1033 which is configured so that a portion of turntable overhangs support bracket 4; the distance dimension of recessed edge 1110, that is the distance that the recessed edge is shorter when compared to a comparable support bracket 4, is generally at least ⅛ inch and in the preferred embodiments is between ¼ inch and 6 inches. In some embodiments that distance may be up to feet. In other embodiments the that distance is at least a suitable distance that is greater than a typical adult male thumb but not so large of a distance and so large of a recessed area such that support bracket 4 is unstable and has a significantly increased likelihood from slipping off any support and causing spillage of items on turntable 2 that may be resting on support bracket 4. Retaining member may be of extruded disc-shaped and configured to limit the bearing assembly and/or the turntable from not being concentric with the support bracket.

Figure 26A:
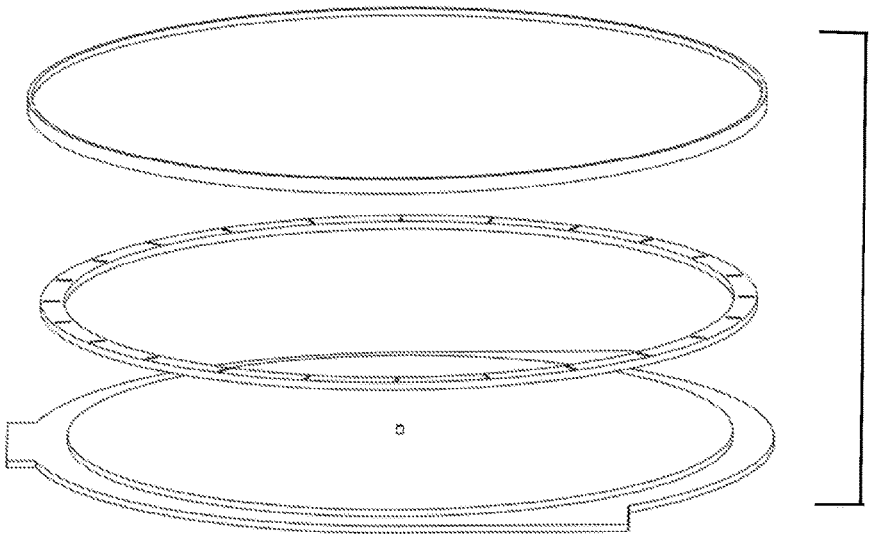
FIG. 26A is an isometric perspective view of a diagram showing an exploded view of a rotatable shelf assembly.

FIG. 26A is an isometric perspective view of a diagram showing an exploded view of a rotatable shelf assembly; support bracket 4 has a recessed edge which is circular in shape and resides near the front of the support bracket (and will be near the front of the refrigerator compartment when installed into an embodiment of disclosed refrigerators). The retaining member of support bracket 4 may be an extruded disc shaped member which retains the bearing assembly and limits lateral movement of the bearing assembly; a pin in the center of the retaining member may be insertable into pinhole located on the bottom side of turntable (not show in this diagram) as to assist in keeping the turntable concentric with the support bracket.

Figure 27A:
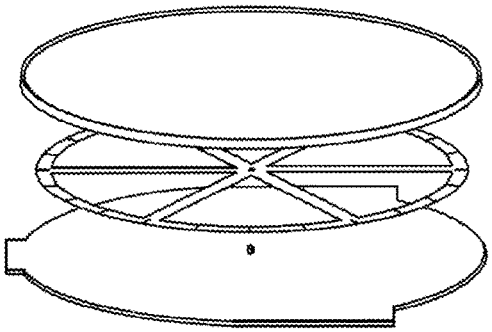
FIG. 27A is an isometric perspective view of a diagram showing an exploded view of a rotatable shelf assembly.
Figure 27B:
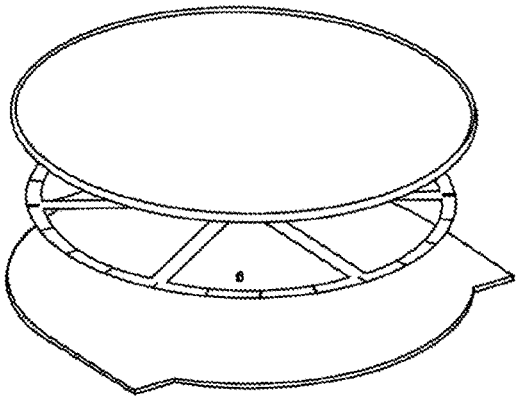
FIG. 27B is an isometric perspective view of a diagram showing an exploded view of a rotatable shelf assembly.
Figure 27C:
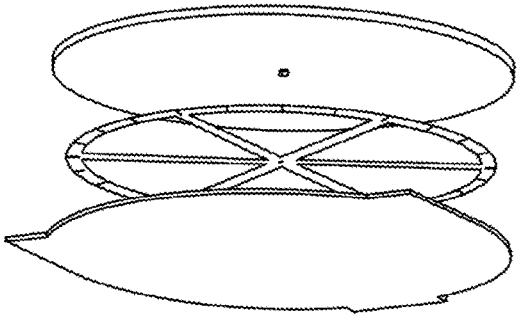
FIG. 27C is an isometric perspective view of a diagram showing an exploded view of a rotatable shelf assembly.

FIG. 27A is an isometric perspective view of a diagram showing an exploded view of a rotatable shelf assembly; a pin located at the center of the support bracket is visible;

FIG. 27B is an isometric perspective view of a diagram showing an exploded view of a rotatable shelf assembly; as discussed earlier, the bearing assembly has spokes;

FIG. 27C is an isometric perspective view of a diagram showing an exploded view of a rotatable shelf assembly; in this embodiment an inset is not included because pin (not visible) is insertable into a pinhole located on the bottom side of turntable. Bearing assembly has a pinhole at its center for the pin. Pin may be threaded like a screw and pinholes may or may not be configured to receive a threaded object or have other mechanisms such as magnets to keep the pin engaged with a pinhole.

Figure 27D:
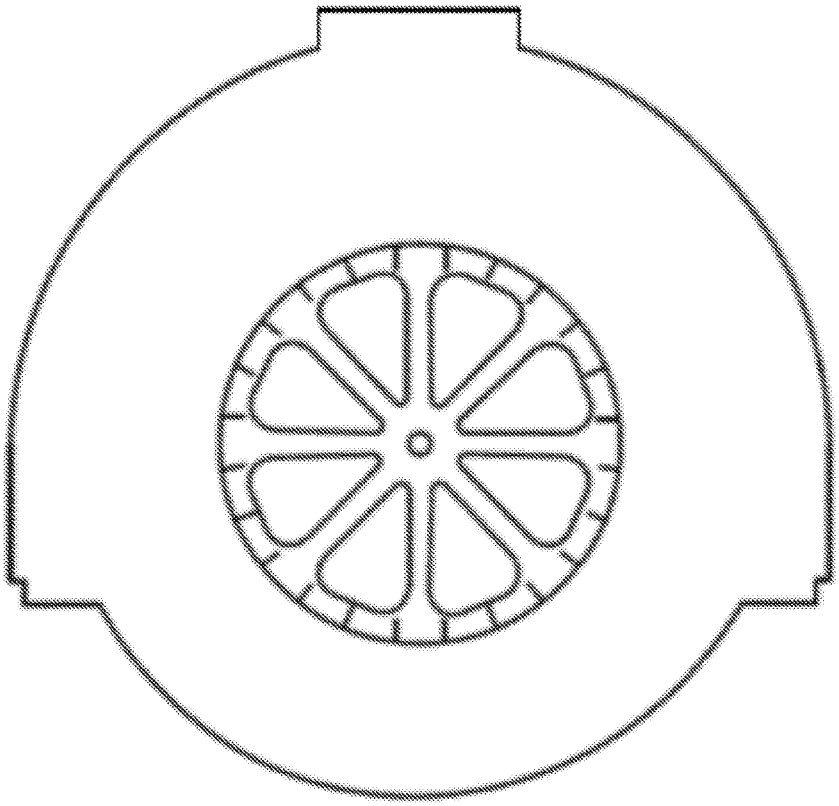
FIG. 27D is a top view perspective of the embodiment depicted in FIG. 27C, except that the rotatable shelf is not depicted.

FIG. 27D is a top view perspective of the embodiment depicted in FIG. 27C, except that the rotatable shelf is not depicted; pinhole of bearing assembly is depicted and approximately 24 roller bearings are depicted near the perimeter of bearing assembly.

Figure 28A:
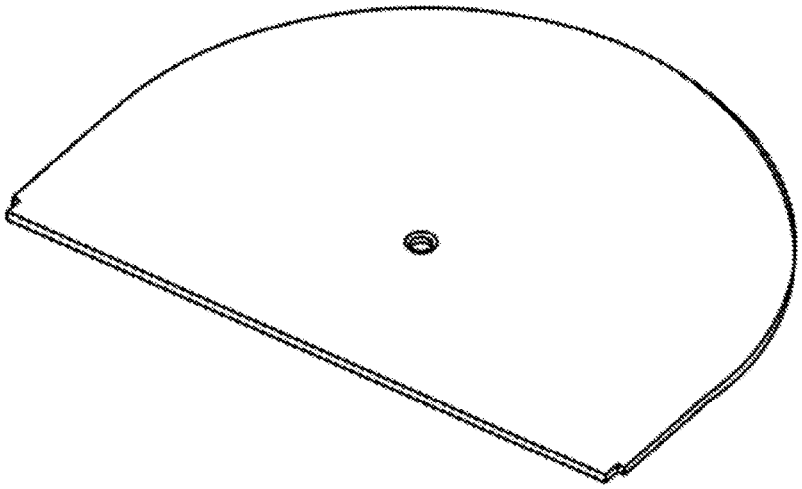
FIG. 28A is an isometric view of an embodiment of a support bracket.
Figure 28B:
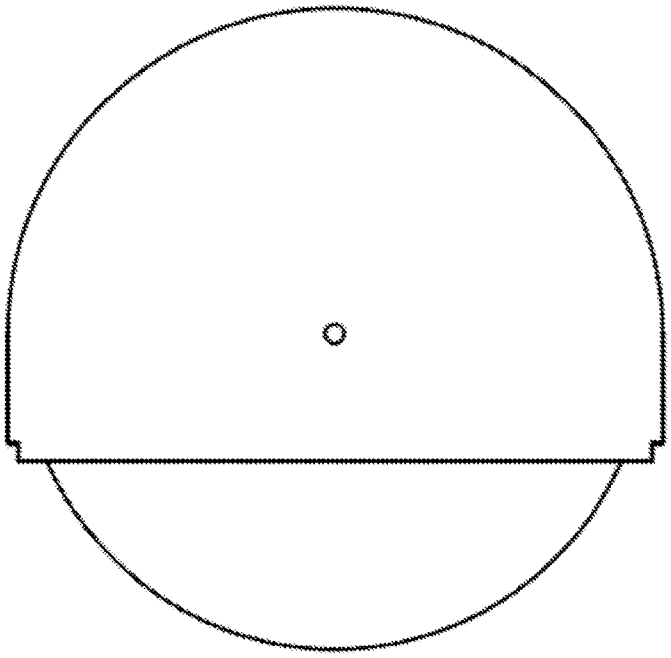
FIG. 28B is a bottom perspective view of a rotatable shelf assembly consisting of the support bracket depicted in FIG. 28A, a bearing assembly (not visible), and a rotatable shelf.

FIG. 28A is an isometric view of an embodiment of a support bracket having a straight recessed edge; other embodiments contemplate other configurations of recessed edges which do not pose a danger to operators of the rotatable disc shelves;

FIG. 28B is a bottom perspective view of a rotatable shelf assembly consisting of the support bracket depicted in FIG. 28A, a bearing assembly (not visible), and a rotatable shelf; support bracket 4 has a notch on each side which is configured to mate with a vertical pilaster or bracket as described elsewhere and limit the horizontal of the support bracket when installed.

Figure 29A:
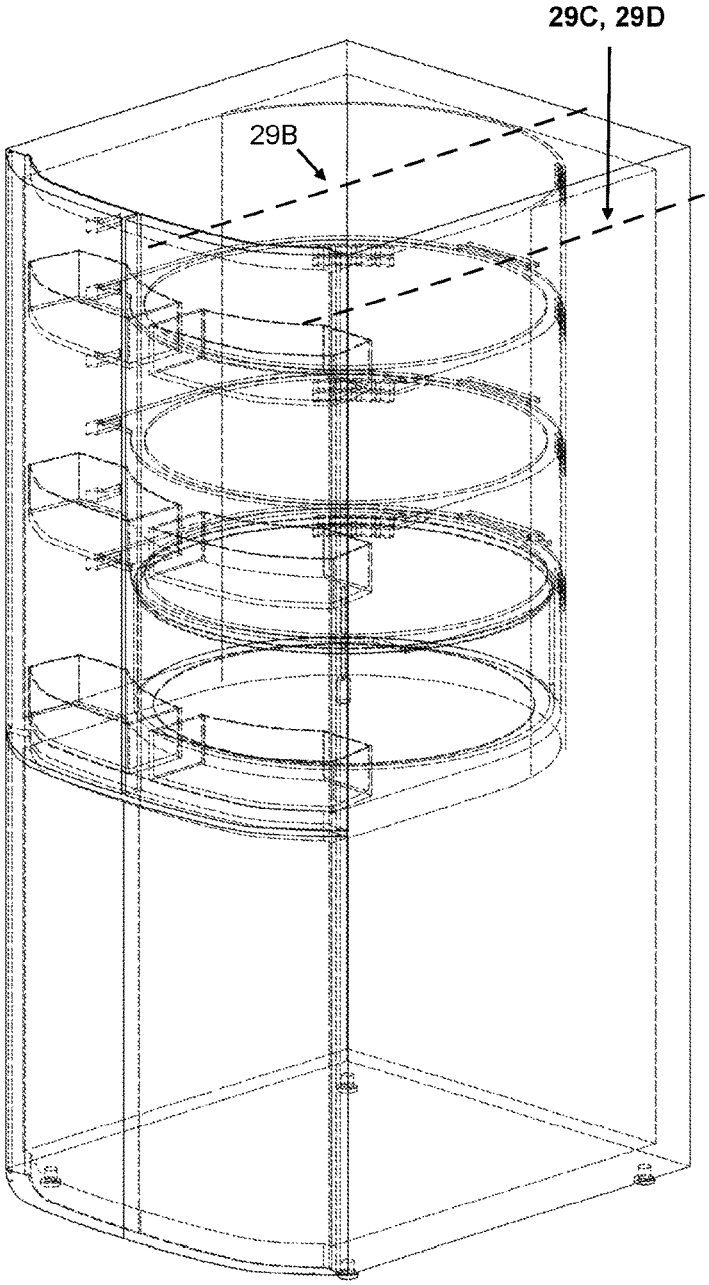
FIG. 29A is a depiction of a refrigerator comprising the following shown in broken lines: embodiments of a first upper shelf assembly, a second middle shelf assembly, and a bottom rotatable shelf assembly also known as a rotatable crisper drawer assembly; contoured door shelves; and a set of French-style doors.

FIG. 29A is a depiction of a refrigerator comprising the following shown in broken lines: embodiments of a first upper shelf assembly, a second middle shelf assembly, and a bottom rotatable shelf assembly also known as a rotatable crisper drawer assembly; 6 contoured door shelves; and a set of French-style doors.

Figure 29B:
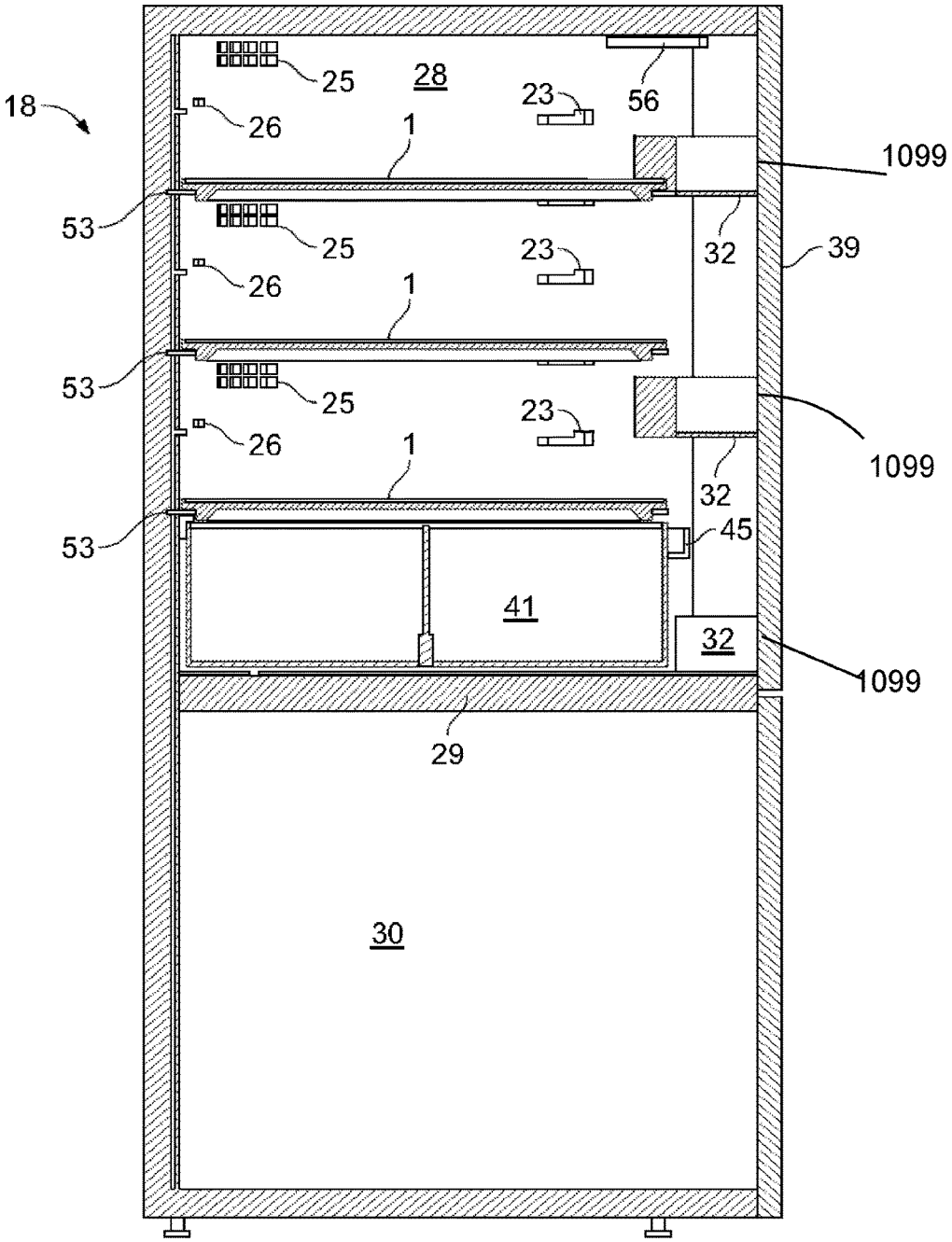
FIG. 29B is a side cross sectional view of the embodiments of the rotatable shelf assembly and door shelves depicted in FIG. 29A.
Figure 29C:
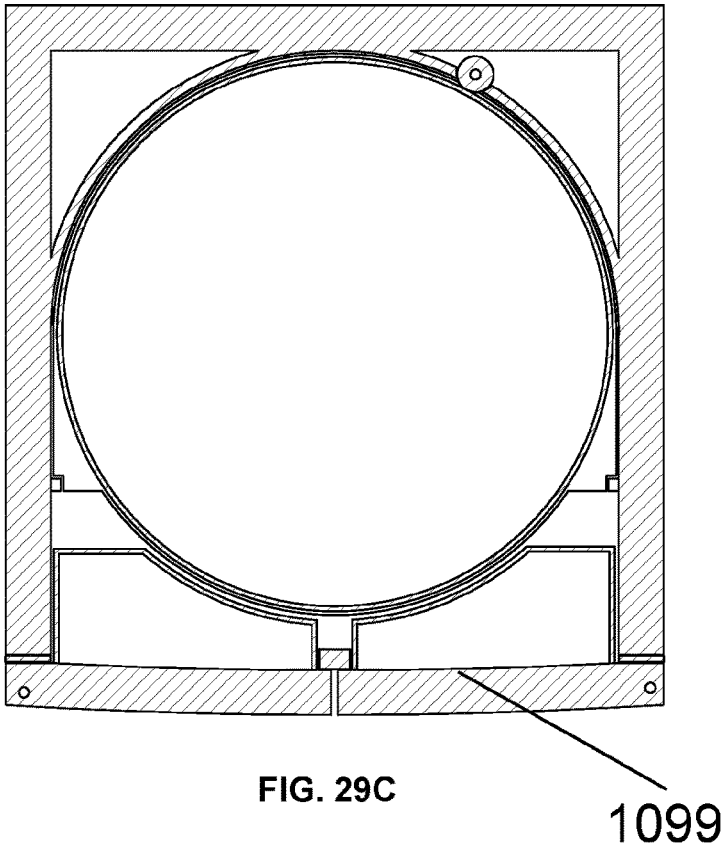
FIG. 29C is a diagram of a cross-sectional view with a cross section taken from a refrigerator such as the one shown in FIG. 29A, from a top perspective, of an embodiment of a refrigerator with a plurality of rotatable shelf assemblies and contoured door shelves installed therein.
Figure 29D:
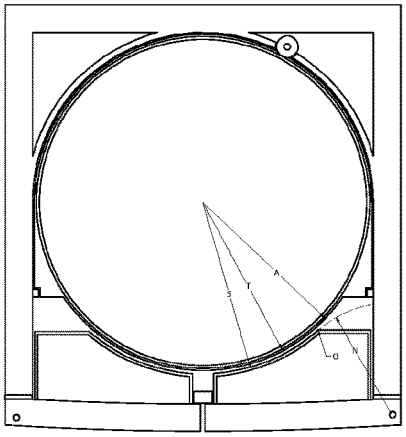
FIG. 29D is a diagram of a cross-sectional view with a cross section taken from a refrigerator such as the one shown in FIG. 29A, from a top perspective, of an embodiment of a refrigerator with a plurality of rotatable shelf assemblies and contoured door shelves installed therein.

FIG. 29B is a side cross sectional view of the embodiments of the rotatable shelf assembly and door shelves depicted in FIG. 29A; see Figure descriptions for 1A and 15D with the exception that FIG. 29B depicts door shelves that are shaped as depicted in FIG. 29C and FIG. 29D; elements are identical to the numbered elements of FIG. 15C with the notable exception that the distal edge of the back wall of the shelf (which is nearer to the turntable when compared with position of the front edge 1099 of the shelf) is relatively straight and perpendicular or substantially perpendicular with the nearest side interior wall of the refrigerator; the distal edge depicted in the FIG. 29 series of diagrams is not defined by the arc of a radius with a beginning point at the nearest door hinge point. The distance from the distal edge to the front edge 1099 of the shelf is sufficient in preferred embodiments as to fit a standard milk jug.

FIG. 29C is a diagram of a cross-sectional view with a cross section taken from a refrigerator such as the one shown in FIG. 29A, from a top perspective, of an embodiment of a refrigerator with a plurality of rotatable shelf assemblies and contoured door shelves installed therein;

FIG. 29D is a diagram of a cross-sectional view with a cross section taken from a refrigerator such as the one shown in FIG. 29A, from a top perspective, of an embodiment of a refrigerator with a plurality of rotatable shelf assemblies and contoured door shelves installed therein; see description for FIG. 15E with the noted exception that that the distal edge of the back wall of the shelf (which is nearer to the turntable when compared with position of the front edge 1099 of the shelf) is relatively straight and perpendicular or substantially perpendicular with the nearest side interior wall of the refrigerator; the distal edge depicted in the FIG. 29 series of diagrams is not defined by the arc of a radius with a beginning point at the nearest door hinge point. The distance from the distal edge to the front edge 1099 of the shelf is sufficient in preferred embodiments as to fit a standard milk jug. (The inflection point is still defined by the tangent point or a point that is within a 20 mm radius of the tangent point for 1) an arc with a radius originating from the center of the turntable and 2) an arc with a radius originating from the hinge point for the nearest door hinge. Distal edge 1099 of the back wall of the shelf originates from the inflection point and ends at the nearest side interior wall of the refrigerator.

Figures 30A, 30B:
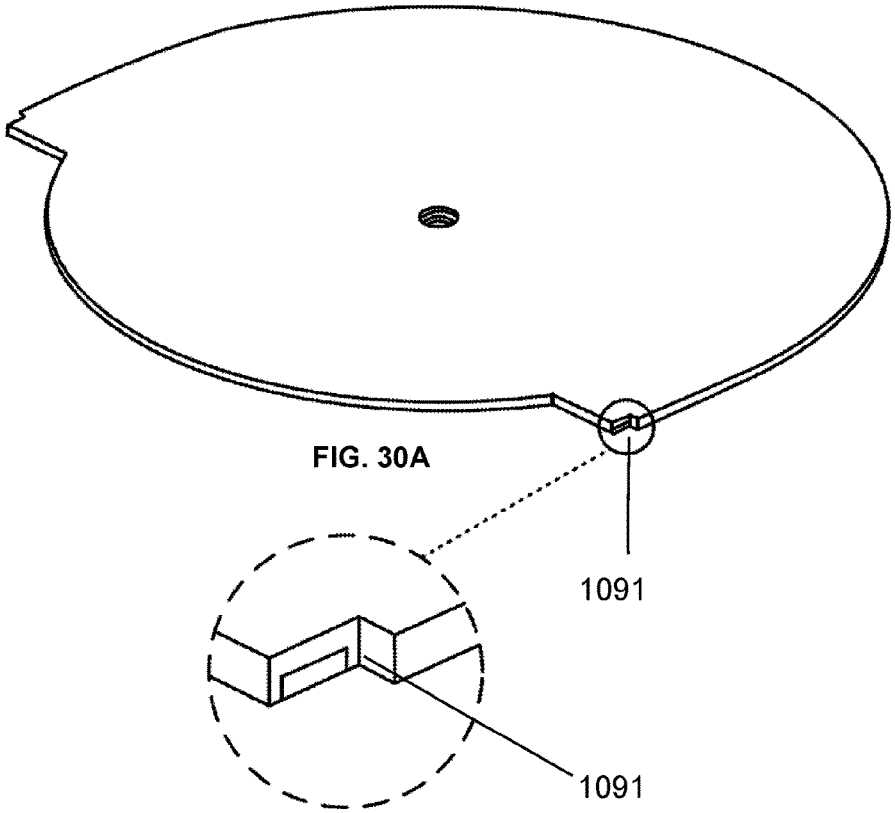
FIG. 30A is an isometric view of a diagram of an embodiment of a support bracket having a notch.
FIG. 30B is an enlarged view of an diagram of the notch depicted in FIG. 30A.

FIG. 30A is an isometric view of a diagram of an embodiment of a support bracket having a support bracket notch 1091 as described elsewhere and in FIG. 15C;

FIG. 30B is an enlarged view of an diagram of the support bracket notch 1091 depicted in FIG. 30A; support bracket notch may be of any size or shape but in preferred embodiments are rectangular shaped or shaped to mate with a bracket, vertical pilaster or other object.

Figures 30C, 30D, 30E:
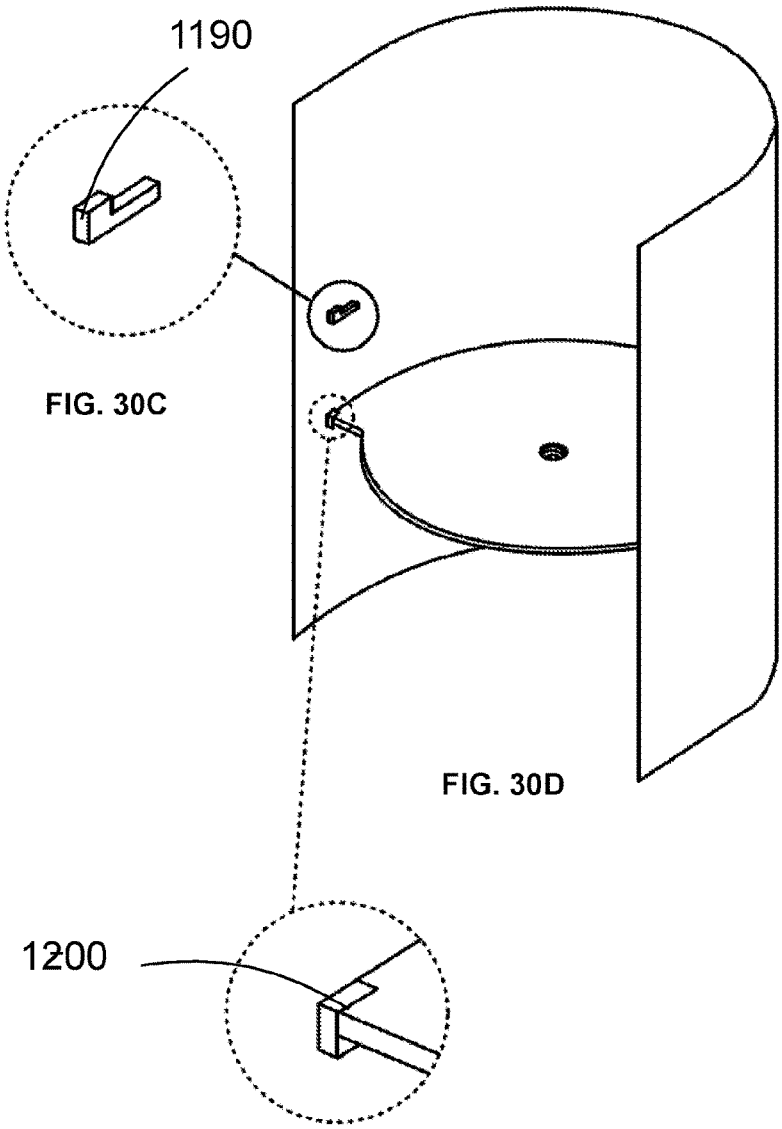
FIG. 30C is an enlarged view of a diagram of a support member for the support bracket shown in FIG. 30D.
FIG. 30D is an isometric view of an embodiment of a support bracket and an embodiment of a contoured interior wall of a refrigerator
FIG. 30E is an enlarged view of a diagram of an embodiment of a support member for an embodiment of a support bracket shown in FIG. 30D.

FIG. 30C is an enlarged view of a diagram of a support member for the support bracket shown in FIG. 30D;

FIG. 30D is an isometric view of an embodiment of a support bracket and an embodiment of a contoured interior wall of a refrigerator; the contoured interior wall may be formed by a refrigerator liner in some embodiments. An L-shaped bracket 1190 is depicted and may be configured to support a support bracket. Any type of bracket or known means of coupling an object to an interior wall of a refrigerator may be used.

FIG. 30E is an enlarged view of a diagram of an embodiment of a support member for an embodiment of a support bracket shown in FIG. 30D; a C-shaped bracket 1200 is depicted as having received a support bracket 4 and supporting support bracket 4.

Figure 30F:
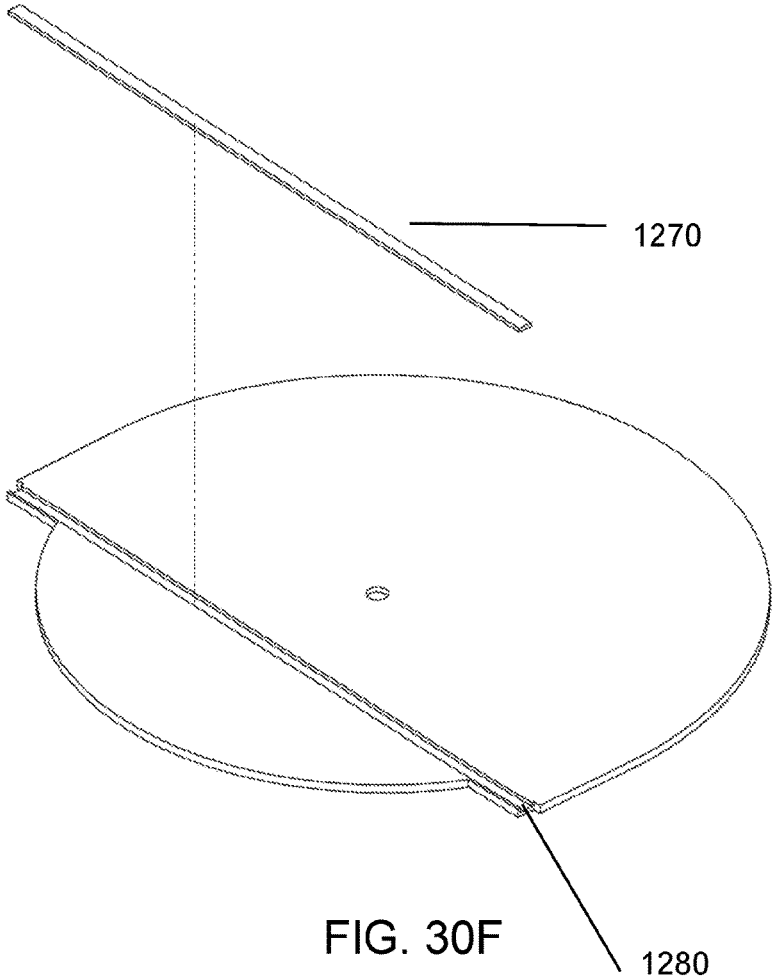
FIG. 30F is a bottom side view of the embodiment in FIG. 30A.

FIG. 30F is a bottom side view of the embodiment in FIG. 30A. A channel member 1280 in some embodiments defines a groove called a channel member groove; the size and length of the channel member groove in preferred embodiments is of sufficient dimensions to receive a reinforcement member 1270. In preferred embodiments, both reinforcement member 1270 and channel member 1280 extend along the complete length of support bracket 4. Reinforcement member 1270 may be constructed from any relatively non-fragile material such as metal or plastic.

Figure 31A:
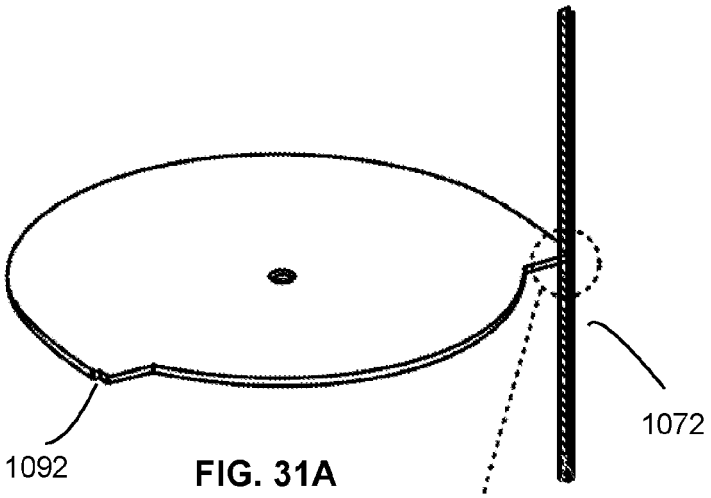
FIG. 31A is a diagram of an embodiment of a support bracket and an embodiment of a vertical pilaster.
Figure 31B:
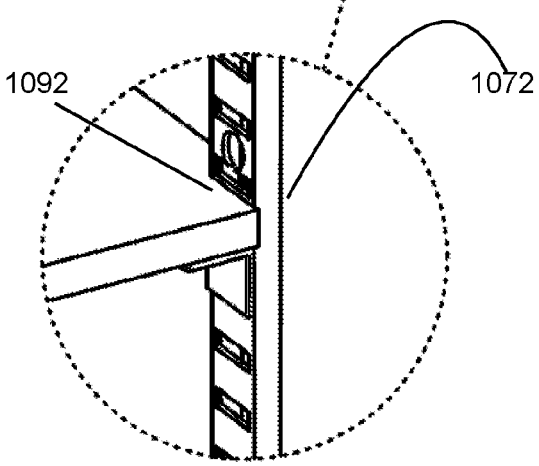
FIG. 31B is an enlarged diagram of an embodiment of a support bracket and an embodiment of a vertical pilaster.

FIG. 31A is a diagram of an embodiment of a support bracket and an embodiment of a vertical pilaster 1072;

FIG. 31B is an enlarged diagram of an embodiment of a support bracket and an embodiment of a vertical pilaster; a bracket that is L-shaped has been inserted into a groove or slot of the vertical pilaster and support bracket 4 rests upon and is coupled with mounting bracket 1180; support bracket's notch bracket 1092 is depicted having mated with vertical pilaster 1072 which is vertically aligned.

Figure 32A:
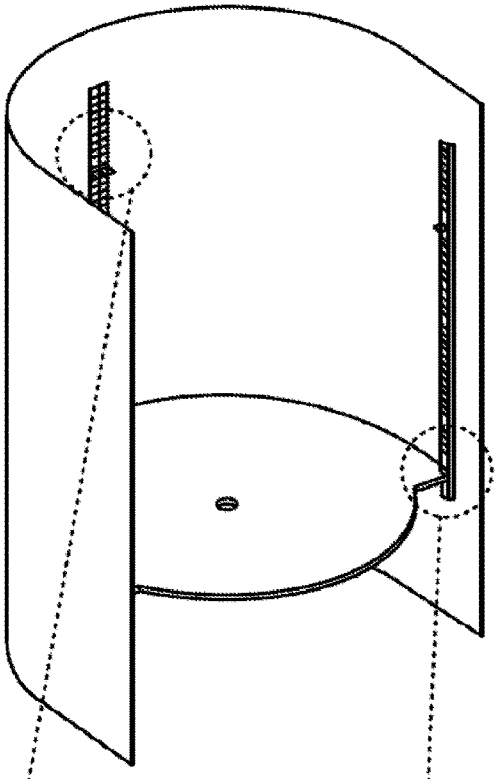
FIG. 32A depicts a support bracket with a notch that is coupled with a vertical pilaster; a refrigerator liner forms an interior back wall and contours the curved edge of the support bracket.

FIG. 32A depicts a support bracket with a notch that is coupled with a vertical pilaster; a refrigerator liner forms an interior back wall and contours the curved edge of the support bracket.

Figure 32B:
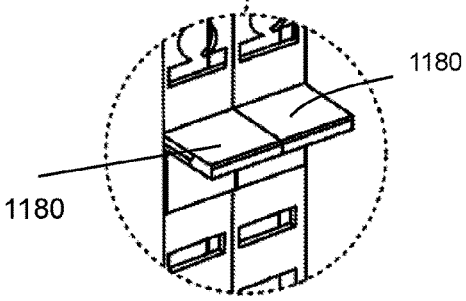
FIG. 32B is an isometric, enlarged view of an embodiment of a pair of vertical pilasters and a pair of brackets as shown in FIG. 32A

FIG. 32B is an isometric, enlarged view of an embodiment of a pair of vertical pilasters and a pair of mounting bracket 1180 as shown in FIG. 32A.

Figure 32C:
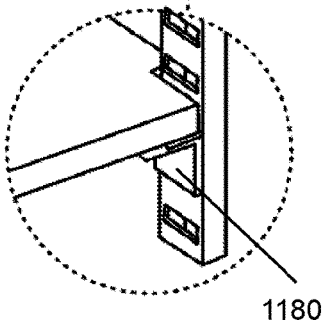
FIG. 32C is an isometric, enlarged view of an embodiment of the support bracket, bracket, and vertical pilaster depicted in FIG. 32A.

FIG. 32C is an isometric, enlarged view of an embodiment of the support bracket, bracket, and vertical pilaster depicted in FIG. 32A.

Figure 33A:
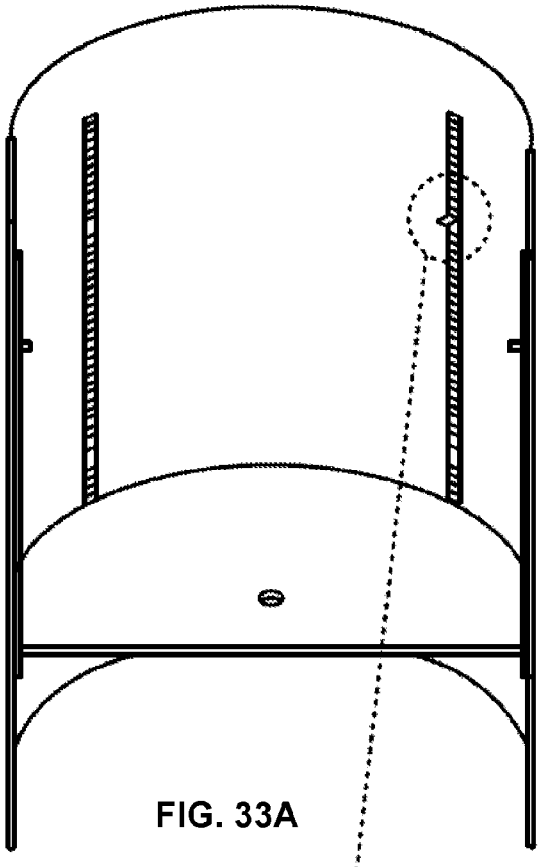
FIG. 33A is front perspective view of an embodiment of the refrigerator and vertical pilasters and a bracket located along the back interior wall of the refrigerator.

FIG. 33A is front perspective view of an embodiment of the refrigerator and vertical pilasters and a bracket located along the back interior wall of the refrigerator. A support bracket with a recessed edge has been installed into the refrigerator and is supported by mounting brackets (not shown). In some embodiments, support bracket has one or more flanges that may be inserted into slots that are located on the walls of the refrigerator or on mounting brackets coupled to the walls of the refrigerator.

Figure 33B:
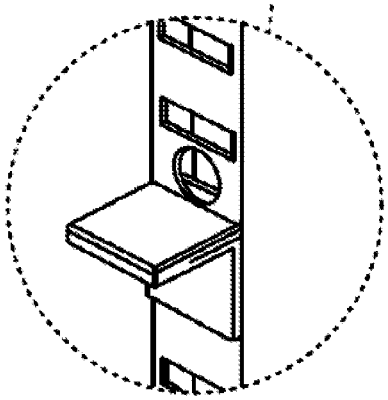
FIG. 33B is an isometric, enlarged view of a diagram of an embodiment of a vertical pilaster and bracket depicted in FIG. 33A.

FIG. 33B is an isometric, enlarged view of a diagram of an embodiment of a vertical pilaster and bracket depicted in FIG. 33A.

Referring now to FIGS. 7A-7E, various features and embodiments of a rotating drawer assembly 41 for use in a refrigerator are shown. In some embodiments, rotating drawer assembly 41 may be configured to allow it to slide towards the user and/or to rotate.

One non-limiting example of rotating drawer assembly 41 is described as follows. Rotating drawer assembly 41 may comprise outer drum 42, inner drum 43, and bearing assembly 3 disposed between outer drum 42 and inner drum 43 to facilitate the rotation of inner drum 43 relative to outer drum 42. Items to be stored may be placed in inner drum 43, which may be further partitioned by variously configured dividers 44 to create separate spaces within inner drum 43.

Figure 7A:
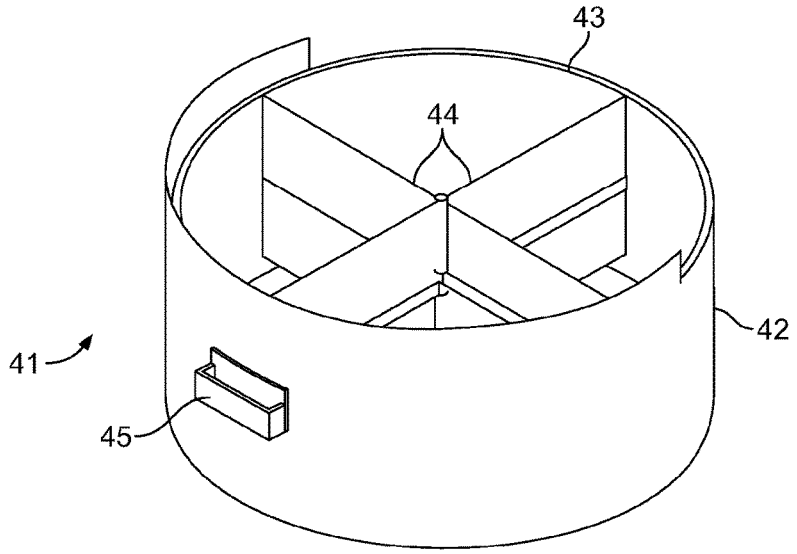
FIG. 7A is a diagram of a perspective view of an embodiment of a rotating drawer assembly for use in a refrigerator.
Figure 7B:
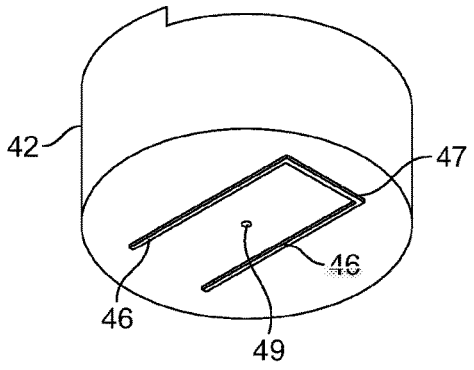
FIG. 7B is a diagram of a bottom perspective view of one embodiment of an outer drum configured for use in a rotating drawer assembly.

In some embodiments, outer drum 42 also may include handle 45 configured to allow a user to grip when sliding rotating drawer assembly 41 outward from refrigerator 18. Referring to FIG. 7B, a bottom view of an embodiment of outer drum 42 is shown. Outer drum 42 may be substantially cylindrically shaped, with an open top and closed bottom. In some embodiments the outer diameter of outer drum 42 may be slightly less than the inner width of refrigerator 18. The outer radius of outer drum 42 may also be configured to follow the radius of a curved rear portion of interior wall 161 of refrigerator 18. In some embodiments outer drum comprises a cylindrical wall and a bottom surface being a turntable 2.

Some embodiments of outer drum 42 may include at least one groove 46 configured to interlock with at least one corresponding groove 51 located on divider 29 of refrigerator 18, as seen in FIGS. 5A and 5B. When these grooves 42, 51 are mated, outer drum 42 may slide in the direction of the grooves 42, 51 when pulled or pushed by the user. In some embodiments either or both grooves 42, 51 may include bearings to facilitate the translational sliding. As pictured in FIG. 7A, outer drum 42 may also, in some embodiments, include at least one stopping groove 47 configured to limit the translational sliding of outer drum 42 by the means of front bar groove of 51. It is contemplated that other elements may be used to limit the translational sliding range of outer drum 42.

Figure 7C:
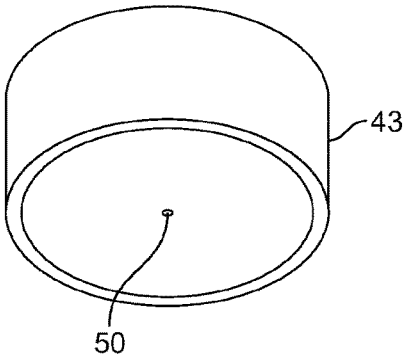
FIG. 7C is a diagram of a bottom perspective view of one embodiment of an inner drum configured for use in a rotating drawer assembly.

Referring now to FIGS. 7B and 7C, which depict bottom views of embodiments of outer drum 42 and inner drum 43. Inner drum 43 may be substantially cylindrically-shaped with an open top and closed bottom. The outer diameter of inner drum 43 may be configured to be slightly smaller than the inner diameter of outer drum 42, such that the inner drum 43 may be placed inside the outer drum 42 with a small clearance. In some embodiments, outer drum 42 may also include a small hole or recess 49 in its bottom surface configured in size and shape to selectively mate with a nub or protrusion 50 in the center of the bottom surface of inner drum 43. This configuration may maintain a substantially fixed concentric relationship between outer drum 42 and inner drum 43.

Figure 7D:
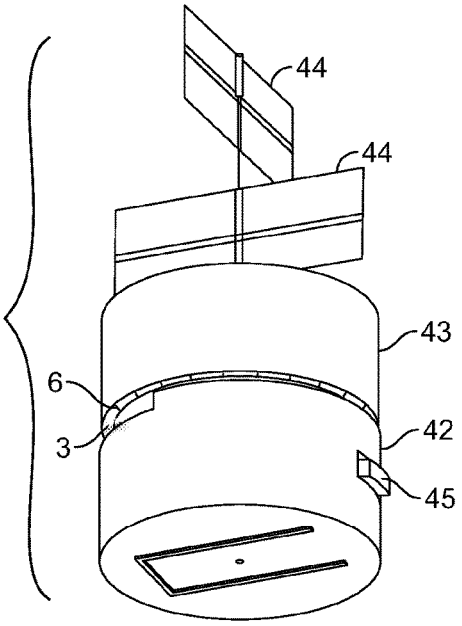
FIG. 7D is a diagram of an exploded view of an embodiment of a rotating drawer assembly as seen from a bottom perspective view, which shows the placement of a bearing assembly between an outer drum and an inner drum.
Figure 7E:
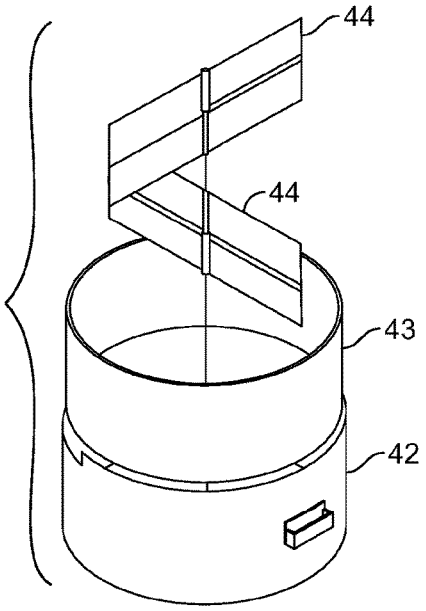
FIG. 7E is a diagram of an exploded view of an embodiment of a rotating drawer assembly as seen from a top perspective view.

An exploded view of an embodiment of a rotating drawer assembly 41 is shown in FIGS. 7D and 7E from a bottom and top perspective. In this embodiment shown in FIG. 7D, a bearing assembly 3 is included between outer drum 42 and inner drum 43 to facilitate the rotation of inner drum 43 relative to outer drum 42. In some embodiments, bearing assembly 3 may comprise a bearing assembly 3 as pictured in FIG. 14A or FIG. 12, or in FIG. 12 with at least one bearing 6 removed or at least one bearing 8 removed.

In some embodiments as shown in FIG. 7D and FIG. 7E, inner drum 43 is further configured to receive at least one divider 44 that may be configured to partition inner drum 43 into a plurality of spaces. In some embodiments as shown in FIG. 7D and FIG. 7E, the at least one divider 44 may be used to partition inner drum 43 into two, three, four, or more spaces. The at least one divider 44, also known as partition 44, may be used to divide inner drum 43 into radially divided sections. Divider 44 may be designed to lock in place when pushed all the way down. Also divider 44 may be configured to be able to rotate when divider 44 is lifted slightly upward; this may allow divider 44 to be able to be rotated until a desired partition angle is achieved and then divider 44 may be pushed down to lock divider 44 into place at the desired angle. In other embodiments, one or more dividers 44 may be configured to divide the inner drum into substantially parallel sections by forming chords across inner drum 43. In some embodiments, no dividers 44 may be used and inner drum 43 may remain unpartitioned. In some embodiments, the lip of inner drum 43 may be configured to comprise a high friction surface that may be gripped by a user when rotating inner drum 43. Inner drum 43 can also be rotated by rollers 55 protruding through slots 26.

A user may grasp the annular lip of the rotatable drawer assembly and rotate the rotatable drawer assembly in a clockwise or counterclockwise direction while at the same moving the rotatable drawer assembly forwards or backwards along a horizontal axis. In some methods, the user may grasp the annular lip of the rotatable drawer assembly and rotate the rotatable drawer assembly in a clockwise or counterclockwise direction while at the same moving the rotatable drawer assembly forwards or backwards along a horizontal axis while the rotatable drawer assembly is coupled to a resting piece and the resting piece is coupled to a track that has at least one barrier along the track which functions to provide haptic feedback to the user when the track collides with rotatable drawer assembly.

Figure 34A:
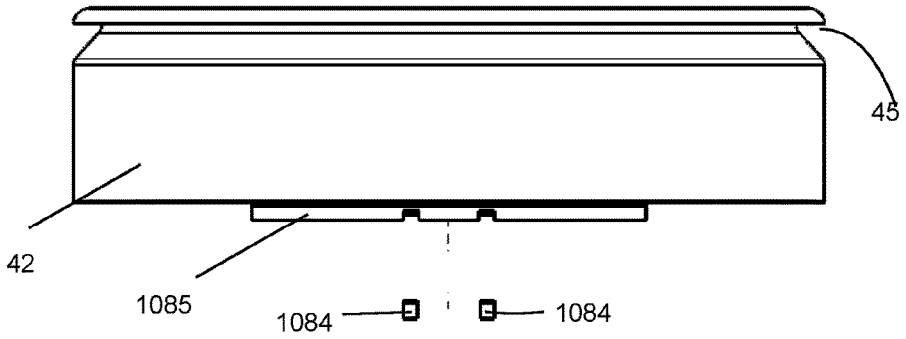
FIG. 34A is a side view of a diagram of a crisper drawer and rails

Referring to FIG. 34A, a side view of a diagram of an outer drum assembly 42 and resting piece 1085 of a rotating drawer assembly 41 and a plurality of track 1084 is depicted. Although the FIG. 7 series depicts an outer drum and an inner drum, the more preferred embodiments comprise a single drum. In one embodiment, the rotating drawer assembly 41 may comprise an outer drum assembly 42 consisting of a turntable 2 circumscribed by a cylindrical sidewall 1079, and a handle 45. The cylindrical sidewall and turntable components may be separable or a single piece. The handle 45, also known as an annular lip, may comprise an upper lip of the drum wall which has a curved shape that can receive and provide grip for a human hand, a human thumb, a plurality of human finger, a device configured for grabbing things such as grabber, or any other object that may be used to rotate an object. The handle 45 and outer drum 42 may be separable or a single piece. The handle 45 may extend continuously around the circular wall 1079 or appear in limited sections of the circumference. The handle may be used for rotating the drawer in and for moving the drawer laterally along a track 1084. The outer drum assembly 42 may be coupled to a ring-shaped bearing assembly 4 and to a resting piece 1085. The resting piece 1085 may comprise at least one resting piece channel 46 on its lower surface which may receive at least one track 1084. Handle 45 is also referred to as annular lip for purposes of this disclosure. Resting piece 1085 in some embodiments comprises a resting piece channel 46 which is a horizontal channel that is configured to receive an elongated track which may be rod-like or an elongated rectangular shape and may have additional haptic features.

Figure 34B:
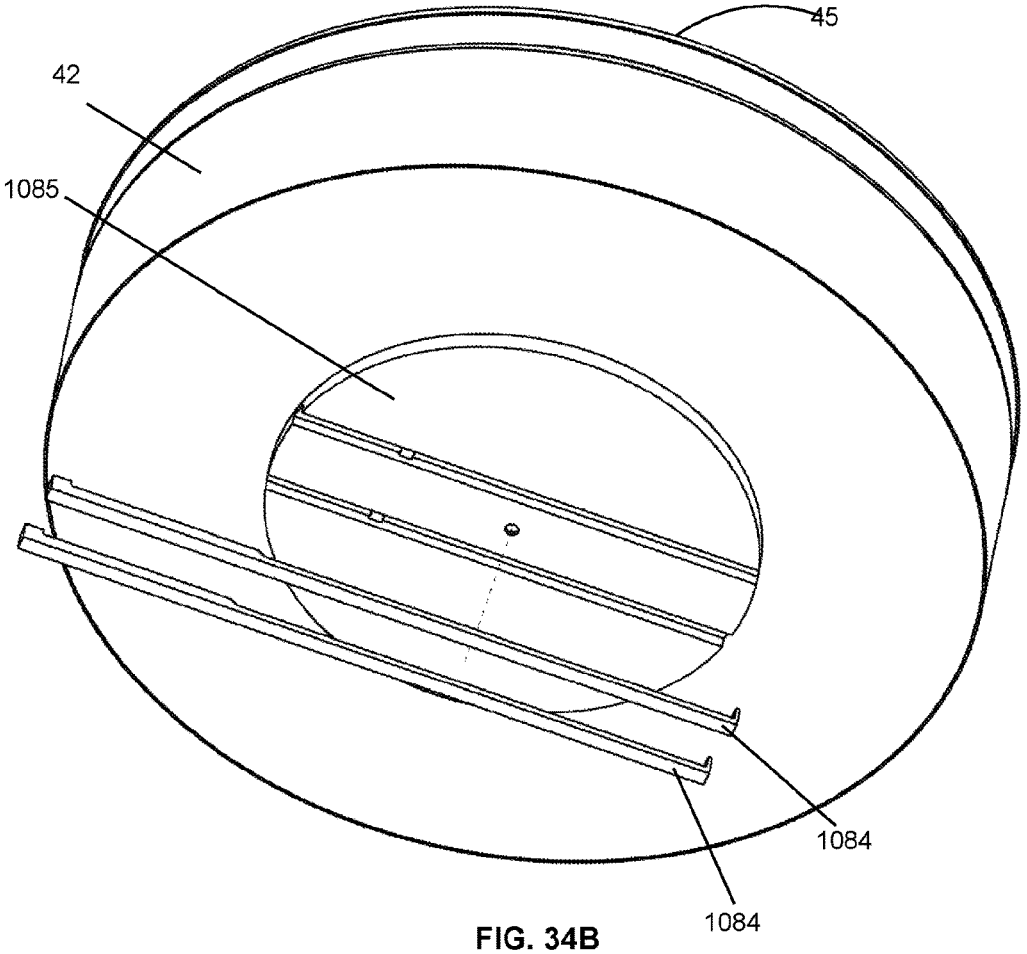
FIG. 34B is an isometric view from the bottom view of a crisper drawer, a bottom plate, and a pair or rails.

Referring to FIG. 34B an isometric view from the bottom view of a rotating drawer assembly 41, an outer drum assembly 42, a resting piece 1085, and a pair of track 1084 are depicted. One or more track 1084 may constrain the lateral movement of the rotating drawer assembly 41 to a single axis, which in preferred embodiments is constraining along the direction of forwards and backwards and limiting side-to-side movement.

Resting piece 1085 has at least one resting piece channel 46 on its lower surface which receives a track 1084. Resting piece 1085 is thus designed to ride along at least one track 1084 which is coupled to the refrigerator, and may even be extruded material, and guides the drawer assembly drawer in and out of the refrigerator compartment between a storage location and an access location. The track 1084 may be shaped in such a way as to prevent the rotatable drawer assembly from being moved unexpectedly from its storage location and to provide haptic feedback so a user may know when the drawer has been moved to the drum's usual storage location in the refrigerator compartment. The track 1084 may be an extruded component of the bottom surface of the refrigerator compartment or it may be attached or coupled to the bottom surface. In the most preferred embodiments there are one or two of track 1084. Tracks are optional; however, those embodiments which use tracks constrain the movement of the rotatable drawer assembly to forwards and backwards instead of from side to side. Thus in the preferred embodiments, the rotatable drawer assembly comprises an outer drum assembly 42 which consists of the outer drum with the bottom portion being a turntable (also known as a rotatable disc-shaped shelf), the annular lip which may function as a handle, and optional partition holders and partitions, b) a bearing assembly, and a resting piece assembly. A resting piece assembly includes the resting piece and any tracks.

Figure 35A:
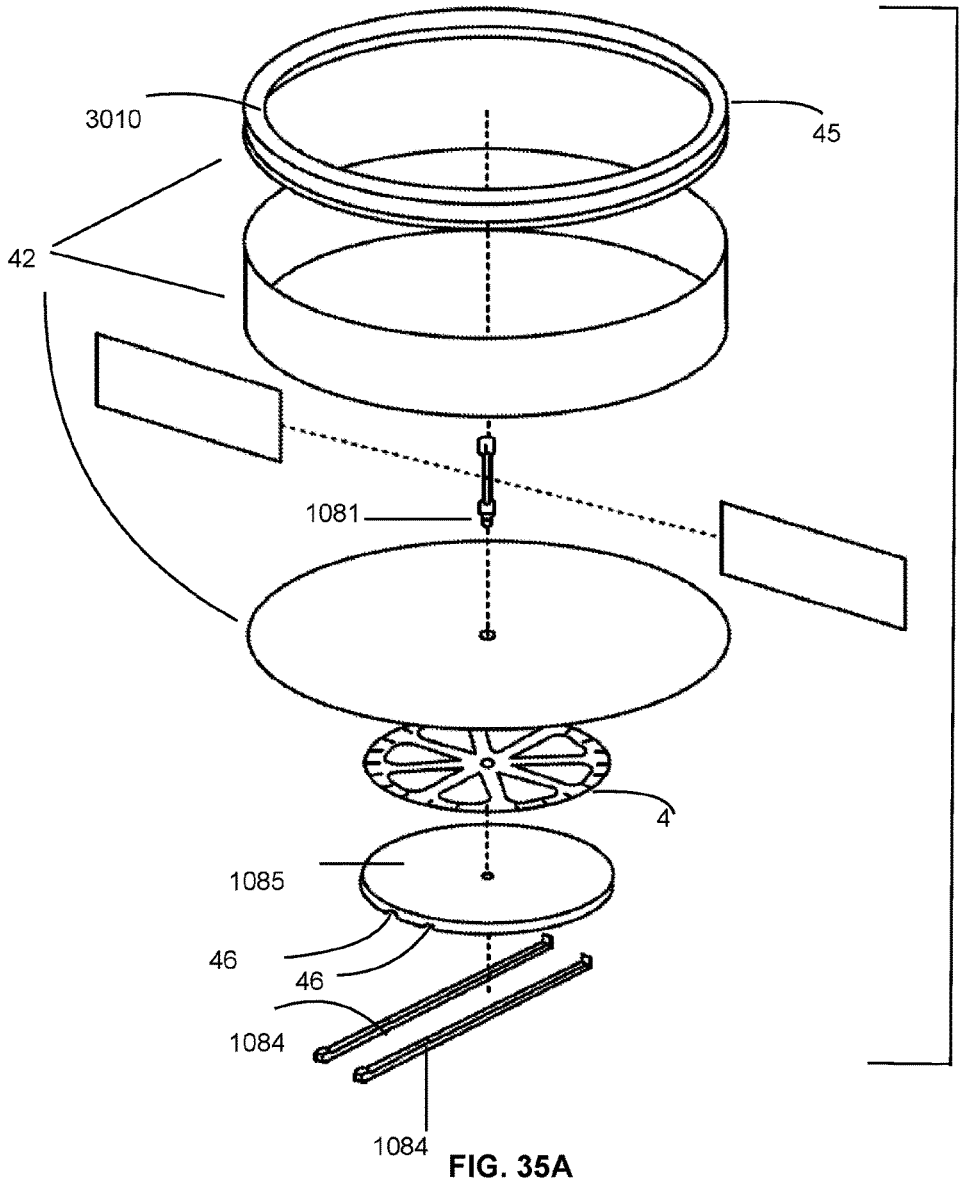
FIG. 35A is an isometric, exploded view of a diagram of a crisper drawer assembly.
Figure 35B:
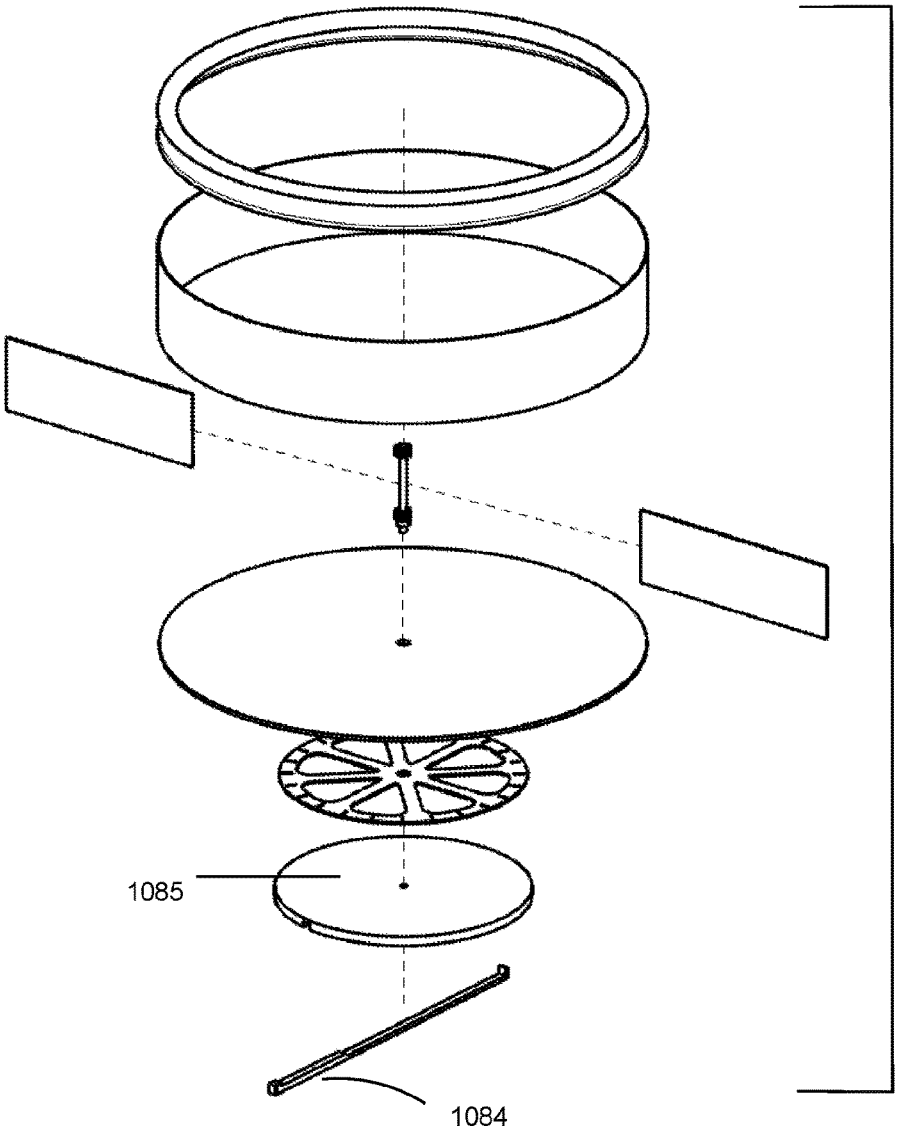
FIG. 35B is an isometric, exploded view of a diagram of a crisper drawer assembly.

Referring to FIG. 35A an isometric, exploded view of a diagram of a crisper drawer assembly are depicted. A central pin 1081 may couple the outer drum assembly 42 with a bearing assembly 3 and a resting piece 1085. The outer drum assembly 42, bearing ring 3, and resting piece 1085 each may possess a small hole 49 which receives the central pin 1081. The central pin 1081 may maintain concentricity of these three components during rotational or lateral motion. Two tracks 1084 are depicted; other embodiments may have one or more tracks and one or more Referring to FIG. 35B an isometric, exploded view of a diagram of a crisper drawer assembly are depicted. Refer to FIG. 35A's description for element numbers and parts, with the notable difference that a single track 1084 is depicted and a single resting piece channel is depicted.

Figure 36A:
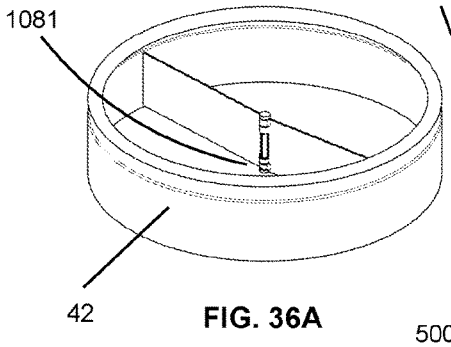
FIG. 36A is an isometric view of a diagram of an embodiment of a crisper drawer, crisper drawer partition, and crisper drawer partition holder.

Referring to FIG. 36A, an isometric view of a diagram of an embodiment of a crisper drawer, crisper drawer partition, and crisper drawer partition holder are depicted. The central pin 1081 may comprise an upper portion which protrudes and contains extruded forms which may provide multiple attachment points for a removable partition wall 1083, also known as a partition, resulting in distinct storage compartments within the outer drum assembly 42. The partition walls 1083 may be attached in multiple configurations to produce distinct storage compartments of multiple sizes.

Dividers may be formed from plastic or other materials and of the size and dimension to divide the outer drum into sectors.

Figure 36B:
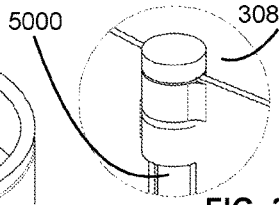

Referring to FIG. 36B, an enlarged view of the top portion of the crisper drawer partition holder shown 3080 in FIG. 36A; depicting a possibly attachment point for a partition wall 1083. A partition top holder 3080 is depicted which has space for receiving the top corner portion of at least one divider. An optional cap 4000 may be inserted into partition top holder 3080 using methods known in the art such as by screwing or by pushing a projection into a hollow space of the partition top holder 3080.

Figure 36C:
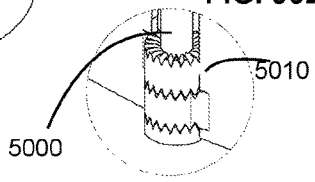

Referring to FIG. 36C, an enlarged view of the bottom portion 5010 of the crisper drawer partition holder shown in FIG. 36A are depicted. Another embodiment of an attachment point consists of grooved tooth-like extrusions existing on the central pin 1081 and partition wall 1083.

Figure 36D:
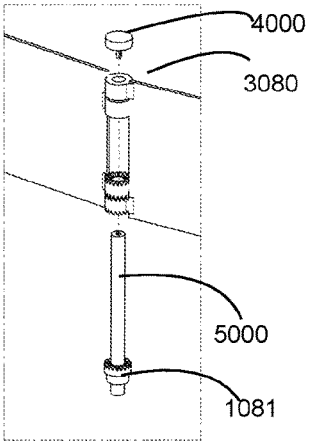

Referring to FIG. 36D, an enlarged, exploded view of the partition holder shown in FIG. 36A are depicted. The central pin 1081 may contain a central post 5000, which is a protrusion to which the partition walls 1083 attach. A cap piece 4000 may lock the central post 5000 in place and prevent contaminants from depositing on the central post 5000 and its attachment points. The optional cap piece 4000 may be inserted into partition top holder 3080 using methods known in the art such as by screwing or by pushing a projection into a hollow space of the partition top holder 3080.

Figures 37A, 37B, 37C, 37D, 37E, 37F:
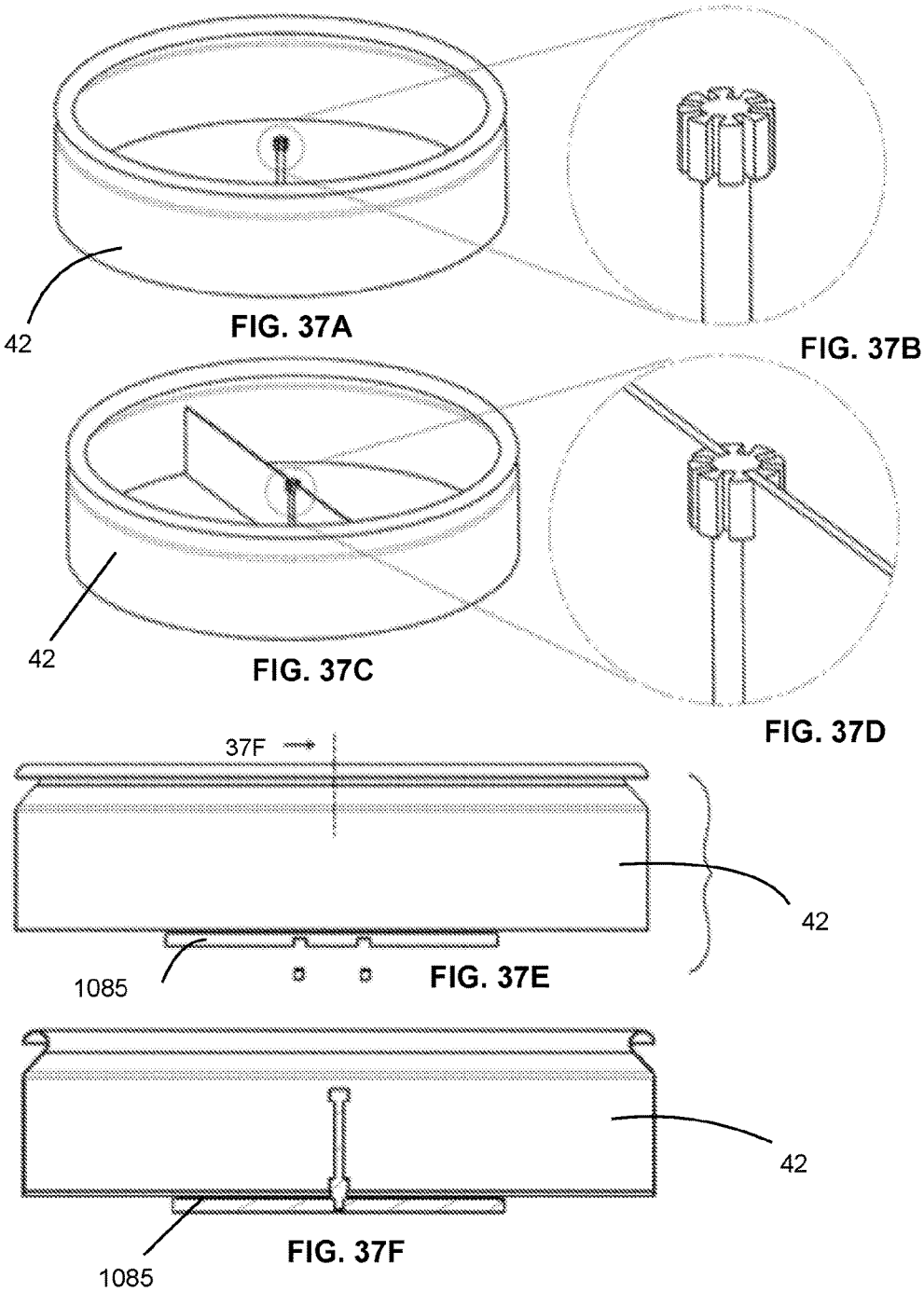

Referring to FIG. 37A, a perspective view of a diagram of an embodiment of a crisper drawer and an embodiment of a partition holder are depicted.

Referring to FIG. 37B, an enlarged view of a diagram of the partition holder shown in FIG. 37A is depicted. In another embodiment of attachment points, the central pin 1081 may comprise protrusions which form multiple slots.

Referring to FIG. 37C, a perspective view of a diagram of an embodiment of a crisper drawer, a partition, and an embodiment of a partition holder are depicted.

Referring to FIG. 37D, an enlarged view of a diagram of the partition holder shown in FIG. 37C are depicted. The slotted attachment points on the central pin 1081 may receive partition walls 1083.

Referring to FIG. 37E, a perspective view from the side of a diagram of an embodiment of a outer drum assembly 42, a resting piece 1085, and two tracks 1084 are depicted.

Referring to FIG. 37F a cross-sectional view of the crisper drawer and the bottom plate depicted in FIG. 37E are depicted.

Figure 38A:
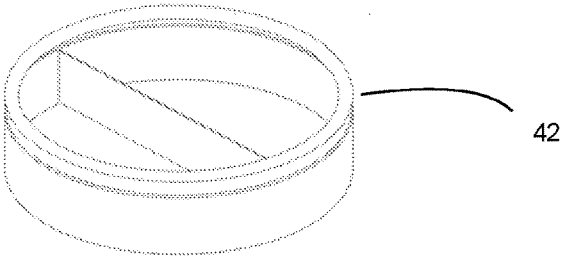

Referring to FIG. 38A, a perspective view of a diagram of an embodiment of a crisper drawer and an embodiment of a partition are depicted. An embodiment may comprise a single partition wall 1083 which divides the drawer into two storage compartments. The partition wall 1083 may be removable and may attach to multiple points on the outer drum assembly 42.

Figure 39A:
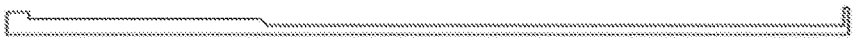

Referring to FIG. 39A, a side perspective view of a diagram of a track are depicted. The track 1085 may be shaped in such a way as to prevent the rotating drawer assembly 41 from being moved unexpectedly from its storage location and to provide haptic feedback so a user may know the location of the rotating drawer assembly 41 along the track 1085. Resting piece channel 1085 may be an extruded component of the bottom surface of the refrigerator compartment or it may be attached to the bottom surface.

Referring to FIG. 39A, a side perspective view of a diagram of a rail are depicted. Front barrier 4020 may consist of a raised edge between 0.1 inch and 6 inches in height which functions to provide resistance if a user has pulled rotatable drawer assembly too far forward and the rotatable drawer assembly is about to be pulled out of the refrigerator. Resting piece has an end piece that functions to catch against front barrier 4020; however, a user may lift the rotatable drawer assembly such that the resting piece end piece no longer catches against the front barrier 4020 and the user may then remove the rotatable drawer assembly from refrigerator 18. This type of feature is known as haptic feedback. Middle barrier 4030 may comprise a chamfered edged, a filleted edge, a rounded edge, a tilted edge, or any other type of edged that functions to provide resistance when a user has pulled the drawer out past a certain point. In preferred embodiments, middle barrier 4030 of track has a chamfered edge, which provides resistance but is also angled so that a user can pull and tilt the rotatable drawer assembly at a gradual angle to move the rotatable drawer assembly past middle barrier 4030. Middle barrier 4030 may be located at a specific distance along the track to be correlated with how far the user should be able to pull out rotatable drawer assembly before meeting resistance. In some embodiments, users may pull out from the refrigerator compartment between 10% and 90% of the length of the rotatable drawer before middle barrier 4030 of track contacts a front end piece of resting piece designed to catch against middle barrier 4030 and front barrier 4020. Back barrier 4040 is located at the back end of track and is between 0.1 and 10 inches in height and is configured to provide resistance to make it difficult for a user to push the rotatable drawer assembly so far forward into the refrigerator that the back portion of the resting piece has behind the back barrier 4040 of track.

Figure 39B:
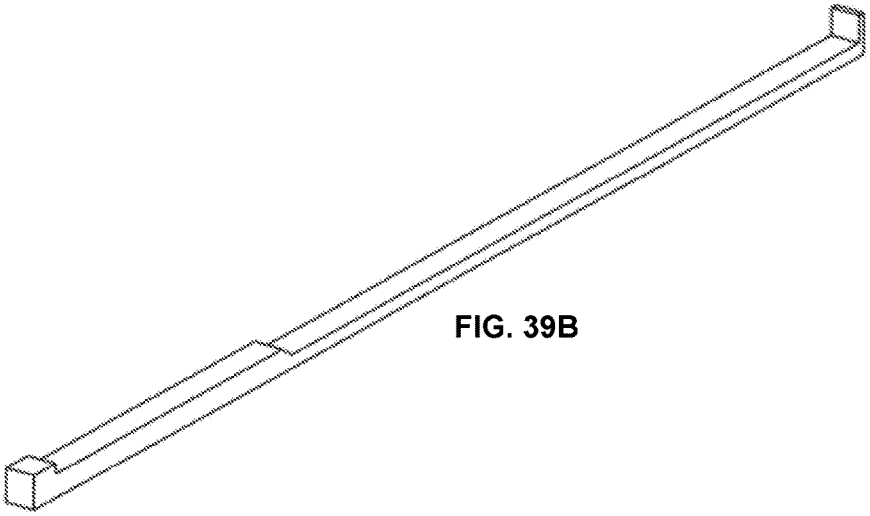

Referring to FIG. 39B, an isometric view of a diagram of a rail are depicted. See descriptions for FIG. 39A.

FIG. 40A is an isometric view from the top, front perspective of an embodiment of a pair of door shelves. See Figure descriptions for FIG. 15C and FIG. 15E.

FIG. 40B is an isometric view of an embodiment of a pair of door shelves shown in FIG. 40A. See Figure descriptions for FIG. 15C and FIG. 15E.

FIG. 41A is an isometric view from the top, front perspective of an embodiment of a pair of door shelves. See Figure descriptions for FIG. 29C and FIG. 29D.

FIG. 41B is an isometric view of an embodiment of a pair of door shelves shown in FIG. 41A;

FIG. 42A is an isometric view of diagram of an embodiment of an ice maker, a door panel, and a water dispenser;

FIG. 42B is an isometric view from the back view of a diagram of an embodiment of the ice maker, the door panel and the water dispenser depicted in FIG. 42A;

FIG. 42C is a top view of a diagram of the icemaker depicted in FIGS. 42A and 42B;

FIG. 42D is an isometric view from the side view of a diagram of the ice machine depicted in FIGS. 42A, 42B, and 42C. A ice maker housing 5100 is depicted which houses components 5110 known in the art for standard ice makers. A rotating screw 5120 extends laterally along from one end of the ice maker housing to the other end. On one end of ice maker is a cold air vent 5140 and a water tube 5150. A motor is depicted; the motor 5130 is located nearby the rotating screw. An auger 5160 is located within the ice maker. In some embodiments auger 5160 and rotating screw 5120 are part of the same device. The ice maker housing 5100 is configured to extend along the horizontal distance of a shelf contoured to a turntable as previously disclosed. In some embodiments, the distal arc of the back wall of a contoured shelf, the proximal arc of the back wall of a contoured shelf as previously disclosed, are extended substantially vertically between 2 inches and 5 feet to form a contoured chamber. Such contoured chamber 5170 may house a water machine, an ice maker, or other devices that are known to be found in refrigerators.

FIGS. 43A through 43E will now be described in further detail;

FIG. 43A is an exploded view of a bearing assembly depicted in FIG. 43E;

FIG. 43B is a top perspective view of the support bracket, shelf, and bearing assembly (not visible);

FIG. 43C is a side perspective view of the embodiment shown in FIG. 43B;

FIG. 43D is a cross sectional view of the alternative embodiment of the bearing assembly that is not visible in FIG. 43B but is visible in FIG. 43E;

FIG. 43E is a cross-sectional view diagram that is viewed from the side of a cross section taken from FIG. 43B and that shows an embodiment of a rotatable shelf assembly that comprises a shelf, a bearing assembly, and a support bracket;

Referring to FIG. 43A and the rest of the FIG. 43 series of drawings:

An apparatus for refrigerating comprising a cabinet shell including a first compartment and a second compartment, each of said first and second compartments including a respective opening for receiving items to be refrigerated, the first compartment comprising an interior wall, the interior wall comprising a rear interior wall portion;

a first side interior wall portion; and, a second side interior wall portion;

a French-style door set, the French-style door set comprising first and second French-style doors pivotally mounted to the cabinet shell about the opening of the first compartment, wherein the first French-style door comprises an outer surface and an inner surface, wherein the second French-style door comprises an outer surface and an inner surface, wherein the first French-style door is configured to rotate about a first door hinge so as to be opened in a clockwise direction and wherein the first French-style door comprises a first door shelf, the first door shelf comprising a back wall, wherein the back wall further comprises a proximal portion and a distal portion, wherein the proximal portion of the back wall is configured to contour to at least 3 percent of the perimeter of the rotatable shelf, wherein the first door shelf further comprises a floor;

wherein the second French-style door is configured to rotate about a second door hinge so as to be opened in a counterclockwise direction, wherein the second French-style door further comprises a second door shelf, wherein the second door shelf comprises a back wall, wherein the back wall of the second door shelf comprises a proximal portion and a distal portion, wherein the proximal portion of the back wall of the second door shelf is configured to contour to at least 3 percent of the perimeter of the rotatable shelf, wherein the first French-style door is configured to abut the second French-style door and wherein the first French-style door and the second French-style door are collectively characterized as a French-style door set;

at least one rotatable shelf assembly disposed within the first compartment of the apparatus, the at least one rotatable shelf assembly comprising a rotatable disc-shaped shelf comprising a circumference portion;

an annular-shaped lip coupled to the circumference portion;

an upper surface;

a lower surface; and, a bearing assembly comprising at least three bearing holders;

at least three bearings wherein the at least three bearings are each operably coupled to one of the at least three bearing holders;

a support bracket comprising an upper surface;

a lower surface;

an outer surface; and, a support bracket flange configured to physically couple with the at least one interior wall of the apparatus, the support bracket flange being further configured to orient the upper surface of the support bracket in a substantially horizontal direction within the apparatus, the support bracket being detachably coupled with the at least three bearings.

wherein the bearing assembly further comprises an upper bearing mount portion 7000, the upper bearing mount portion being configured in the shape of a toroid;

a lower bearing mount portion 7030, the lower bearing mount portion being configured in the shape of a toroid;

a top casing 7010 being coupled to an inner surface of the upper bearing mount portion;

a bottom casing 7020 being coupled to an inner surface of the lower bearing mount portion; the top casing further comprising a proximal end-portion, a central portion, and a distal end-portion, wherein the proximal end-portion further comprises a proximal end flange and wherein the distal end-portion further comprises a distal end flange;

the bottom casing further comprising a proximal end-portion, a central portion, and a distal end-portion; the proximal end-portion of the bottom casing further comprising a proximal end-flange; the distal end-portion of the bottom casing further comprising a distal end-flange;

the central portion of the top casing is configured to mate with a top portion of a bearing and wherein the central portion of the bottom casing is configured to mate with a bottom portion of a bearing;

the bottom casing is configured to be nested within the top casing to form a toroid-shaped groove, wherein the toroid-shaped groove further comprises the at least three bearing holders and the at least three bearings each operably coupled to one of the at least three bearing holders; wherein the proximal end-flange of the top casing is positioned underneath the proximal end-flange of the bottom casing and wherein the distal end-flange of the bottom casing is positioned underneath the distal end-flange of the top casing; wherein the bottom casing further comprises two inflection sections, wherein the central portion of the bottom casing is flanked on both sides by one of the inflection sections, wherein each inflection section is flanked on one side by the central portion and on the other side by the distal end portion of the bottom casing on one end and the proximal end portion on the other end and where in the inflection sections are substantially convex and wherein the distal end section and the proximal end section are substantially concave being configured to have an inner section, a bearing section, and an outer section and said bottom casing being configured to have an inner section a bearing section, and an outer section, wherein the bearing section of the top casing is configured to complement and mate with the top half of a spherical bearing and wherein the bearing section of the bottom casing is configured to complement and mate with the bottom half of the spherical bearing, wherein the bottom casing is configured to nest inside of the top casing when the upper bearing mount portion and the lower bearing mount portion are coupled; wherein the inner surface of the upper bearing mount portion directly faces the inner surface of the lower bearing mount portion.

Referring to FIG. 43E and FIG. 43F.

An apparatus for refrigerating comprising a cabinet shell including a first compartment and a second compartment, each of said first and second compartments including a respective opening for receiving items to be refrigerated, the first compartment comprising an interior wall, the interior wall comprising a rear interior wall portion;

a first side interior wall portion; and, a second side interior wall portion;

a French-style door set, the French-style door set comprising first and second French-style doors pivotally mounted to the cabinet shell about the opening of the first compartment, wherein the first French-style door comprises an outer surface and an inner surface, wherein the second French-style door comprises an outer surface and an inner surface, wherein the first French-style door is configured to rotate about a first door hinge so as to be opened in a clockwise direction and wherein the first French-style door comprises a first door shelf, the first door shelf comprising a back wall, wherein the back wall further comprises a proximal portion and a distal portion, wherein the proximal portion of the back wall is configured to contour to at least 3 percent of the perimeter of the rotatable shelf, wherein the first door shelf further comprises a floor;

wherein the second French-style door is configured to rotate about a second door hinge so as to be opened in a counterclockwise direction, wherein the second French-style door further comprises a second door shelf, wherein the second door shelf comprises a back wall, wherein the back wall of the second door shelf comprises a proximal portion and a distal portion, wherein the proximal portion of the back wall of the second door shelf is configured to contour to at least 3 percent of the perimeter of the rotatable shelf, wherein the first French-style door is configured to abut the second French-style door and wherein the first French-style door and the second French-style door are collectively characterized as a French-style door set;

at least one rotatable shelf assembly disposed within the first compartment of the apparatus, the at least one rotatable shelf assembly comprising a rotatable disc-shaped shelf comprising a circumference portion;

an annular-shaped lip coupled to the circumference portion;

an upper surface;

a lower surface; and, a bearing assembly comprising at least three bearing holders;

at least three bearings wherein the at least three bearings are each operably coupled to one of the at least three bearing holders;

a support bracket comprising an upper surface;

a lower surface;

an outer surface; and, a support bracket flange configured to physically couple with the at least one interior wall of the apparatus, the support bracket flange being further configured to orient the upper surface of the support bracket in a substantially horizontal direction within the apparatus, the support bracket being detachably coupled with the at least three bearings.

further comprising a casing wherein the casing comprises a bottom casing, an inner section of the bottom casing, a top casing, and an inner section of the top casing, wherein a first distal end and a second distal end of the inner section of the bottom casing are configured to bend upwards at least 0.1 mm from the bottom casing and nest within an inner section of the top casing, wherein the inner section of the top casing further comprises a first distal end and a second distal end wherein first and second distal ends are configured to bend downwards.

Figure 11:
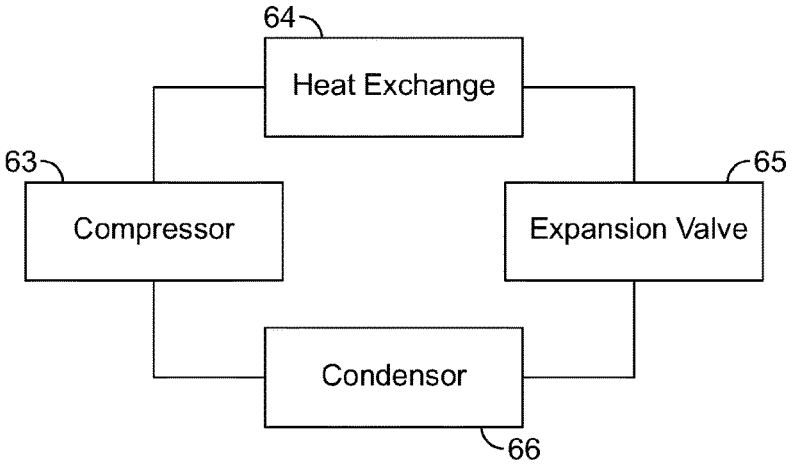
FIG. 11 is a schematic view of an embodiment of the components necessary to produce refrigerated air for use in a refrigerator comprising some embodiments of the invention.

FIG. 11 illustrates, in schematic form, the major components necessary to provide refrigerated air for refrigerator 18. Refrigerator 18 may comprise a closed loop system including a compressor 63, a heat exchange 64, an expansion valve 65, and a condenser 68, with refrigerant running through the system. Compressor 63 may pressurize the refrigerant causing it to increase in temperature and turn into a gas. The pressurized refrigerant gas then flows to the heat exchange 64 where some of the heat may dissipate returning the refrigerant to liquid form. The high-pressure liquid refrigerant than flows through expansion valve 65 into condenser 66, causing the gas to immediately vaporize and absorb the heat from within the refrigeration space 29, thus cooling the refrigerator 18. The refrigerant may then be returned to the compressor, and the cycle repeats. Heat exchange 64 and condenser 68 may comprise a series of coils.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus for refrigerating comprising a cabinet shell including a first compartment and a second compartment, each of said first and second compartments including a respective opening for receiving items to be refrigerated, the first compartment comprising an interior wall, the interior wall comprising a rear interior wall portion;

a first side interior wall portion; and, a second side interior wall portion;

a French-style door set, the French-style door set comprising first and second French-style doors pivotally mounted to the cabinet shell about the opening of the first compartment, wherein the first French-style door comprises an outer surface and an inner surface, wherein the second French-style door comprises an outer surface and an inner surface, wherein the first French-style door is configured to rotate about a first door hinge so as to be opened in a clockwise direction and wherein the first French-style door comprises a first door shelf, the first door shelf comprising a back wall, wherein the back wall further comprises a proximal portion and a distal portion, wherein the proximal portion of the back wall is configured to contour to at least 3 percent of the perimeter of a rotatable shelf, wherein the first door shelf further comprises a floor;

wherein the second French-style door is configured to rotate about a second door hinge so as to be opened in a counterclockwise direction, wherein the second French-style door further comprises a second door shelf, wherein the second door shelf comprises a back wall, wherein the back wall of the second door shelf comprises a proximal portion and a distal portion, wherein the proximal portion of the back wall of the second door shelf is configured to contour to at least 3 percent of the perimeter of the rotatable shelf, wherein the first French-style door is configured to abut the second French-style door and wherein the first French-style door and the second French-style door are collectively characterized as a French-style door set;

at least one rotatable shelf assembly disposed within the first compartment of the apparatus, the at least one rotatable shelf assembly comprising the rotatable shelf, wherein the rotatable shelf is disc-shaped, the rotatable shelf comprising a circumference portion;

an annular-shaped lip coupled to the circumference portion;

an upper surface;

a lower surface; and, a bearing assembly comprising at least three bearing holders;

at least three bearings wherein the at least three bearings are each operably coupled to one of the at least three bearing holders;

a support bracket comprising an upper surface;

a lower surface;

an outer surface; and, a support bracket flange configured to physically couple with the interior wall of the apparatus, the support bracket flange being further configured to orient the upper surface of the support bracket in a substantially horizontal direction within the apparatus, the support bracket being detachably coupled with the at least three bearings.

2. An apparatus as in claim 1, wherein the support bracket further comprises an inner surface, wherein the support bracket being detachably coupled with the at least three bearings further comprises the inner surface of the support bracket being detachably coupled with the at least three bearings.

3. An apparatus as in claim 1, wherein the support bracket being detachably coupled with the at least three bearings further comprises the upper surface of the support bracket being detachably coupled with the at least three bearings.

4. An apparatus as in claim 1, wherein the first door shelf is further configured to contour to no more than 25 percent of the perimeter of the rotatable shelf and wherein the second door shelf is further configured to contour to no more than 25 percent of the perimeter of the rotatable shelf.

5. An apparatus as in claim 4, wherein the annular-shaped lip extends along an entire perimeter of the rotatable shelf, wherein the annular-shaped lip vertically rises at least 1 mm from the horizontal plane of the rotatable shelf; wherein the annular-shaped lip further comprises a bottom portion and a top portion, wherein the bottom portion is selected from a group consisting of a fillet edge and a chamfer edge, wherein the top portion is selected from a group consisting of a substantially convex edge and a substantially flat edge.

6. An apparatus as in claim 4 wherein the outer surface of the French-style door set is defined by an arc of the French-style door set, wherein a sagittal of the arc of the French-style door set is between 0.5 inches and 22 inches in height.

7. An apparatus as in claim 4 wherein at least one motor assembly is coupled to the rotatable shelf assembly and is configured to rotate the rotatable shelf when a control switch is switched to the on position.

8. An apparatus as in claim 4 further comprising a compressor and at least one electric motor, wherein the at least one electric motor is configured to automatically rotate the at least one rotatable when the compressor of apparatus is operated.

9. An apparatus as in claim 1, wherein the back wall of the first door shelf is ogee shaped, wherein the proximal portion of the back wall of the first door shelf extends into the first compartment, and wherein the distal portion of the back wall of the first door shelf extends into the first compartment, wherein the proximal portion of the back wall of the first door shelf is substantially defined by a first arc comprising a fractional part of a first circumference defined by a first radius with a beginning point which is concentric with a center of the rotatable shelf; and, wherein the distal portion of the back wall of the first door shelf is substantially defined by a second arc comprising a fractional part of a second circumference that is defined by a second radius with a beginning point which is concentric with the first door hinge point of the first door hinge;

wherein the back wall of the first door shelf further comprises an inflection point portion separating the proximal portion of the back wall of the first door shelf from the distal portion of the back wall of the first door shelf;

wherein the back wall of the second door shelf is ogee shaped, wherein the proximal portion of the back wall of the second door shelf and the distal portion of the back wall of the second door shelf extend into the first compartment and wherein the back wall of the second door shelf further comprises a first section of the second door shelf being substantially defined by a first arc of the second door shelf comprising a fractional part of a first circumference of the second door shelf defined by a first radius of the second door shelf with a beginning point which is concentric with the center of the rotatable shelf; and, a second section of the second door shelf being substantially defined by a second arc of the second door shelf comprising a fractional part of a second circumference of the second door shelf that is defined by a second radius of the second door shelf with a beginning point which is concentric with a second door hinge point of the second door hinge, wherein the second door hinge point is concentric with a vertical rotational axis around which the second hinge rotates; and, an inflection point of the second door shelf separating the first section of the second door shelf and the second section of the second door shelf of the edge portion of the second door shelf.

10. An apparatus as in claim 9, wherein the inflection point of the first door shelf is defined by a point which is located at a distance of 20 mm or less from a point at which the first arc is tangent to the second arc.

11. An apparatus as in claim 1, wherein the edge portion of the first door shelf further comprises a distal edge portion, wherein the proximal portion of the edge portion is substantially defined by a first arc with a first radius with a beginning point which is concentric with a center of the rotatable shelf; wherein the distal edge portion is between 3.5 inches and 7 inches in length, wherein said distal edge portion is defined by a first end which is located within 20 mm of the inflection point of the first door shelf and also defined by a second end, wherein the second end is coupled with the side interior wall and wherein said distal end portion is configured to be perpendicular or within 23 degrees of perpendicular with the first side interior wall.

12. An apparatus as in claim 1, wherein the first French-style door further comprises a third door shelf, wherein the third door shelf further comprises an edge portion facing the first compartment, an interior wall, an exterior wall, a distal side wall, and a proximal side wall;

wherein the apparatus further comprises an ice-making device disposed in the third door shelf, the ice-making device comprising an interior wall, an exterior wall, a distal side wall; a proximal side wall; a motor; an ice maker housing; a rotating screw; a cold air vent; and a water tube.

13. An apparatus as in claim 1 further comprising at least one section of the rear interior wall residing rearward of the rear portion of the rotatable shelf and generally aligned along a horizontal plane passing through both the rotatable shelf and the at least one section of the rear interior wall, wherein the at least one section of the rear interior wall is concaved, contoured to complement a peripheral rim of the rear portion of the rotatable shelf, and configured to establish clearance between the rotatable shelf and the at least one section of the rear interior wall when the rotatable shelf is being rotated.

14. An apparatus as in claim 1 wherein the bearing assembly further comprises a retaining member operably coupled with at least one of the support bracket or the rotatable shelf; wherein the retaining member is configured to limit the rotatable shelf from shifting laterally a distance greater than 2 inches when the rotatable shelf is being rotated about a vertical axis of rotation.

15. An apparatus as in claim 1 wherein the bearing assembly comprises a bearing assembly, the bearing assembly comprising an inner bearing assembly comprising a plurality of inner bearing housings; and, an outer bearing assembly comprising a plurality of outer bearing housings;

the inner bearing assembly is configured with a circular groove positioned on an outer edge of the inner bearing assembly; and, the outer bearing assembly further comprises a circular groove positioned on an outer edge of the outer bearing assembly;

wherein the inner bearing assembly is positioned so as to nest within the outer bearing assembly; and, wherein the groove of the inner ring and the groove of the outer ring are configured to jointly form a torus-shaped channel, said channel being configured to receive at least three bearings, wherein only one of the inner bearing housing and the outer bearing housing is frictionally coupled to the rotatable shelf such that the rotatable shelf and the one of the inner bearing housing and the outer bearing housing are configured to jointly rotate about a vertical axis that is concentric with the center of the rotatable shelf.

16. An apparatus as in claim 15, wherein exclusively one of the inner bearing assembly or the outer bearing assembly is a selected bearing assembly being selected from the group consisting of the inner bearing assembly and the outer bearing assembly and is also positioned to be elevated with respect to the one of the group consisting of the inner bearing assembly and the outer bearing assembly which is not the selected bearing assembly, wherein at least some portion of an upper surface of the selected bearing assembly is frictionally coupled with the rotatable shelf and is also configured to rotate jointly with the rotatable shelf when the rotatable shelf is rotated.

17. An apparatus as in claim 1, wherein the support bracket is configured to be an annulus wherein a main body of the annulus extends sufficiently so that the distal edge of a central void of the annulus is positioned to be closer to the central axis of a rotatable shelf when the rotatable shelf is placed on the support bracket in correct alignment with respect to a retaining member.

18. An apparatus as in claim 1 wherein the bearing assembly is further configured into an annular ring.

19. An apparatus as in claim 1 wherein the support bracket is further configured into the shape of an annular ring.

20. An apparatus as in claim 19 wherein the support bracket further comprises a depressed annular-shaped groove configured to receive the bearing assembly.

21. An apparatus as in claim 19, wherein a front portion of the support bracket has a recessed edge so as to allow a rotatable disc shaped shelf coupled to the top surface of the support bracket to overhang the support bracket by a distance of at least one inch measured from a perimeter of the rotatable shelf to the nearest point of the recessed edge of the support bracket, wherein the perimeter of the rotatable shelf that corresponds to the support bracket is between 15% and 55% of the total perimeter of the rotatable shelf.

22. An apparatus as in claim 1, wherein the support bracket further comprises an extruded disc configured to be inserted into the bearing assembly, wherein the extruded disc is configured to maintain the position of the bearing assembly as relatively concentric with the support bracket when the annular ring is coupled to the support bracket.

23. An apparatus as in claim 1 further comprising at least two L-brackets, at least two vertically-aligned side pilasters wherein the at least two vertically-aligned side pilasters are configured to couple to one L-bracket selected from the group consisting of the at least two L-brackets, at least one L-bracket coupled to both the vertically aligned rear pilaster and the support bracket, and at least side interior wall of the apparatus, wherein a rear portion of the support bracket is configured to couple with the rear interior wall of the apparatus, wherein the support bracket further comprises a support slot configured to engage with the at least one vertically aligned pilaster so as to prevent the forward sliding of the support bracket when the rear support of the support bracket is coupled to the vertically-aligned rear pilaster and also substantially parallel to a horizontal plane.

24. An apparatus as in claim 1, wherein the support bracket further comprises a pin and wherein the rotatable shelf further comprises a pinhole configured to mate with the pin and maintain the concentricity of the rotatable shelf with the support bracket when the pin is mated to the pin hole; wherein the pin is configured to keep the rotatable shelf assembly concentric with a vertical axis of rotation.

25. An apparatus as in claim 1 further comprising a cylindrical sidewall coupled to the upper surface of the rotatable shelf to define an interior space;

at least one partition, wherein the at least one partition is configured to divide the interior space into at least two sectors;

an annular lip circumscribing the upper perimeter of the cylindrical sidewall; the annular lip being detachable or molded to the cylindrical sidewall;

the annular lip further being a generally inverted U-shape directed radially outward from the center of the rotatable shelf and configured to provide sufficient space for at least one human finger to be inserted into a space between the annular lip and the cylindrical side wall.

26. An apparatus as in claim 25, further comprising 3 partitions wherein the total number of partitions is four and the four partitions are configured to divide the inner space into four sectors.

27. The apparatus as in claim 25 further comprising at least one track;

at least one resting piece configured to have at least one channel that is configured so that the at least one track is insertable into the at least one channel; wherein a top surface of resting piece is configured to be operably coupled with the bottom surface of the bearing assembly, wherein the rotatable shelf is coupled to a cylindrical sidewall which circumscribes the rotatable disc, wherein the rotatable disc shaped shelf is configured to rotate around a vertical axis simultaneously while being moved in a forward, lateral direction towards the opening of the inner compartment, wherein the at least one partition is configured to be coupled with a central post and to divide the rotatable disc assembly into two or more sectors.

* * * * *